US011498818B2

(12) United States Patent
Koehler et al.

(10) Patent No.: US 11,498,818 B2
(45) Date of Patent: Nov. 15, 2022

(54) VEHICLE SUPPORT ASSEMBLY

(71) Applicants: Steven M. Koehler, Orono, MN (US); Stanley M. Koehler, Eden Prairie, MN (US)

(72) Inventors: Steven M. Koehler, Orono, MN (US); Stanley M. Koehler, Eden Prairie, MN (US)

( * ) Notice: Subject to any disclaimer, the term of this patent is extended or adjusted under 35 U.S.C. 154(b) by 224 days.

(21) Appl. No.: 17/095,732

(22) Filed: Nov. 11, 2020

(65) Prior Publication Data

US 2021/0171328 A1 Jun. 10, 2021

Related U.S. Application Data

(63) Continuation-in-part of application No. PCT/US2020/031386, filed on May 4, 2020.
(Continued)

(51) Int. Cl.
*B66F 7/28* (2006.01)
*B66F 7/12* (2006.01)

(52) U.S. Cl.
CPC . *B66F 7/28* (2013.01); *B66F 7/12* (2013.01)

(58) Field of Classification Search
None
See application file for complete search history.

(56) References Cited

U.S. PATENT DOCUMENTS 2,552,974 A 5/1951 Johnson
3,877,548 A 4/1975 Hernick
(Continued)

FOREIGN PATENT DOCUMENTS

DE 1184479 B 12/1964
DE 1225362 B 9/1966
(Continued)

OTHER PUBLICATIONS

International Search Report and Written Opinion in corresponding International Patent Application No. PCT/US2020/031386 dated Jul. 30, 2020.

*Primary Examiner* — Joseph J Hail
*Assistant Examiner* — Dana Lee Poon
(74) *Attorney, Agent, or Firm* — Steven M. Koehler; Westman, Champlin & Koehler, P.A.

(57) ABSTRACT

A vehicle support assembly mountable to a runway vehicle lift having a frame with a plurality of vertically oriented spaced apart support, a rack having a plurality of portions, wherein each portion is movably coupled to a different vertically oriented support, a runway vehicle support supported on the rack, a lift actuator coupled to the rack to move the rack and the runway vehicle support up and down. The vehicle support assembly comprising: a pair of carriage assemblies, each carriage assembly having an arm carriage and a two movable arms, each arm having a first end coupled to the arm carriage and a second end configured to engage an undercarriage of a vehicle; and a pair of posts wherein each post supports a carriage assembly, each post being movably coupled to the runway vehicle lift with a mount to move the post to and from a first position wherein the post is arranged vertically with the arms extended to support the vehicle above the runway vehicle support and a second storage position wherein the post is displaced from the first position.

21 Claims, 70 Drawing Sheets

Related U.S. Application Data

(60) Provisional application No. 62/942,589, filed on Dec. 2, 2019, provisional application No. 62/843,145, filed on May 3, 2019.

(56) References Cited

U.S. PATENT DOCUMENTS

| | | | | | |
|---|---|---|---|---|---|
| 4,084,790 | A * | 4/1978 | Molnar | B66F 7/02 | 254/90 |
| 4,086,982 | A * | 5/1978 | Hernick | B66F 7/04 | 187/206 |
| 4,267,901 | A | 5/1981 | Tsujimura | | |
| 4,599,034 | A | 7/1986 | Kennedy et al. | | |
| 6,814,342 | B1 * | 11/2004 | Perlstein | B66F 7/02 | 254/133 R |
| 8,256,577 | B2 | 9/2012 | Kritzer | | |
| 9,150,395 | B2 | 10/2015 | Kritzer | | |
| 2019/0144249 | A1 * | 5/2019 | Bartos | B66F 7/065 | 187/211 |

FOREIGN PATENT DOCUMENTS

| | | | |
|---|---|---|---|
| DE | 1258575 | B | 1/1968 |
| FR | 2108882 | A1 * | 10/1970 |
| FR | 2108882 | A1 | 5/1972 |
| FR | 2326376 | A1 | 4/1977 |
| KR | 2019990017651 | U | 5/1999 |
| KR | 101266029 | B1 | 5/2013 |
| RU | 51380 | U1 | 2/2006 |

* cited by examiner

VEHICLE SUPPORT ASSEMBLY

BACKGROUND

The discussion below is merely provided for general background information and is not intended to be used as an aid in determining the scope of the claimed subject matter.

There exist two commonly used forms of vehicle lifts. A first version of a vehicle lift includes spaced-apart vertically oriented supports. A rack is guided up and down on the supports having spaced-apart runways that a vehicle can be driven on and used to support the vehicle in an elevated position. A lift mechanism can include separate actuators coupled to each corner of the rack, or a single actuator coupled with cabling to each corner of the rack. Commonly this type of lift assembly is referred to a four-post or runway vehicle lift.

A second form of lift assembly includes two vertically-oriented posts. A carriage moves up and down on each post and carries movable arms that can be configured to engage the underside of a vehicle, typically, the frame or other lift points designated by the manufacturer. A lift mechanism includes separate actuators for each carriage and post, or a single actuator coupled with cabling to each of the carriages. Commonly, this version of a vehicle lift is referred to as a two-post vehicle lift.

The runway or four-post vehicle lift is well-suited for long term or temporary storage of a vehicle since the vehicle can be driven on and off the lift. The lift supports the vehicle on its tires in a normal operating position. However, this type of lift is not particularly well-suited for working on the vehicle, particularly, from below since the runways are present and due to their width to accommodate vehicles of varying width from, for example, a small compact car to a full size large pickup of, the runways significantly obstruct or at least hamper access to portions of the vehicle where work needs to be performed such as the suspension components of the vehicle.

In contrast, the two-post vehicle lift is well-suited for working on vehicles since the wheel assemblies hang freely from the vehicle and the vehicle is supported by arms that extend outwardly from the vehicle thus exposing the complete underside of the vehicle. However, storage of vehicles with this type of vehicle lift is not recommended because the wheel assemblies are hanging from the vehicle, and the suspension components are unsprung, which can cause damage to the vehicle such as the suspension if left in this condition for a period of time.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

One general aspect includes a vehicle support assembly mountable to a runway vehicle lift having a frame with a plurality of vertically oriented spaced apart supports. The vehicle support assembly also includes a pair of carriage assemblies, each carriage assembly having an arm carriage and a two movable arms. Each arm has a first end coupled to the arm carriage and a second end configured to engage an undercarriage of a vehicle. A pair of posts are included. Each post supports a carriage assembly. Each post is movably coupled to the runway vehicle lift with a mount to move the post to and from a first position where the post is arranged vertically with the arms extended to support a vehicle above the runway vehicle support and a second storage position where the post is displaced from the first position.

Implementations may include one or more of the following features. The vehicle lift assembly where each carriage assembly is movable on each respective post. Each carriage assembly is coupled to the mount that is securable to the runway vehicle support. Each carriage assembly includes an arm carriage driver movable on the associated post, the arm carriage driver coupled to the mount and disposed on the post below the associated arm carriage, the arm carriage driver being separable from the associated arm carriage and movable on the associated post when the runway vehicle support is lowered. Each carriage assembly can be pivotally coupled to the mount allowing each associated post to be inclined with respect to the runway vehicle support. The storage position may include each post being oriented parallel to the runway vehicle support, and where the posts move up and down with the rack and runway vehicle support. Each carriage assembly can be slidably coupled to a horizontal guide allowing each associated carriage assembly and post to move alongside the runway vehicle support. The horizontal guides are stationary relative to movement of the runway vehicle support. Each carriage assembly is slidably coupled to the runway vehicle support allowing each associated carriage assembly and post to move alongside the runway vehicle support. The storage position may include each post and carriage assembly disposed proximate an end of the runway vehicle support. Each carriage assembly can also be pivotally coupled to the mount allowing each associated post to be inclined with respect to the runway vehicle support. The storage position may include either the post being oriented parallel to the runway assembly, and where the posts move up and down with the rack and runway vehicle support, or the post and carriage assembly disposed proximate an end of the runway vehicle support.

The vehicle lift assembly may include a pair of carriage locks, each carriage lock being configured to hold one of the arm carriages at a selected elevated position on each associated post. The carriage assemblies are coupled to the runway vehicle support where the selected elevated position of each arm carriage is obtained by moving the runway vehicle support vertically to move the arm carriage on each respective post. The arms are configured to be placed under the undercarriage of a vehicle with the vehicle supported by the runway vehicle support in the elevated positions, and where the arms support the vehicle in the selected elevated position when the runway vehicle support is lowered and separated from the vehicle.

The two-post support assembly can include a second lift actuator configured to move the arm carriages with respect to each associated post. Alternatively, the two-post support assembly does not include any lift actuator to directly move either one or both of the arm carriages.

A second general aspect includes a method for supporting a vehicle. The method includes supporting the vehicle on a runway vehicle support of a runway vehicle lift, where a two-post support assembly is joined to the runway vehicle support, each post having a storage position and an operating position where the post is arranged vertically adjacent one of the runway vehicle supports. Each post has arms couplable or coupled thereto. The method includes moving each post from the storage position to the operating position, locating arms of a two-post vehicle support above the runway vehicle support and below an underside of the vehicle, and lowering the runway and the vehicle such that the vehicle is supported by the arms.

Implementations may include one or more of the following features. The method where lowering the runway includes lowering the runway vehicle support until the vehicle is entirely supported by the arms. The arms are mounted on a carriage movable on each post, and the method further may include selectively fixing a position of the carriage on each post. The method may include coupling each carriage to the runway vehicle support to move vertically on each post with vertical movement of the runway vehicle support. Coupling can include coupling each carriage to the runway vehicle support to pivot on the runway vehicle support. Coupling can also include if desired coupling each carriage to the runway to move along at least a portion of a length of the runway vehicle support.

A third general aspect includes a runway vehicle lift including a frame having a plurality of vertically oriented spaced apart supports and a rack having a plurality of portions, where each portion is movably coupled to a different vertically oriented support. A runway vehicle support is supported on the rack. A first lift actuator is coupled to the rack to move the rack and runway vehicle support up and down. The assembly also includes a two-post support assembly including: a pair of posts; a pair of carriage assemblies, where a carriage assembly is slidably coupled to one of the posts, the carriage assembly having two movable arms, each arm having a first end coupled to the carriage assembly and a second end configured to engage an undercarriage of a vehicle. A second lift actuator is coupled to the carriage assemblies or a second lift actuator coupled to each carriage assembly. The assembly also includes a pump selectively coupled to the first lift actuator to raise the rack and runway vehicle support or to the second lift actuator or actuators to lift the carriage assemblies.

Implementations may include one or more of the following features. The vehicle lift assembly may include a valve coupled to the pump and the first lift actuator and to the second lift actuator or actuators, the valve selectively directing fluid from the pump to the first lift actuator and to the second lift actuator or actuators.

A fourth general aspect includes a vehicle support assembly mountable to a runway vehicle lift having a frame with a plurality of vertically oriented spaced apart supports. The vehicle support assembly also includes at least a pair of carriage assemblies, each carriage assembly securable to one of the runway vehicle supports with a mount. The carriage assembly has an arm carriage and at least one movable arm, each arm having a first end coupled to the arm carriage and a second end configured to engage an undercarriage of a vehicle. At least a pair of posts are provided where each post supports one of the carriage assemblies and is disposed adjacent one of the runways where the arms extends over at least a portion of the associated runway. Each arm carriage is movable along a length of each associated post and fixable to the associated post at different positions along the length the associated post. The posts are movably coupled to the runway vehicle lift to move to and from a first position where the posts are arranged vertically with the arms extended to support a vehicle above the runway vehicle support and a second storage position where the posts are displaced from the first position.

Implementations may include one or more of the following features. The vehicle support assembly where the carriage assembly may include an arm carriage driver slidable on one of the posts, the arm carriage driver being disposed below the arm carriage and configured to engage the arm carriage to raise and lower the arm carriage on the post, the arm carriage driver being secured to the mount. The post can be pivotally coupled to the arm carriage driver. The vehicle support assembly may include a removable pivot pin to selectively couple the post to the arm carriage driver. The arm carriage driver can be pivotally coupled to the mount A fifth general aspect includes a vehicle support including a post having a plurality of apertures spaced apart along a length of the post. The post has a base. An arm carriage has two sets of spaced apart apertures extending along a length of the arm carriage. A pair of pins are provided, each pin being insertable through a set of spaced apart apertures in the arm carriage and a pair of apertures in the post.

Implementations may include one or more of the following features. The vehicle support may include an arm carriage driver guided on the post, the arm carriage driver disposed between the base and the arm carriage, the arm carriage driver configured to engage and displace the arm carriage on the post. The arm carriage driver can include a portion configured to be mounted to a runway of a vehicle lift. The arm carriage driver can be pivotally connected to the portion. The arm carriage driver can be slideably connected to the portion for linear displacement A sixth general aspect includes a vehicle support including a post having a plurality of apertures spaced apart along a length of the post, the post having a base. An arm carriage has a crossbeam receiver. A crossbeam has a first end insertable into the crossbeam receiver in a limited manner such that the first end of the crossbeam extends past a first end of the crossbeam receiver and a second end of the crossbeam extends past a second end of the crossbeam receiver. An end cap is mountable to the first end of the crossbeam. A first arm is removably mounted to the end cap,while and a second arm is mounted to the second end of the crossbeam.

Implementations may include one or more of the following features. The vehicle support where each end of the crossbeam includes a pair of apertures, the end cap having apertures alignable with the apertures of the crossbeam on the first end when the end cap is mounted to the first end. The vehicle support may include a first pin to mount the first arm to the end cap, the first pin being insertable in the apertures of the end cap and apertures of the first end of the crossbeam, and a second pin to mount the second arm to the second end of the crossbeam, the second pin being insertable in the apertures of the second end of the crossbeam. The arm carriage and post can be configured to selectively locate the crossbeam on a first side of the post or a second side of the post, the second side of the post facing in a direction opposite the first side of the post.

A seventh general aspect includes a vehicle support assembly mountable to a runway vehicle lift having a frame with a plurality of vertically oriented spaced apart supports. The vehicle support assembly also includes a pair of posts, and a pair of carriage assemblies, where a carriage assembly is associated with and movable on one of the posts. Each carriage assembly includes an arm carriage and a two movable arms. Each arm has a first end coupled to the arm carriage and a second end configured to engage an undercarriage of a vehicle, each carriage assembly being coupled to the rack or the runway vehicle support with a mount to raise and lower with the rack and the runway vehicle support.

Implementations may include one or more of the following features. The vehicle lift assembly where each arm carriage is configured to rotate the post. Each mount can includes a guide coupled to one the arm carriages, the guide can be configured to move the post along at least a portion of a length of the runway vehicle support. The runway vehicle support may include two pairs of spaced apart runways, and the assembly may include a second two-post support assembly having a second pair of posts; and a second pair of carriage assemblies, where a carriage assembly of the second pair of carriage assemblies is associated with and movable on one of the posts of the second pair of posts, each carriage assembly of the second pair of carriage assemblies including an arm carriage and a two movable arms, each arm having a first end coupled to the arm carriage and a second end configured to engage an undercarriage of a second vehicle, each carriage assembly of the second pair of carriage assemblies being coupled to the rack or the other pair of spaced apart runways with a second mount to raise and lower with the rack or the other pair of spaced apart runways. Adjacent posts in a center of the rack can be locatable in non-horizontal storage positions to provide space for a walkway between adjacent runways used for adjacent vehicles on the rack. The vehicle lift assembly and at least one pivotable, telescoping jack stand can be coupled to a runway and have an end engagable with the vehicle. The vehicle lift assembly can include at least one flexible member coupled to frame, rack or runway at a first end and connectable to the vehicle at a second end.

DETAILED DESCRIPTION OF ILLUSTRATIVE EMBODIMENTS

Figure 1:
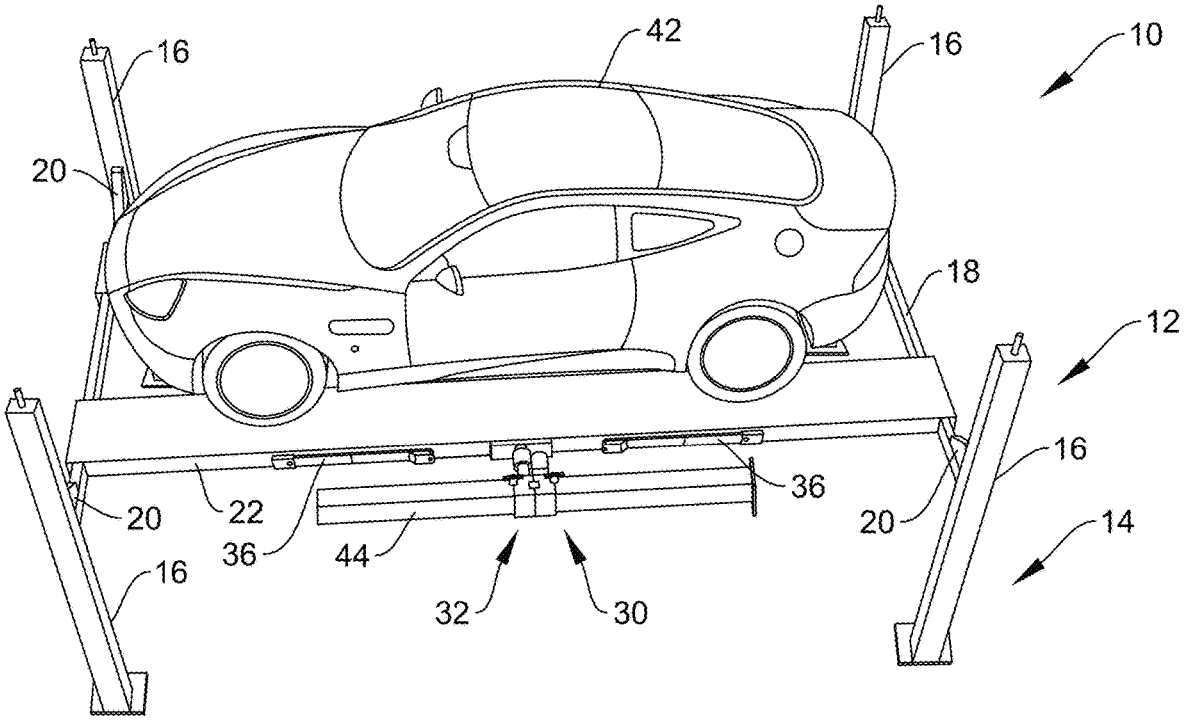
FIG. 1 is a perspective view of a vehicle support assembly mounted to a vehicle lift.

Various embodiments of vehicle lifts of the present disclosure are illustrated in the figures. In addition, as explained below some aspects herein disclosed can be incorporated on two post lifts without being mounted to a runway type vehicle lift.

Generally, as one aspect of the present disclosure, a vehicle lift assembly includes a runway vehicle lift having a frame with a plurality of vertically oriented spaced apart supports. A rack has a plurality of guided portions, wherein each guided portion is movably coupled to a different vertically oriented support. A runway vehicle support, typically a pair of horizontal runways, is supported on the rack. A lift mechanism comprising one or more actuators is coupled to the rack to move the rack and the runways up and down.

The vehicle lift assembly also includes a two-post support assembly. The two-post vehicle support lift assembly has a pair of carriage assemblies. Each carriage assembly has an arm carriage having two movable arms. Each arm includes a first end coupled to the arm carriage and a second end configured to engage an undercarriage of a vehicle. A pair of posts are provided. Each post supports a carriage assembly. The posts are movably coupled to the runway vehicle lift to move to and from a first position wherein the posts are arranged vertically with the arms extended to support a vehicle above the runways and a second, storage position wherein the posts are displaced from the first position.

A first embodiment of a vehicle lift assembly 10 is illustrated in FIGS. 1-18 and includes a runway vehicle lift 12. The runway vehicle lift 12 includes a frame 14 having a plurality of vertically oriented spaced apart supports 16. A rack 18 includes a plurality of guided portions 20. Each guided portion 20 is movably coupled to a different vertically oriented support 16. A runway vehicle support, herein embodied as a pair of spaced apart runways 22, is supported on the rack 18. A lift mechanism is coupled to the rack 18 to move the rack 18 and the runways 22 up and down. Known lift mechanisms include an actuator (not shown) located in each support that is coupled to each corresponding guided portion 20. The actuators are operated in unison to raise and raise and lower each corner of the rack 18. A second known lift mechanism discussed below uses a single actuator and cabling coupled to actuator and the each guided portion 20.

The vehicle lift assembly 10 also includes a two-post support assembly 30, which includes a pair of carriage assemblies 32. Each carriage assembly 32 has an arm carriage 34 and two moveable arms 36. Each arm 36 has a first end 38 coupled to the arm carriage 34 and a second end 40 configured to engage an undercarriage of a vehicle 42, herein exemplified as a car but could also be a motorcycle where a single post and set of arms can be used to hold the motorcycle. Of course, the two-post support assembly can be used to support any type of load such as a trailer or the like.

A pair of posts 44 is movably coupled to the runway vehicle lift 12. Each post 44 supports a carriage assembly 32. The posts 44 move to and from a first position (vehicle or load support position) wherein the posts 44 are arranged vertically with the arms 36 extended to support the load herein the vehicle 42 above the runways 22, and a second storage position wherein the posts 44 are displaced from the first position. In the embodiment of FIGS. 1-18, the storage position of the posts 44 is illustrated as being parallel to the runways 22 wherein each carriage assembly 32 allows the respective posts 44 to rotate from a vertically oriented position to a horizontally oriented position. Preferably, the carriage assembly 32 is configured and mounted to each respective runway 22 such that when the posts 44 are in the horizontal position, the runways 22 can be lowered to the ground, or at least close enough to the ground allowing ramps typically provided with such four-post runway lifts to allow the vehicle to drive on and off the runways 22.

In the storage position, the arms 36 have been removed from the carriage assemblies 32 so as to allow the posts 44 to be horizontally oriented and move up and down with the rack 18. In the storage position, the arm 36 can be mounted to the runways 22, for example, along a side thereof with suitable mounting brackets not specifically shown.

Figure 2:
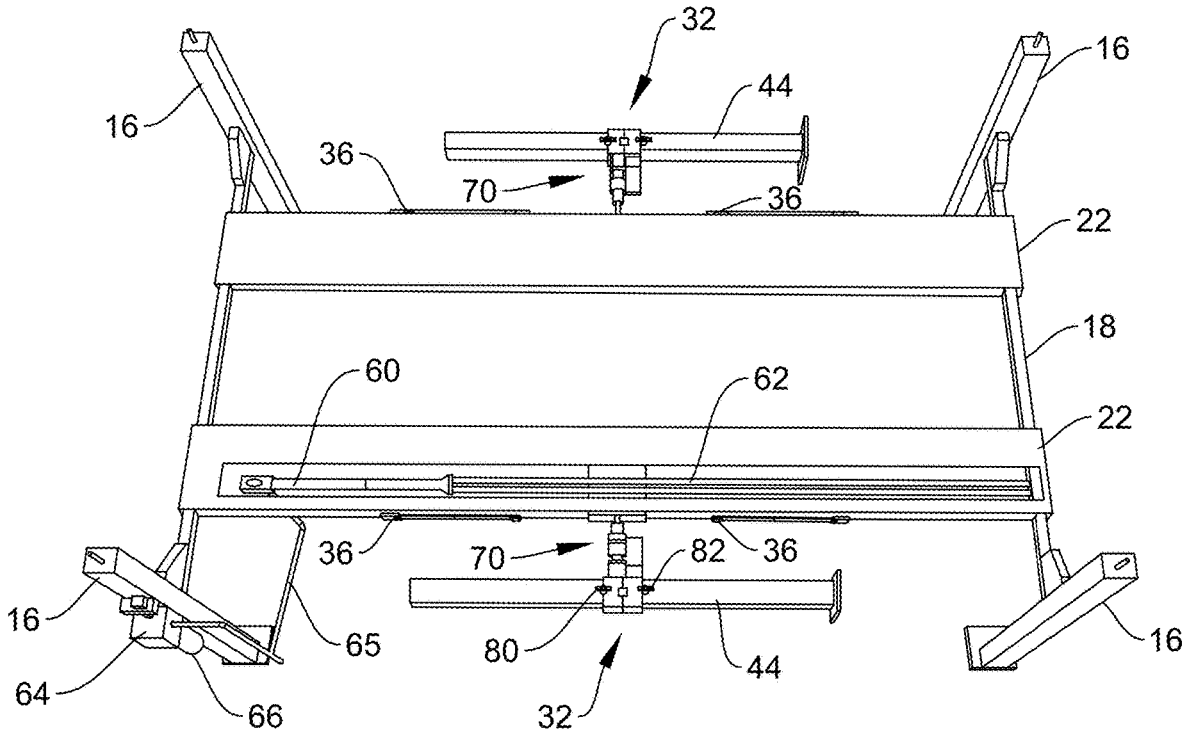
FIG. 2 is a top perspective view of the assembly of FIG. 1 with portions removed.

FIG. 2 illustrates a typical lift mechanism used to lift the rack 18 and runways 22 up and down. In one common embodiment, an actuator 60 is mounted to the underside of one of the runways 22 and with individual cables 62 running to each corner (guided portion 20) of the rack 18 using pulleys as well known. Typically each cable 62 is terminated at each of the vertically oriented supports 16. When the actuator 60 is operated, it pulls the cables 62 and lifts the rack 18. Likewise, when the actuator 60 is operated in a reverse manner, the rack 18 is lowered. A pump 64 pumps hydraulic fluid to the actuator 60 via a hydraulic line 65. When the rack 18 is lowered, hydraulic fluid from the actuator 60 flows to a reservoir 66. It should be noted that in an alternative embodiment, as mentioned above, an actuator is provided for each corner of the rack 18 being mounted within or to each of the vertically oriented supports 16, where the actuator is coupled to the corresponding guided portion 20. The type of lift mechanism provided for the runway vehicle lift 12 can take any number of forms for use in the vehicle lift 10 to raise and lower the rack 18 and runways 22.

Figure 3:
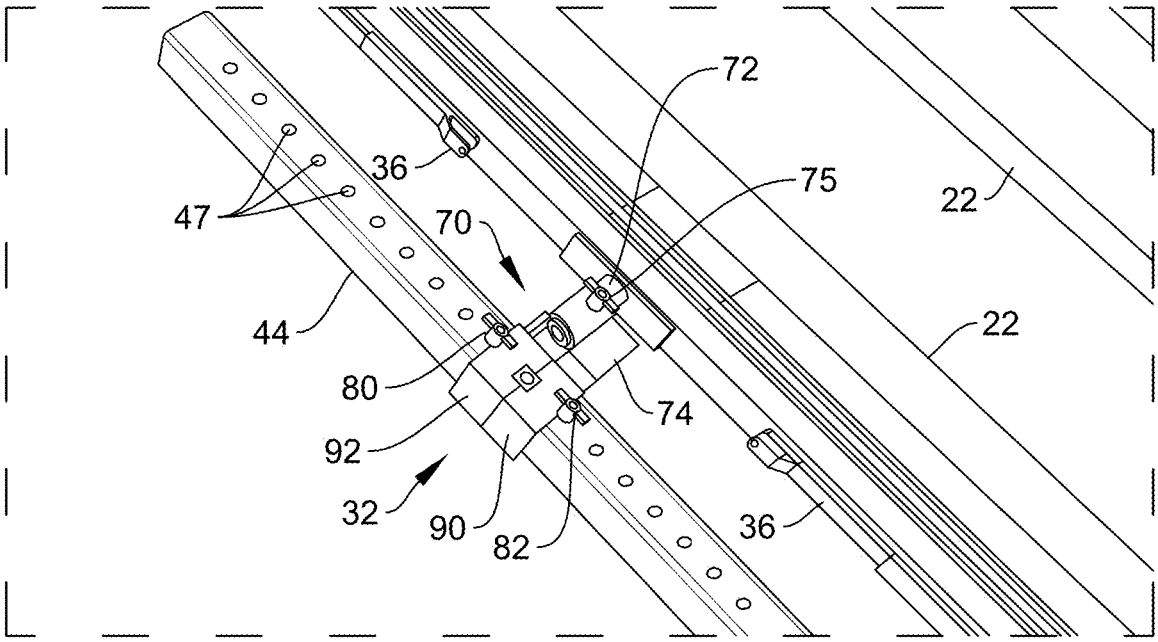
FIG. 3 is an enlarged perspective view of a portion of the assembly of FIG. 1.

FIG. 3 schematically illustrates a mount comprising a pivot assembly 70 suited for pivoting the posts 44 to and from the storage position. The pivot assembly 70 couples the carriage assembly 32 to each runway and includes a first portion 72 mounted to the runway 22. A second portion 74 is pivotably coupled to the first portion 72, herein exemplified as cylinders wherein the first portion 72 extends within a bore of the second portion 72. The second portion 74 connects to the carriage assembly 32. In one embodiment, a lock is provided to inhibit rotation of the pivot assembly 70 when desired. For example, the lock can comprise a pin 75 insertable through aligned apertures of the first portion 72 and the second portion 74 when the posts 44 are in the storage position.

Figure 4:
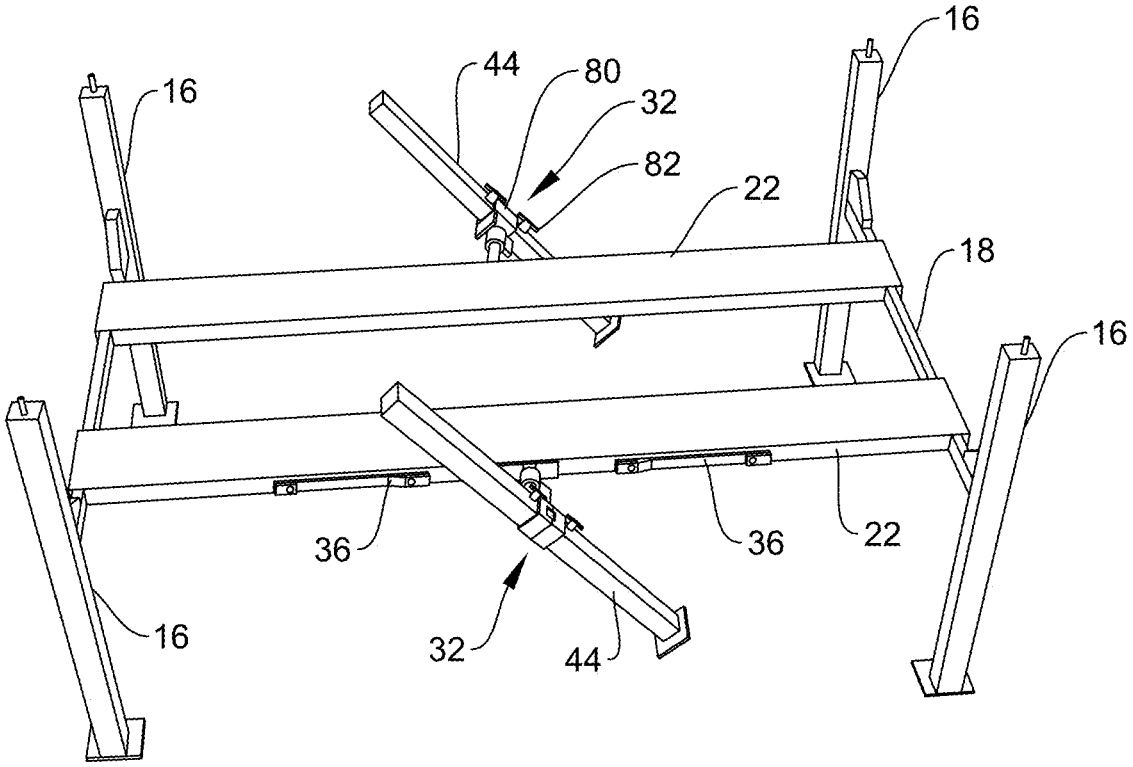
FIG. 4 is a perspective view of the vehicle support assembly of FIG. 1 in a tilted position.
Figure 5:
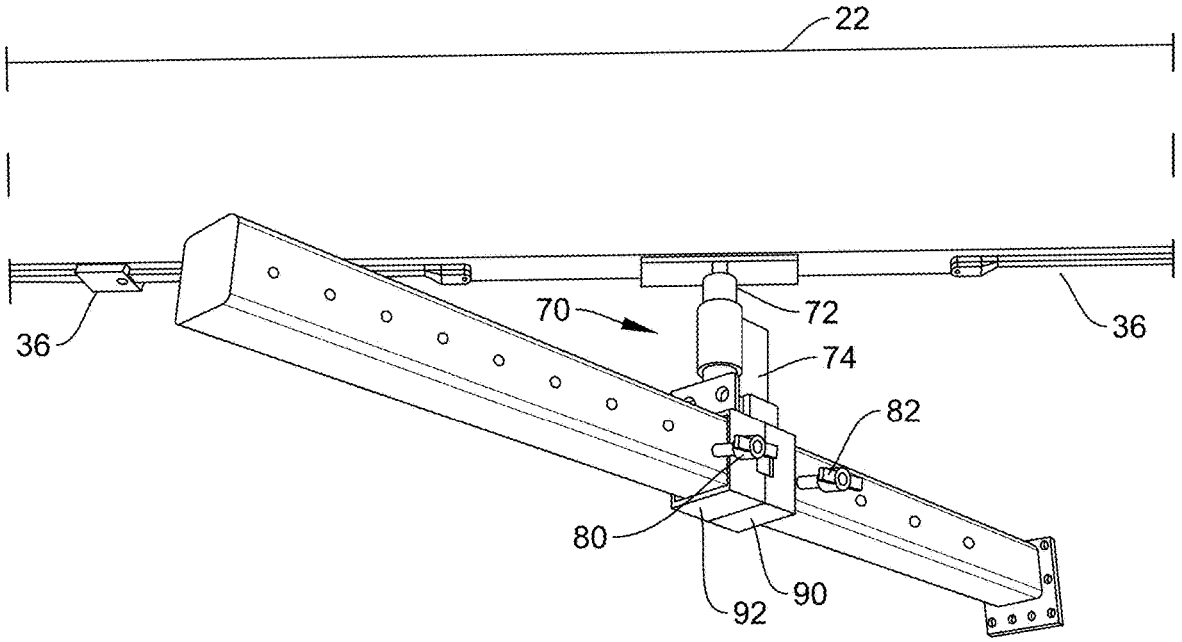
FIG. 5 is a perspective view of a portion of the vehicle support assembly of FIG. 1.
Figure 6:
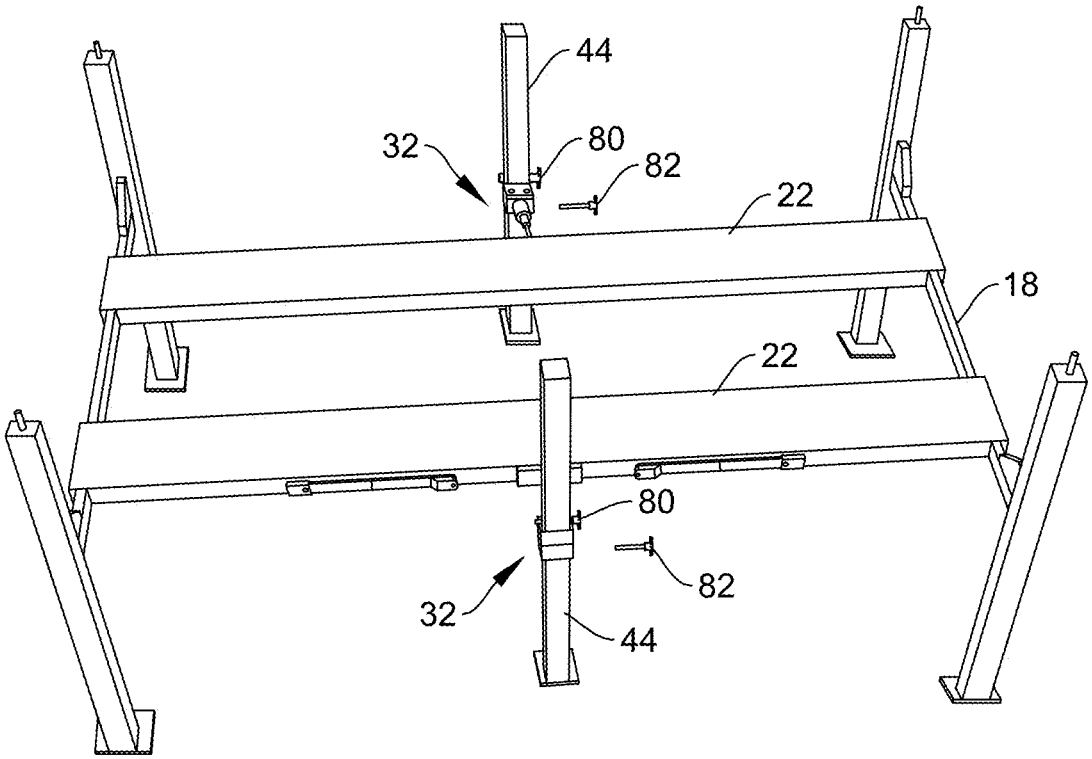
FIG. 6 is perspective view of the vehicle support assembly of FIG. 1 in an upright position.

Operation of the vehicle lift assembly 10 to transfer a load such as the vehicle 42 from being supported by the runway vehicle lift 12 to the two-post support assembly 30 is as follows. With the runways 22 at least lifted partially off the ground, the posts 44 are pivoted using the pivot assemblies 70 as illustrated in FIGS. 4 and 5 to a substantially vertical position as illustrated in FIG. 6. The pivot components of the pivoting assembly 70 forming the pivot axis is disposed between the runway 22 and the posts 44. It should be noted that the location of each carriage assembly 32 on each respective post 44 in the storage position is preferably chosen such that the pivot axis of the pivot assembly 70 extends through or substantially close to the center of gravity of the carriage assembly 32/post 44, which allows the post 44 to be supported in the horizontal position and moved easily to the vertical position.

Each post 44 typically includes a number of apertures 47 (FIG. 3) which allow pins, pawls or the like to extend at least partially through the posts 44 and provide a carriage lock so as to hold the positon of each carriage assembly 32 with respect to each post 44. In the embodiment of FIGS. 1-18, the carriage lock can include two pins 80 and 82 for each carriage assembly 32. (Below with respect to FIGS. 63 and 64, a movable pawl is described.) Pin 80 is disposed above the carriage assembly 32 through the post 44 when the post 44 is oriented in a vertical position, while pin 82 is disposed through the post 44 below the carriage assembly 32 when the post is in the vertical positon. The use of both pins 80 and 82 is particular convenient when the post 44 are in the storage position thereby locking the position of each posts 44 with respect to each carriage assembly 32.

Figure 7:
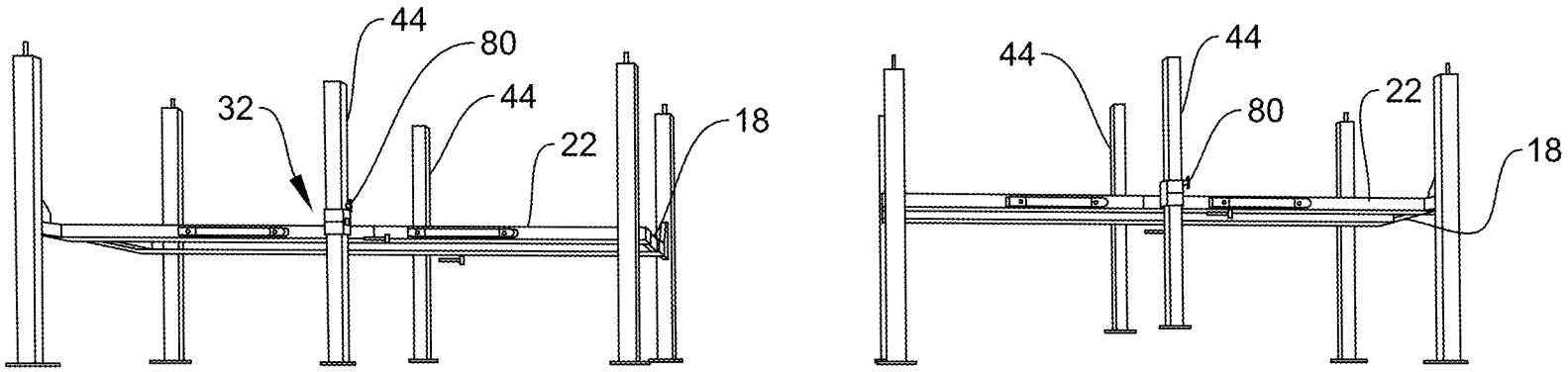
FIG. 7 is a perspective view of the vehicle support assembly of FIG. 1 in two different positions.

FIGS. 6 and 7 illustrate the posts 44, vertically oriented, being supported by each respective runway 22 above the ground surface. In this position, if desired, the pin 82 can be removed from the post 44 since the post 44 is being supported on the carriage assembly 32 by pin 80. From the position illustrated in FIG. 6, the lift mechanism for the runway vehicle lift is operated so as to lower the posts 44 to the ground as illustrated in FIG. 7.

Figure 8:
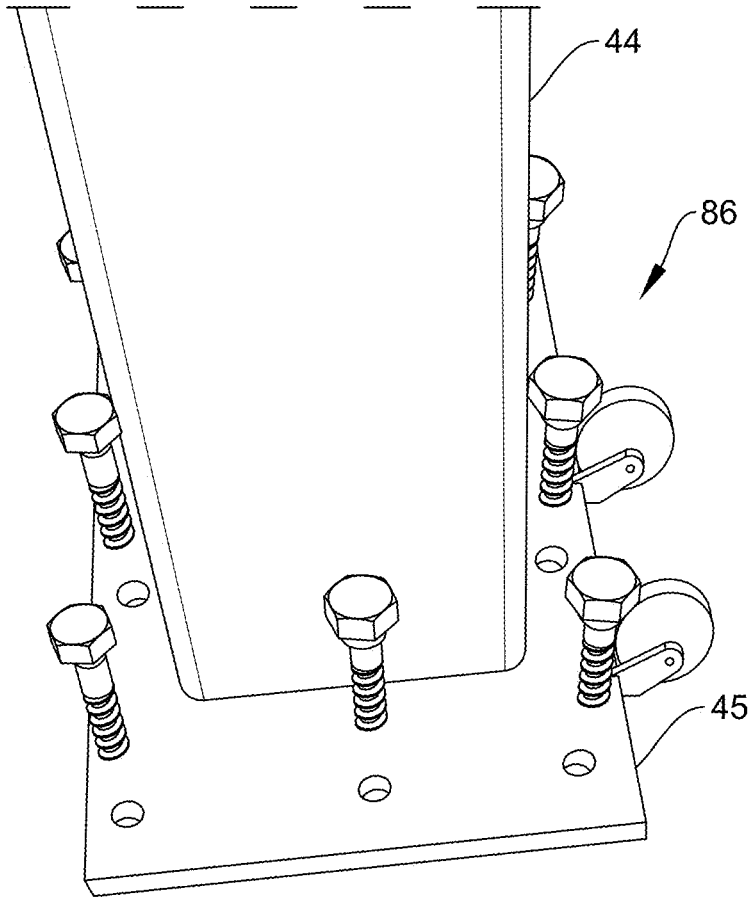
FIG. 8 is a perspective view of a support plate.

Although it may not be required in all embodiments, if desired, fasteners such as bolts 86 illustrated in FIG. 8 can be provided to secure a base 45 of each post to the ground using threaded receptacles as is known in the art.

Figure 9:
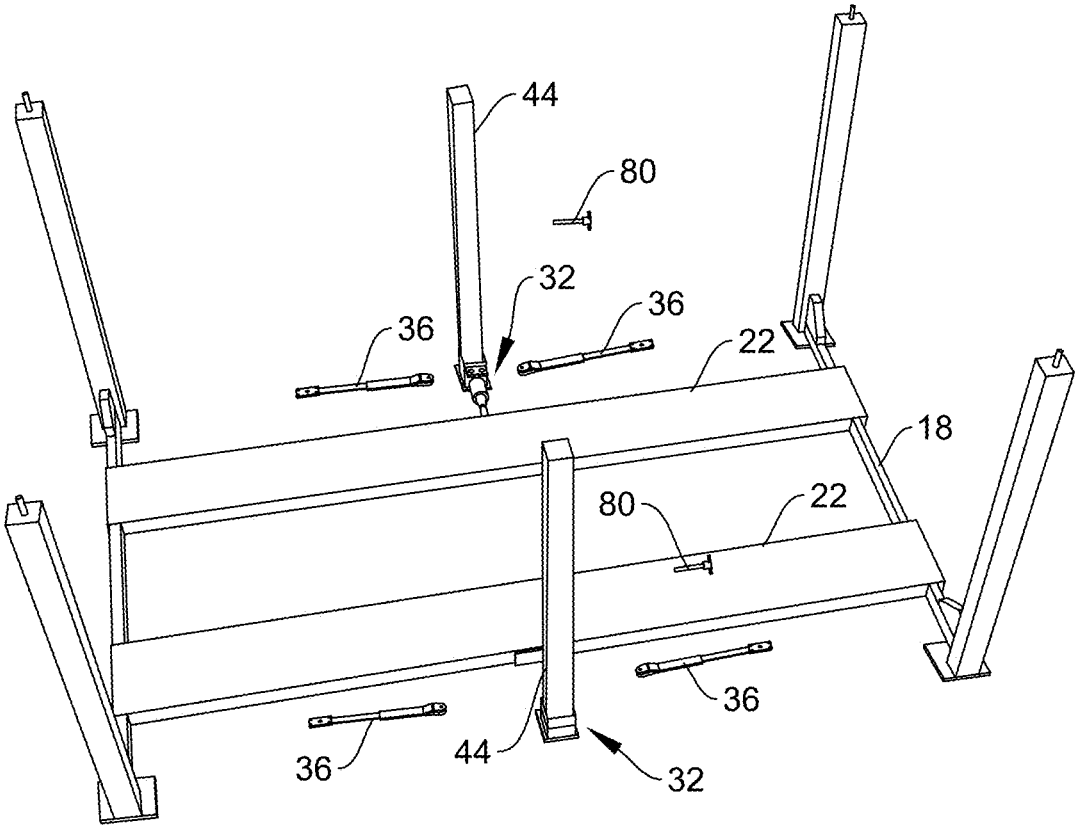
FIG. 9 is another perspective view of the vehicle support assembly of FIG. 1 with arms removed.

With the post 44 lowered to the ground, the pin 80 can be removed from each of the posts 44, thereby allowing the associated carriage assembly 32 to move freely upon each corresponding post 44; however, since each carriage assembly 32 is coupled to each respective runway 22, the carriage assembly 32 only moves on the post 44 with movement of the corresponding runway 22. FIG. 9 illustrates how the carriage assemblies 32 are lowered when the rack 18 and the runways 22 are lowered such as to allow the vehicle to be driven on the runways 22; however, it should be noted lowering of the rack 18, runways 22 and carriage assemblies 32 is not required if the vehicle is already on the runways 22.

Figure 10:
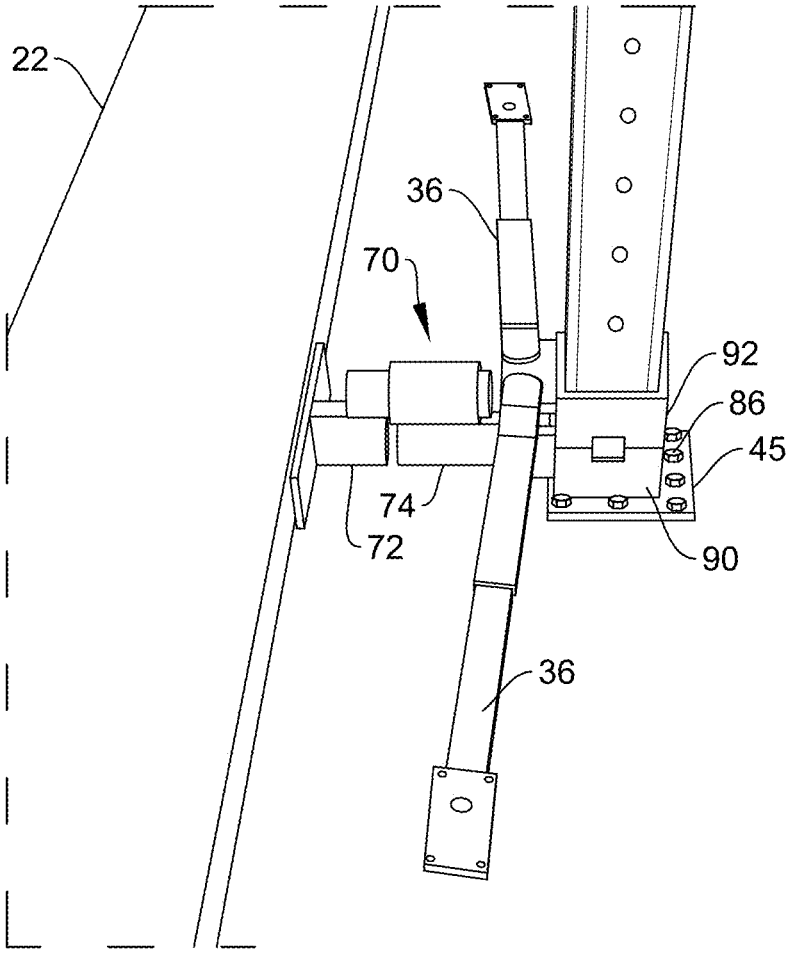
FIG. 10 is a perspective view of the vehicle support assembly of FIG. 1 with arms attached.

FIG. 10 illustrates connection of each of the arms 36 to the carriages assembly 32. In the exemplary embodiment, each carriage assembly 32 includes a arm carriage driver 90 moveable on the associated posts 44. Each arm carriage driver 90 is coupled to the second portion 74 of the pivot assembly 70. A arm carriage 92 is disposed on post 44 above each arm carriage driver 90. Each arm carriage 92 supports the associated arms 36.

Figure 11:
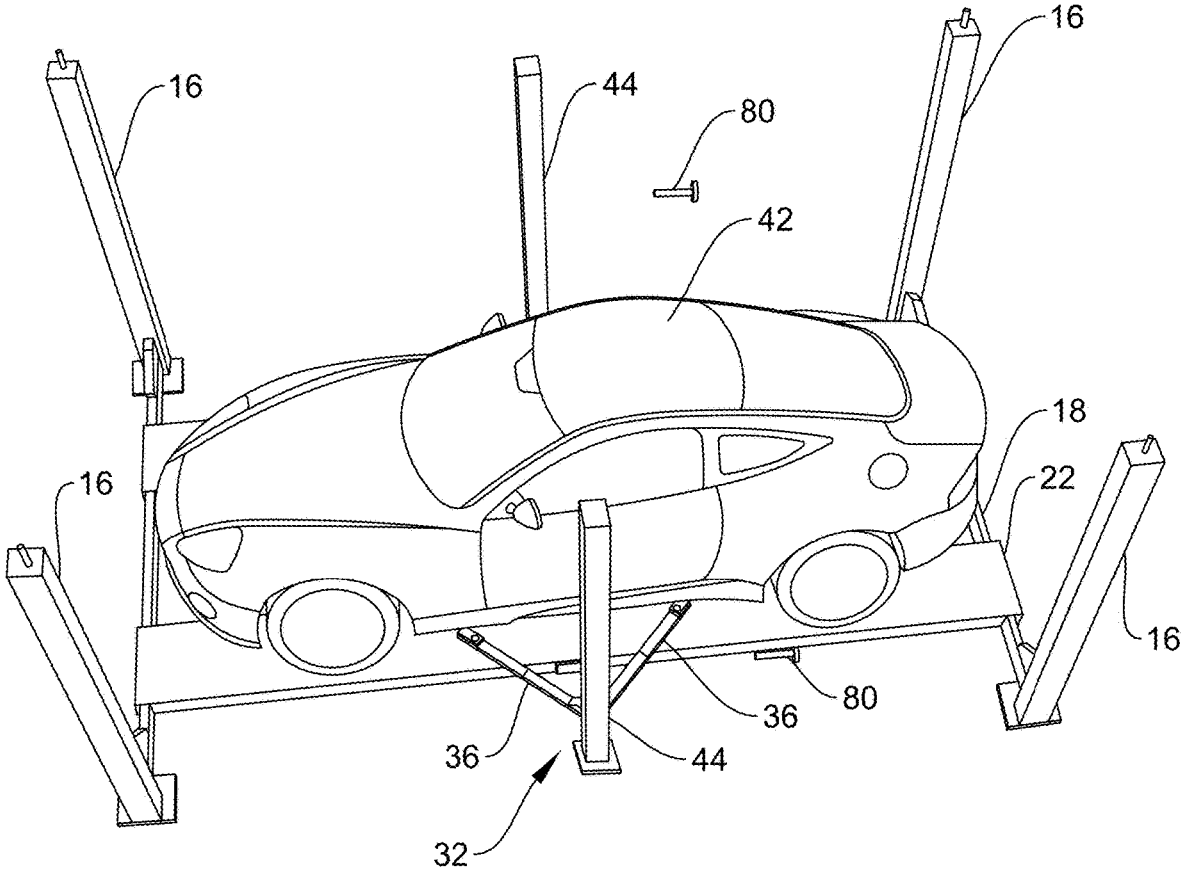
FIG. 11 is a perspective view of the vehicle support assembly of FIG. 1 with arms positions below the vehicle and the lift lowered.
Figure 12:
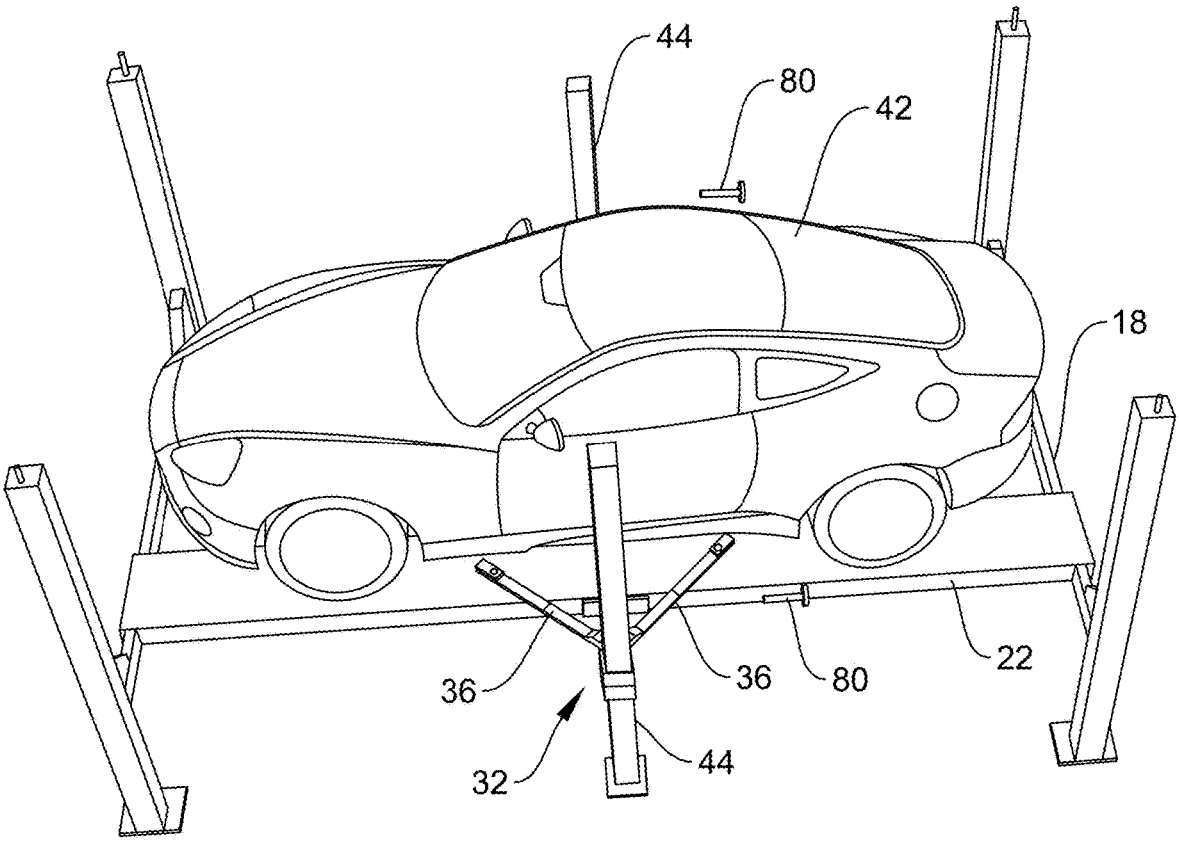
FIG. 12 is a perspective view of the vehicle support assembly of FIG. 1 with the lift partially raised.
Figure 13:
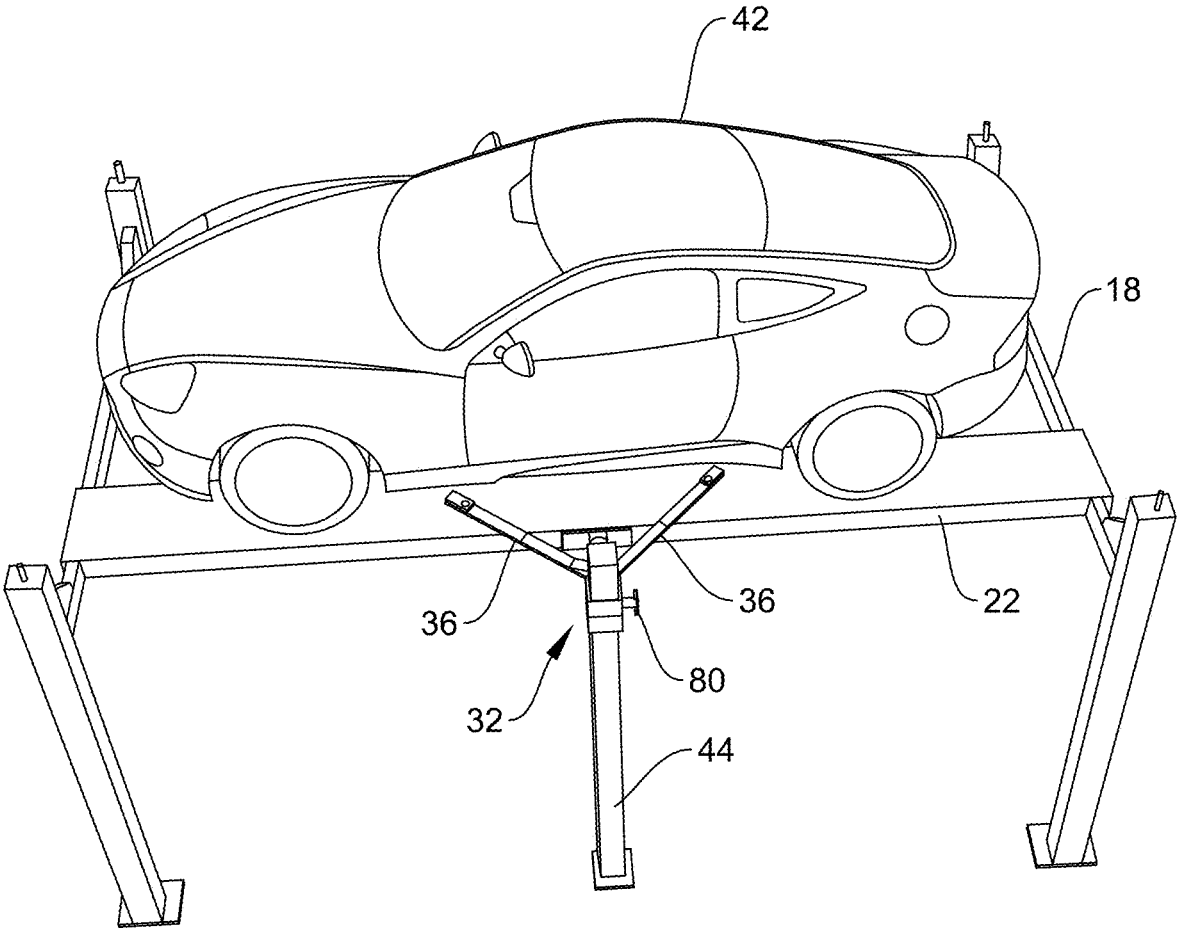
FIG. 13 is a perspective view of the vehicle support assembly of FIG. 1 with the lift fully raised.

FIGS. 11-13 illustrate how each carriage assembly 32 is preferably moved upward along each post 44 with movement of the rack 18 and runways 22 by the lift mechanism of the runway vehicle lift 12. If desired, the carriage assemblies 32 can be moved upwardly on each post 44 apart from raising the rack 18 and runways 22, although it is particularly convenient to have the lift mechanism of the runway vehicle lift 12 raise the carriage assemblies 32 via the rack 18 and runways 22.

Figure 14:
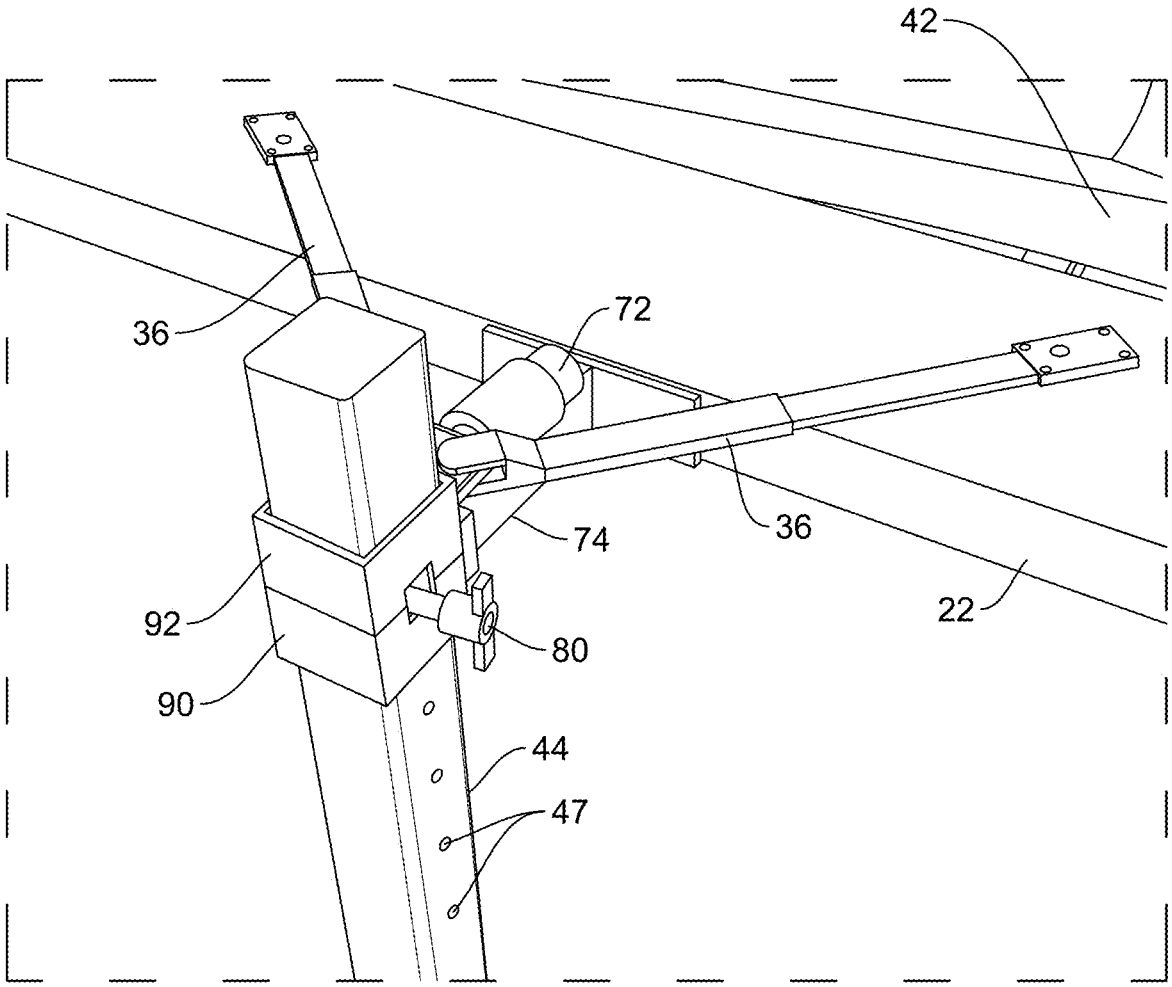
FIG. 14 is an enlarged perspective view of the vehicle support assembly of FIG. 1 with the lift fully raised.

Referring to FIGS. 13 and 14, once the desired height of the arms 36 has been obtained, pin 80 is used to hold the arm carriage 92 in a fixed position with respect to the post 44. Each pin 80 is inserted through apertures provided in each respective post 44 so as to be disposed below the arm carriage 92 and above the arm carriage driver 90. In the embodiment illustrated, a window or aperture is formed between the arm carriage 92 and the arm carriage driver 90 so as to allow convenient access to the apertures in the post 44. Typically, as stated earlier, each post 44 comprises a number of apertures along its length allowing the height of the arm carriage 92 to be adjusted. With the tires of the vehicle 42 resting upon the runways 22, the arms 36 are positioned below the lift points on the underside of the vehicle. The carriage assembly 32 and its coupling to each respective runway 22 is configured to allow the arms 36 to swing freely in the space between the runways 22 and the underside of the vehicle, which is illustrated in FIG. 15.

Figure 15:
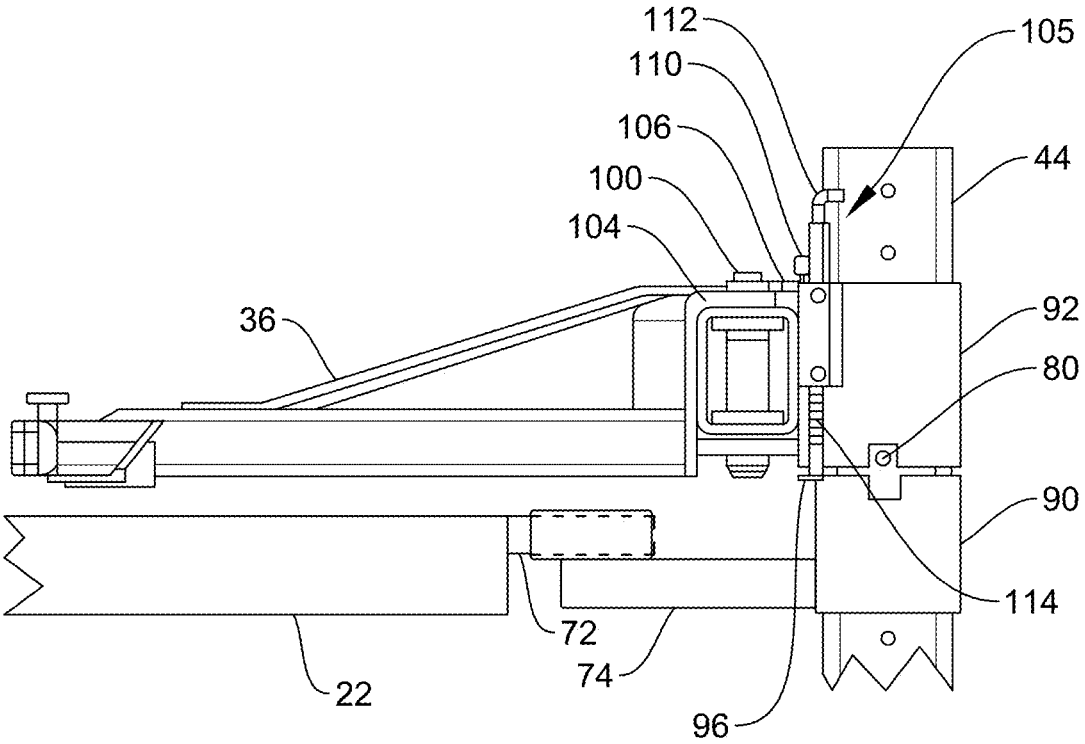
FIG. 15 is a side-elevational view an arm carriage.
Figure 16:
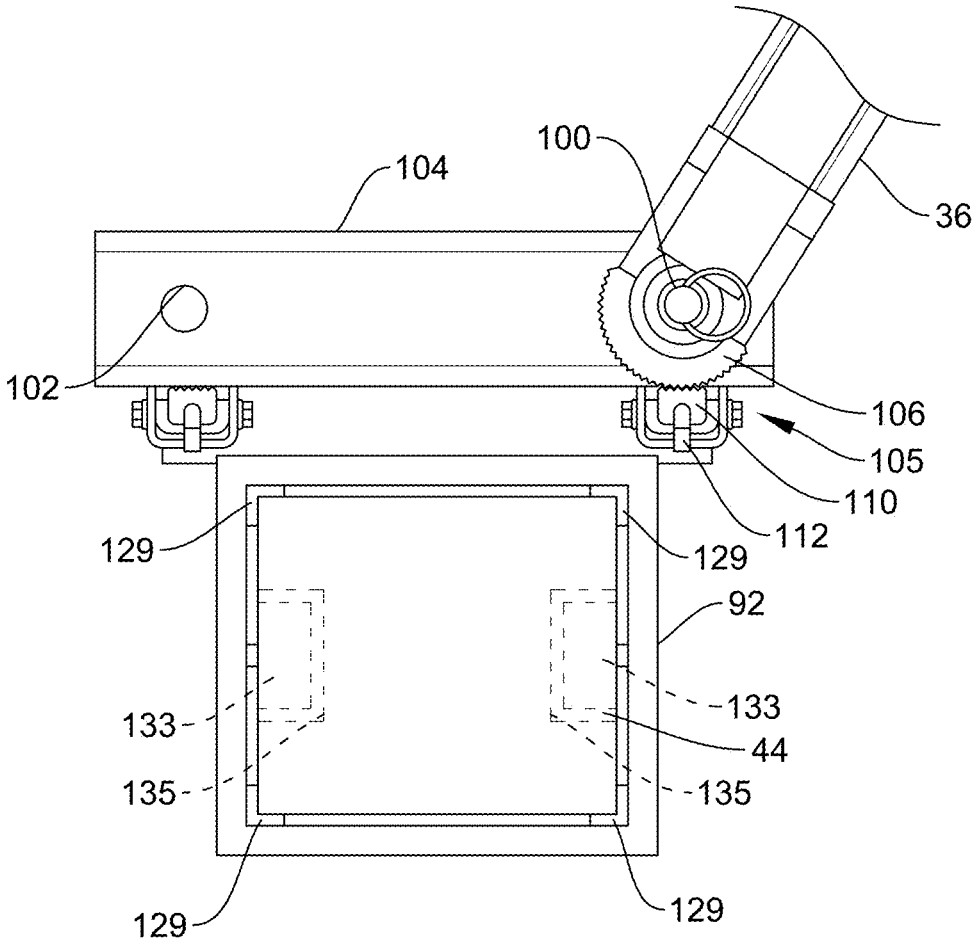
FIG. 16 is a top-plan view of portion of the vehicle support assembly with portions removed.

FIGS. 15 and 16 illustrate that the arms 36 can be coupled to the arm carriage 92 with removable pins 100 provided through apertures 102 in a support 104. Commonly, each of the arms 36 includes an arm restraint mechanism 105 that will hold each arm 36 selectively in a fixed position with respect to the support 104. The restraint mechanism 105 includes an arcuate member 106 having teeth. A lock member 110 has teeth that selectively engage the teeth of the arcuate member 106 to restrain arm 36. Referring to FIG. 15, the lock member 110 is mounted on a shaft or rod 112 so as to move up and down with the rod 112.

FIG. 16 further illustrates guide blocks 129 disposed between posts 44 and arm carriage 92 (as well as used between posts 44 and arm carriage driver 90, but not shown). Since the carriage assembly is not under load from the vehicle weight as the carriage assembly moves up and down the posts 44, the guide blocks 129 should not exhibit much wear. In addition or in the alternative other forms of guide members can be used such as but not limited to wheels 133 for example coupled to the arm carriage 92 and the arm carriage driver 92 and captured in guide channels 135 provided in the posts 44, schematically illustrated in FIG. 16 with dashed lines.

Figure 17:
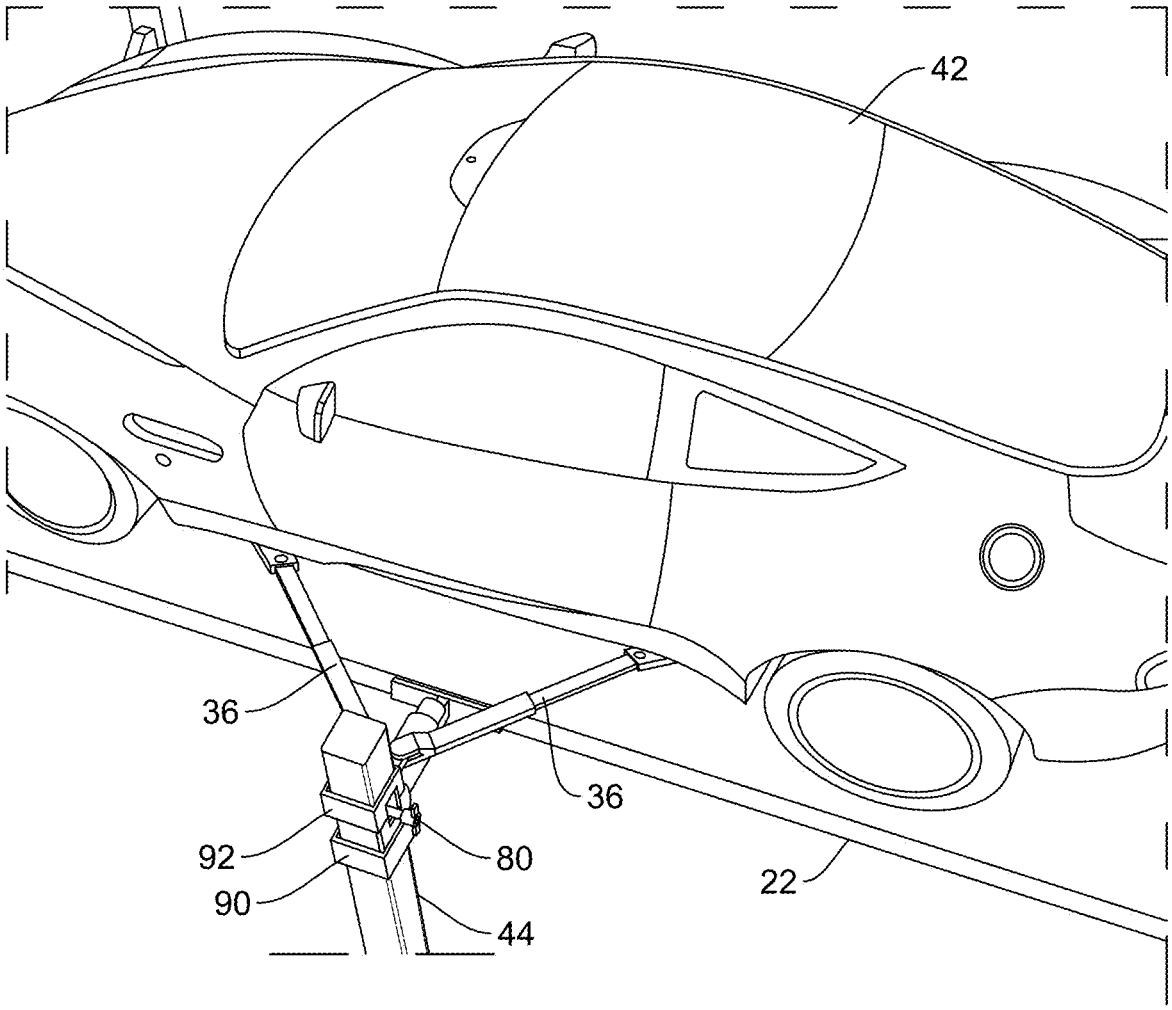
FIG. 17 is a perspective view of a portion of vehicle support assembly of FIG. 1 with the arm carriage driver disengaged from the arm carriage.
Figure 18:
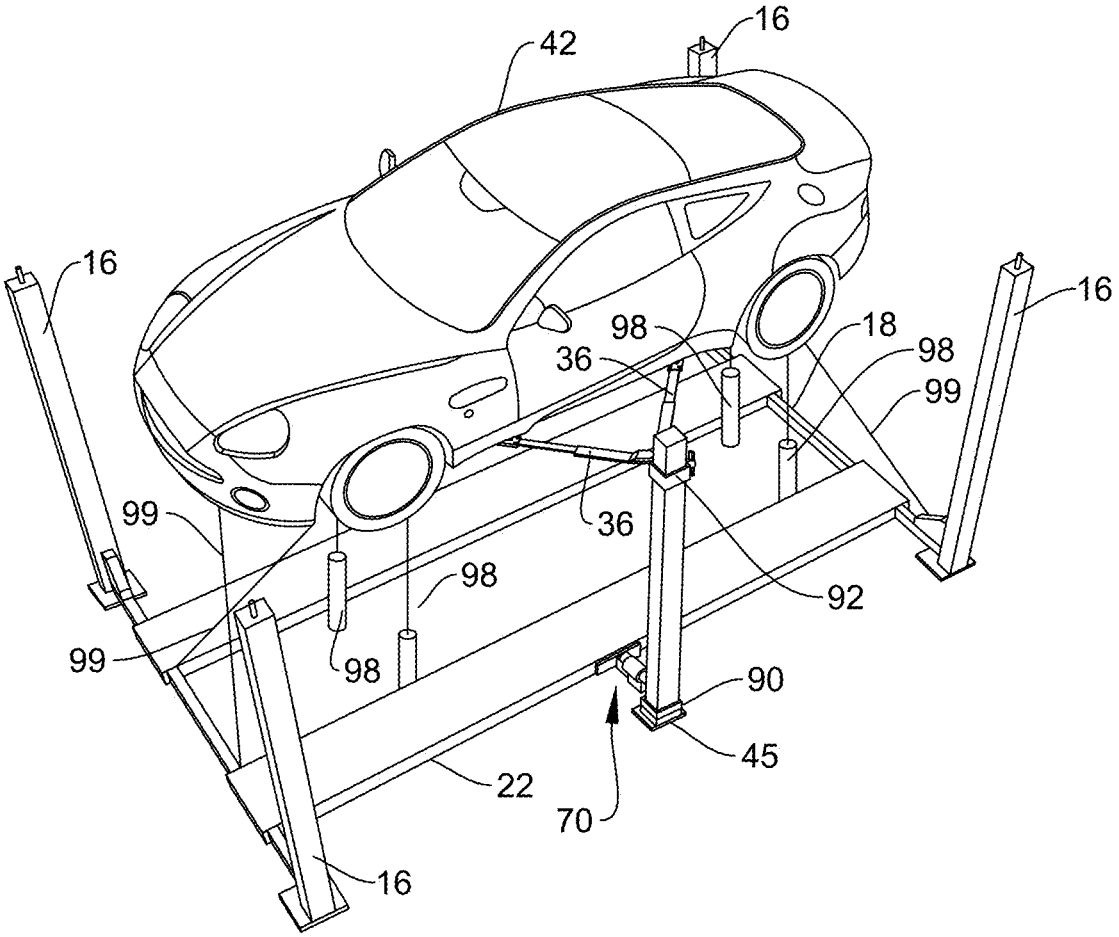
FIG. 18 is a perspective view of the vehicle support assembly of FIG. 1 supporting a vehicle.

Referring also to FIG. 17, with the pin 80 located between each corresponding arm carriage 92 and arm carriage driver 90, the rack 18 and runways 22 along with the vehicle 42 can be lowered which causes the arm carriage driver 90 to separate from the arm carriage 92 because the arm carriage driver 90 is coupled to move with the associated runway 22, but the pin 80 holds the arm carriage 92 in position. Since the arm carriage 92 is holding the arms 36 in a fixed vertical position below the vehicle 42, as the vehicle 42 lowers with the runways 22, the arms 36 will eventually engage the vehicle 42, and with further lowering of the runways 22, the vehicle 42 will transfer completely from the runways 22 to the arms 36 upon sufficient lowering the rack 18 and runway 22. FIG. 18 illustrates the rack 18 and runways 22 being fully lowered to the ground surface; however, if desired, the runways 22 can be lowered to a selected height above the ground surface if desired. Whether lowered only partially below the vehicle 22 or completely to the ground, the runways 22 remain connected to arm carriage drivers 90 which aids in supporting each post 44 upright. It may not even be necessary to secure the posts 44 to the ground with the bolts 86 in view that the arm carriage drivers 90 provide support to the posts 44.

The foregoing process is reversed to transfer the vehicle 42 from the arms 36 back to the runways 22.

Referring back to FIG. 15, with the lowering of the runways 22 and arm carriage drivers 90, the arm restraint mechanisms 105 can be activated so as the hold the angular position of each arm relative 44 to each associated arm carriage 92. In particular, in this embodiment, the rod 112 is in engagement with the arm carriage driver 90 when the arm carriage support 90 is sufficiently proximate the arm carriage 92 so as to lift the shaft 112 and corresponding lock member 110 vertically upwardly so as to disengage from the arcuate member 106. When the arm carriage driver 90 is lowered, the shaft 112 and lock member 110 are also lower such that the teeth of the lock member 110 engages the teeth of the arcuate member 106. If desired, a spring 114 can be configured to bias the shaft 112 and lock member 110 downwardly so as to aid engagement of the lock member 110 with the arcuate member 106. If desired, a tab or flange 96 is provided on the arm carriage driver 90 to engage the end of the shaft 112.

FIG. 18 also illustrates telescoping, pivotable jack stands 98. Each jack stand 98 can be selectively coupled to a runway 22 so as to extend vertically to engage the underside of the vehicle and provide support, adding to stability and inhibiting the vehicle 42 from falling off the arms 36. The jack stands 98 can be tilted to a horizontal position adjacent the runway for storage. In addition or in the alternative flexible members such as straps, ropes or the like 99 can be provided so as to also add to stability of the vehicle 42 on the arms. One end of the flexible member 99 is connected to a portion of the vehicle 42, while the other end is connected to a support 16, the rack 18 or the runway 22 as desired. In a one embodiment, one or more flexible members 99 can be connected straight down from the connection point on the vehicle 42, but in another embodiment, each flexible member 99 is arranged at an angle relative to vertical so as to provide vertical and lateral holding forces. For instance, the flexible members 99 can extend outwardly and downwardly as illustrated by the flexible member 99 at the rear of the vehicle 42, or in another embodiment, the flexible members 99 can cross underneath the vehicle 42 as illustrated in the front of the vehicle 42.

Figure 19:
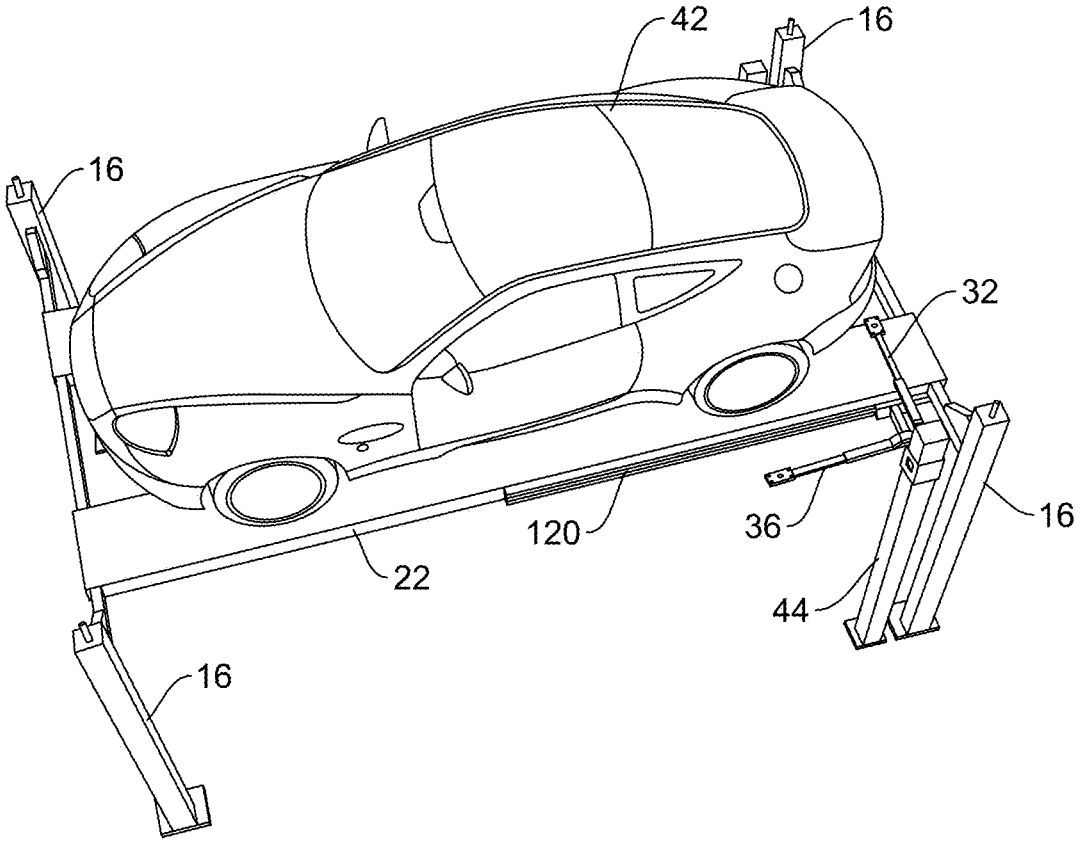
FIG. 19 is a second embodiment of a vehicle support assembly.
Figure 20:
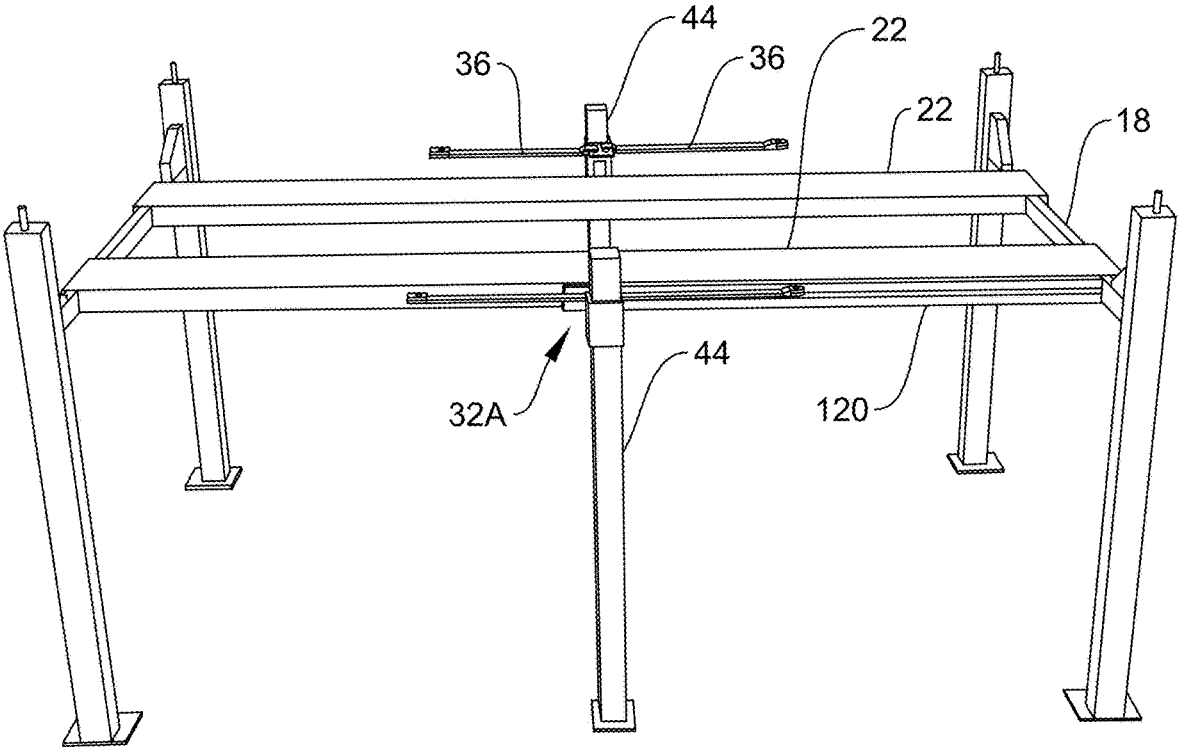
FIG. 20 is a perspective view of the embodiment of FIG. 19 in a second position.
Figure 21:
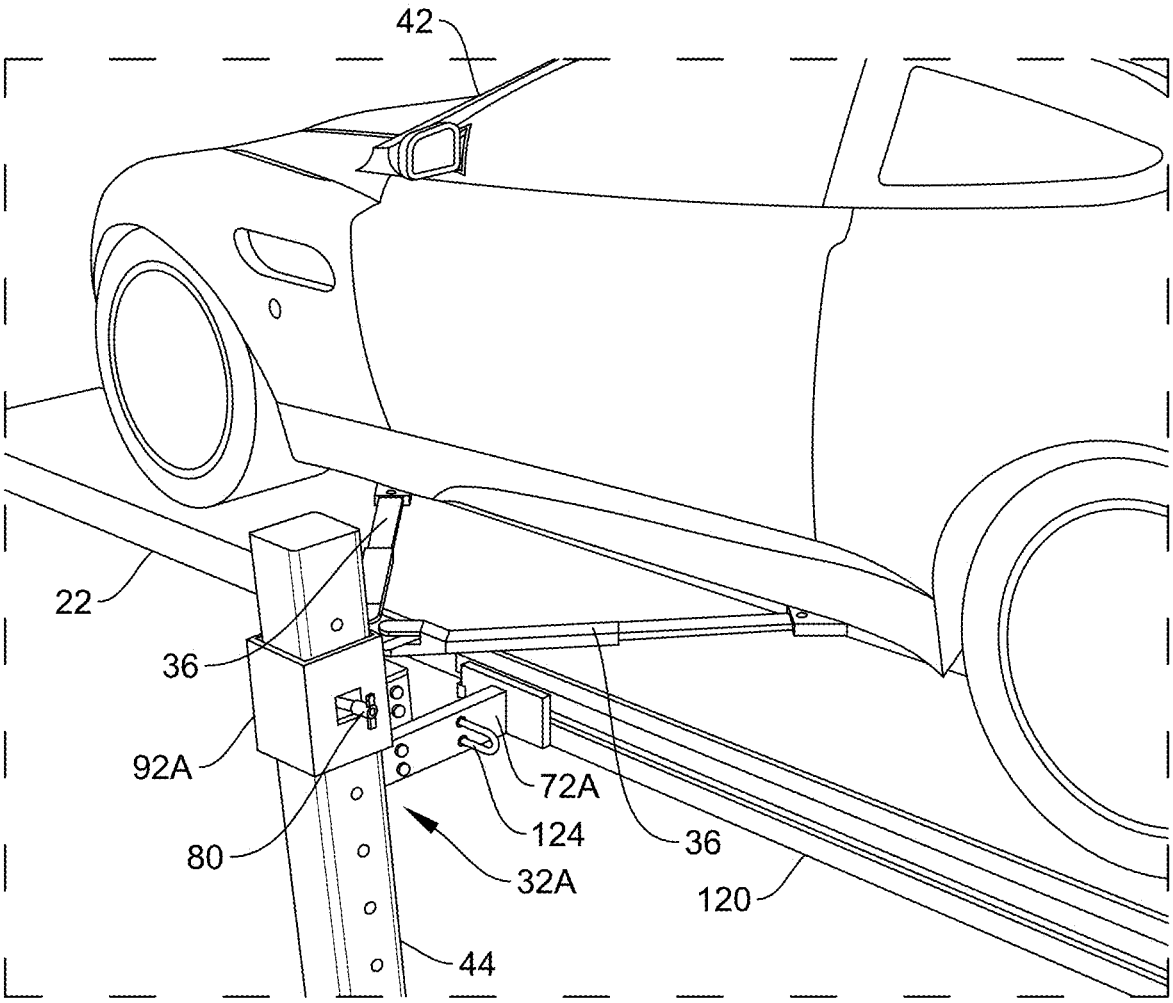
FIG. 21 is a perspective view of a portion of the embodiment of FIG. 19.

FIGS. 19-22 illustrate an embodiment where the storage position of each post 44 is not horizontal with each respective runway 22, but rather, oriented transversely or perpendicular to each respective runway 22. In this embodiment, the carriage assembly 32A is moveably coupled to each respective runway 22 with a mount so as to selectively move along its length. In the embodiment illustrated, the mount includes a guide 120 secured to each runway 22. The first portion 72A of a carriage assembly 32A is configured to slide or move along the guide 120. In this embodiment, the carriage assembly 32A does not pivot. The arm carriage 92A is selectively coupled to the portion 72A with a suitable connector 124 (FIG. 21). FIG. 19 illustrates the storage position, while FIG. 20 illustrates movement from the storage position. It should be noted that with pin 80 coupling the arm carriage 92A to the post 44 so as to not allow the post 44 to slide downwardly, but rather held aloft, the carriage assembly 32A and the post 44 can move as a unit along the guide 120 in an elevated position above the ground surface. Upon reaching the desired position for the post 44, the lift mechanism is operated to lower the rack 18 and runways 22 so as to lower the post 44 to the ground as described above.

Figure 22:
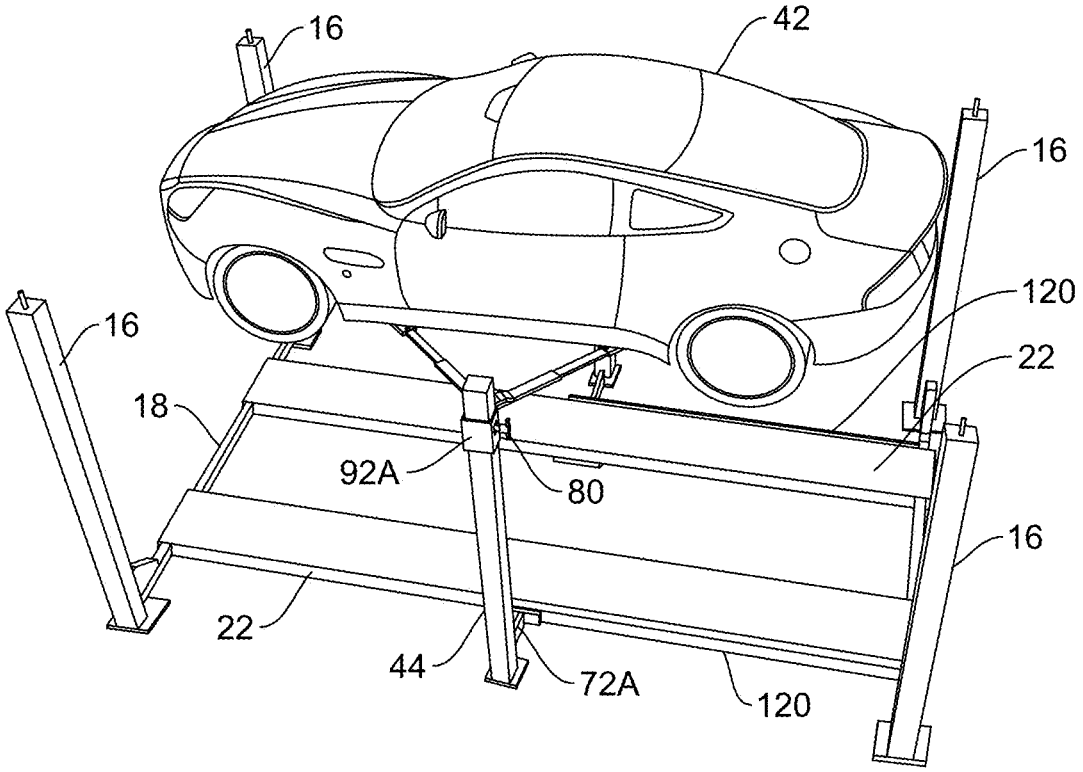
FIG. 22 is a perspective view of the embodiment of FIG. 19 in a position supporting a vehicle.

FIG. 21 illustrates pin 80 being inserted through the post 44 in a manner so as to secure the arm carriage 92A and the connector 124 being removed so as to separate the arm carriage 92A from the runway 22 so that the rack 18, runway 22 and vehicle 42 can be lowered until the vehicle 42 is again supported by the arms 36. FIG. 22 illustrates the rack 18 and runways 22 being completely lowered to the ground surface.

Figure 23:
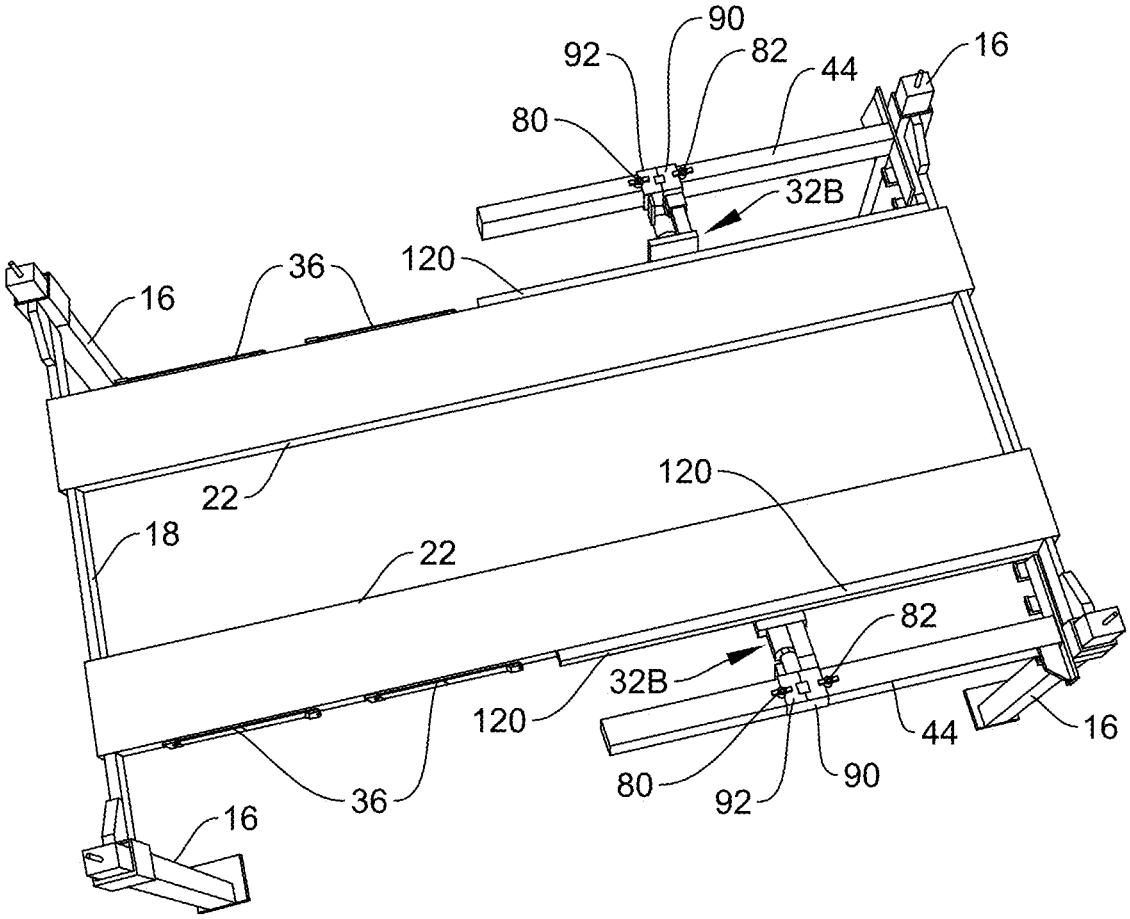
FIG. 23 is a perspective view of another embodiment of a vehicle support assembly.
Figure 24:
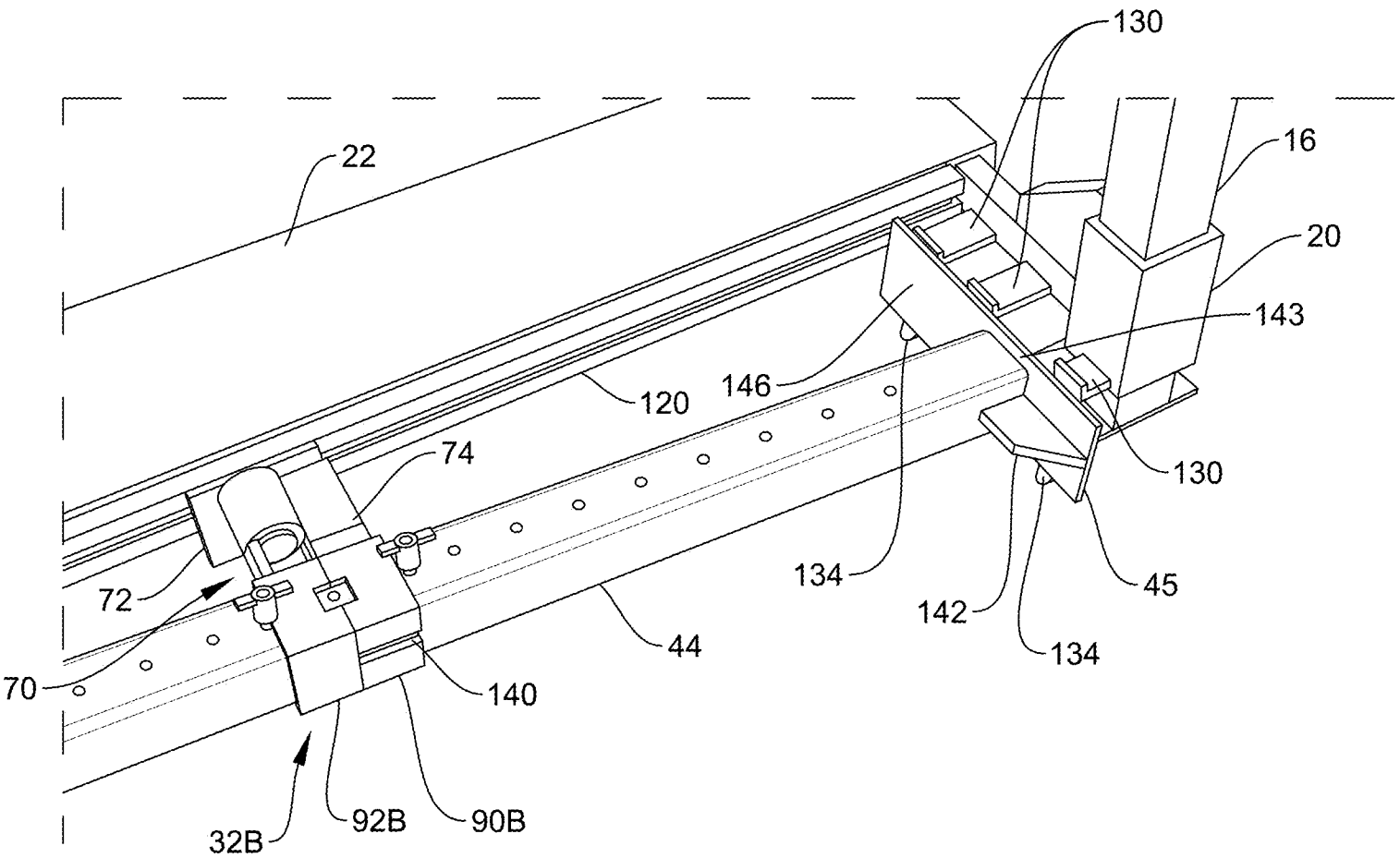
FIG. 24 is a enlarged perspective view of the vehicle support assembly of FIG. 23

FIGS. 23-27 illustrate another embodiment where a carriage assembly 32B is moveable along the guide 120 as well as being pivotable having the pivot assembly 70 described above. In this embodiment, in the storage position illustrated in FIG. 23, the base 45 of each post 44 is shown being supported by the rack 18 on suitable brackets 130. Referring to FIG. 24, with the rack 18 and runway 22 lowered to the ground, the base 45 of each post 44 can be lifted off of the brackets 130 and allowed to rest on the ground surface (not explicitly shown) such as on wheels 134. It should be noted that pins 80 and 82 may need to be temporarily removed so as to allow the post 44 to slide relative to the carriage assembly 32B as the base 45 is lifted off the brackets 130. The pins 80 and 82 can then be reinserted to secure the position of the carriage assembly 32B on the post 44.

Figure 25:
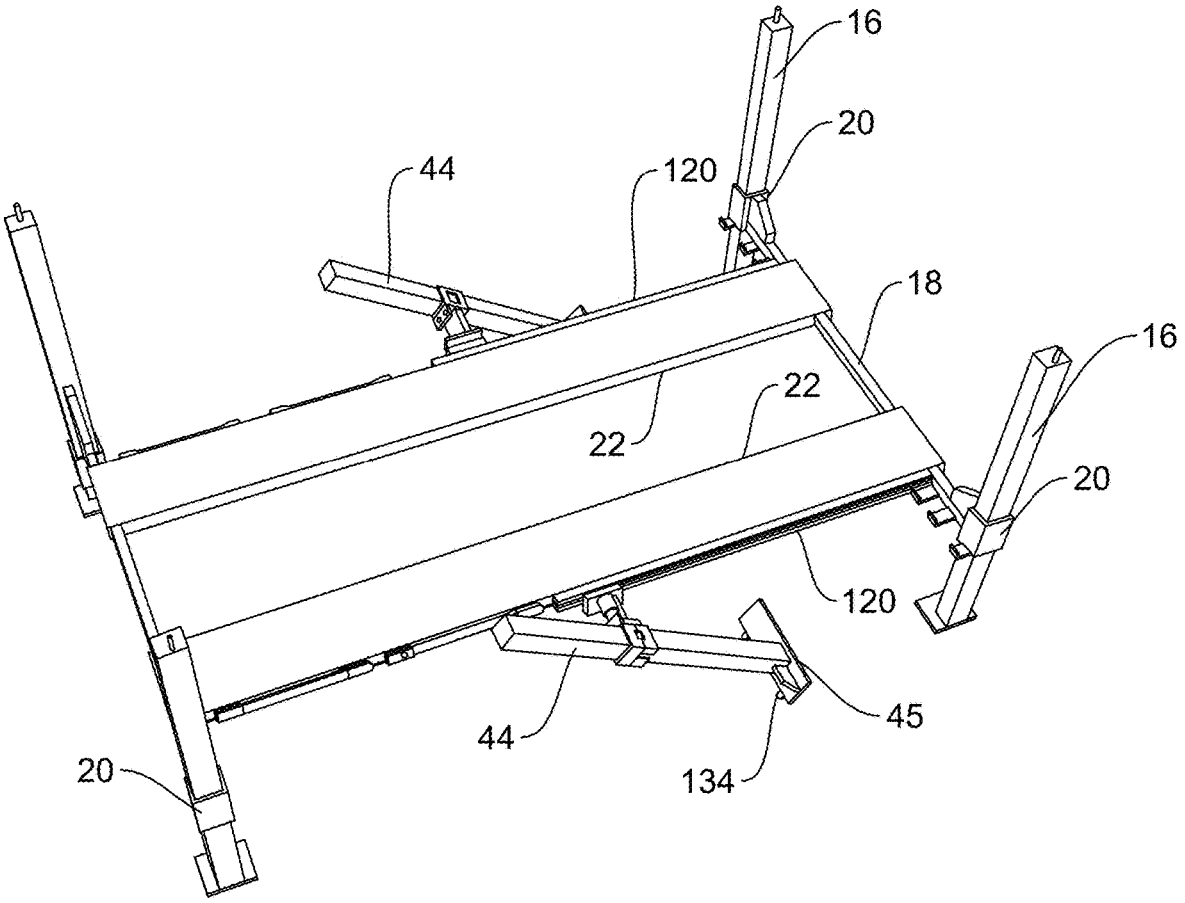
FIG. 25 is a perspective view of the vehicle support assembly of FIG. 23 in a second position.
Figure 26:
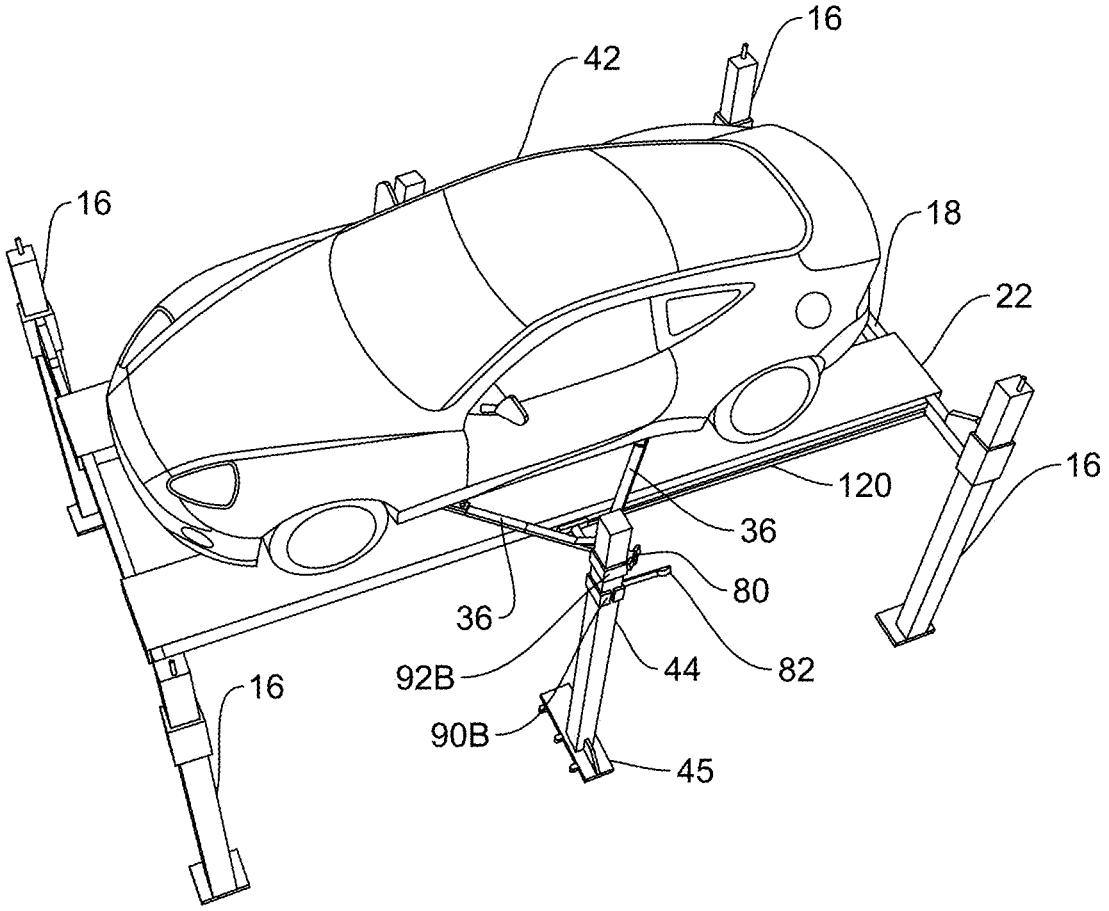
FIG. 26 is a perspective view of the vehicle support assembly of FIG. 23 in an operative position.
Figure 27:
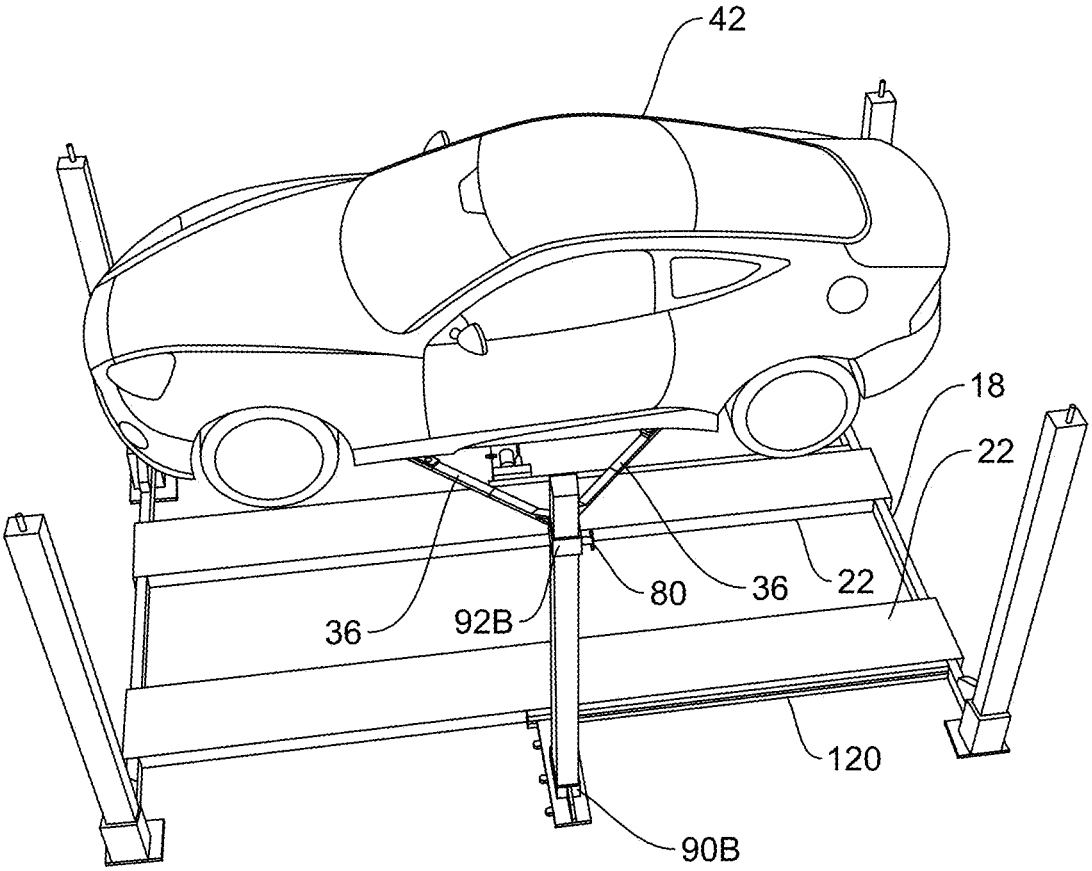
FIG. 27 is a perspective view of the vehicle support assembly of FIG. 23 supporting a vehicle.

FIG. 25 illustrates how when the rack 18 and the runways 22 are lifted, the base 45 of each post 44 travels along the ground surface while the post 44 pivots upwardly due to the pivot assembly 70 provided in the carriage assembly 32B. FIG. 26 illustrates each post 44 being in a vertical position, the base 45 resting upon the ground surface, the pin 80 being inserted through the post 44 to fix the location of the arm carriage 92B with respect to each post 4, the arms 36 partially supporting the vehicle 42 because the rack 18 and runways 22 have been lowered as evidenced by the arm carriage driver 90B being disposed below or away from the arm carriage 92B. FIG. 27 illustrates the vehicle 42 being supported by the arm carriage 92B and the rack 18, runways 22 and arm carriage driver 90B lowered to the base 45.

Referring back to FIG. 24, it should be noted that the arm carriage driver 90B can include a slot 140 that receives a portion 142 of the arm carriage 45, the portion 142 being a support fin or brace connecting the post 44 to a lower plate 143 of the base 45. In the alternative or in the addition, the plate 143 of base 45 can include an inward portion 146 of length sufficient to inhibit rotation of the posts 44 towards each other when vertically upright and supporting the vehicle 42.

Figure 28:
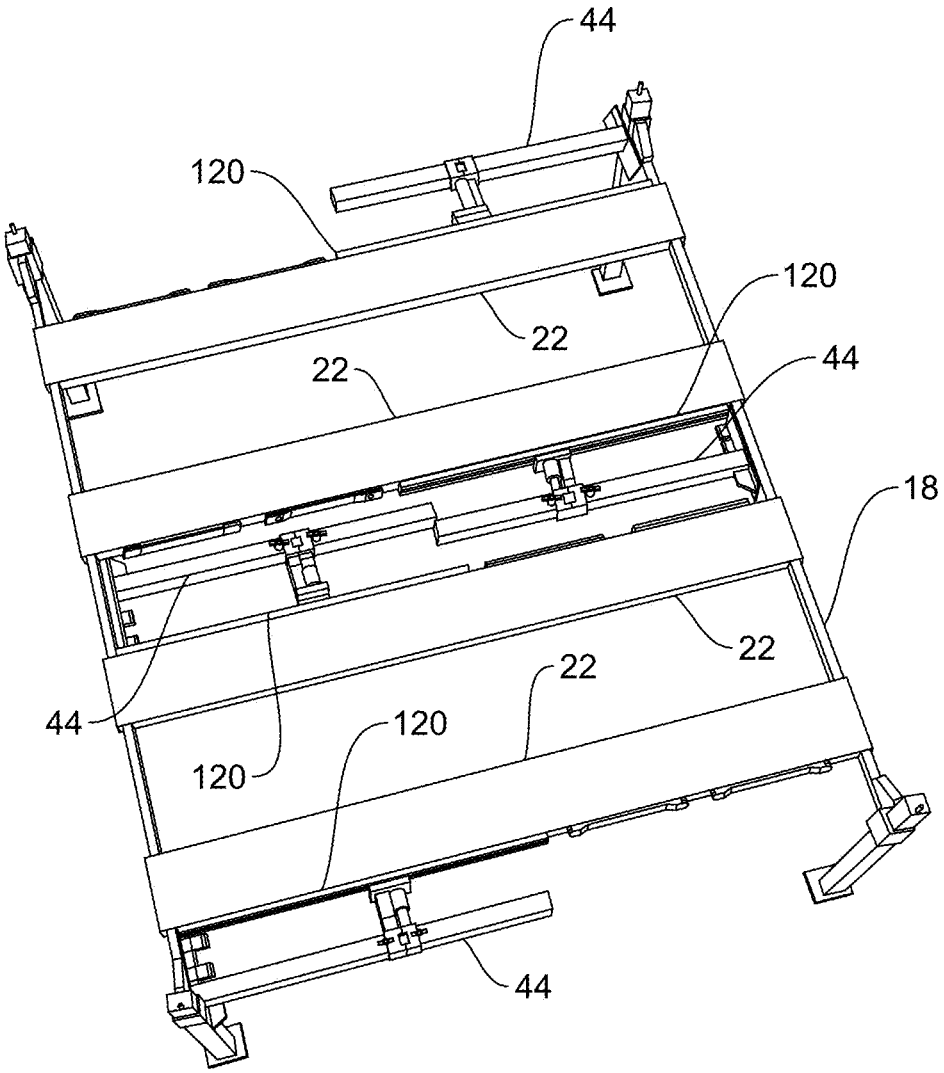
FIG. 28 is a perspective view two vehicle support assemblies mounted to a lift.
Figure 28A:
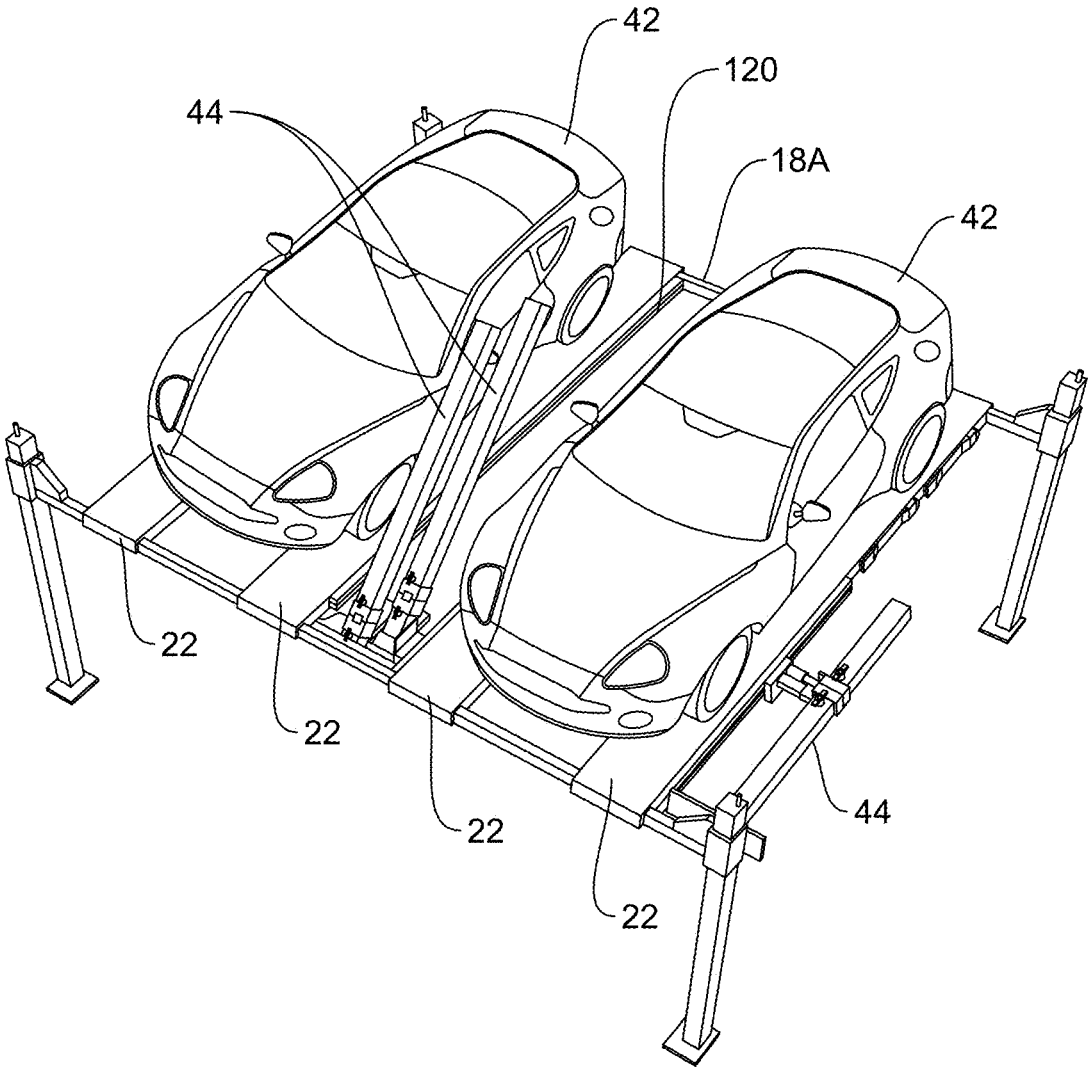
FIG. 28A is perspective view of a second embodiment of two vehicle support assemblies mounted to a lift.
Figure 28B:
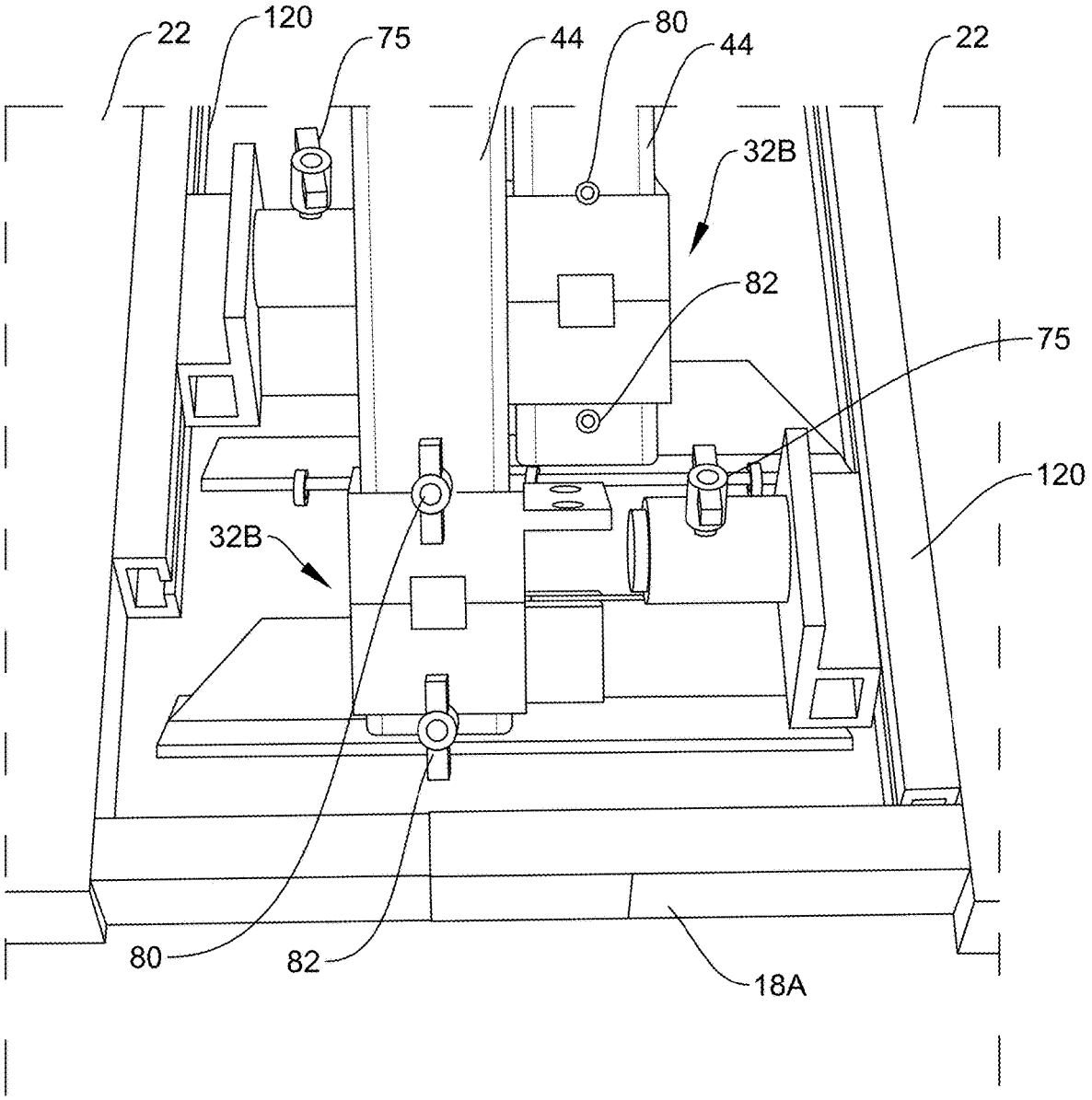
FIG. 28B is an enlarged perspective view if the embodiment of FIG. 28A.

FIG. 28 illustrates a rack 18A having two pairs of runways 22 and how a two-post support assembly can be provided for each pair of runways 22. In FIG. 28, the previous embodiment of the two-post support assembly is illustrated; however, it should be understood that any of the two-post support assembly embodiments herein disclosed having the carriage assembly coupled to the runways 22 can be provided for a rack 18A having two pairs of runways 22. In FIG. 28, all the posts 44 are illustrated in a horizontal storage position; however, this should not be considered limiting. If desired, any of the posts 44 can have a vertically oriented storage position such as illustrated in FIG. 19 whether where the base 45 is on the ground or the post 44 is elevated partially or completely. Location of the center two posts 44 in the embodiment of FIG. 28 where the posts 44 do not have a horizontal storage position can be advantageous for it allows center walkway panels to be present between the innermost runways 22 of the adjacent vehicles 42. Besides vertically oriented storage positions for the center posts 44, if desired, the center posts 44 could also be tilted preferably upwardly so as to have overall heights similar to the vehicles 42. The center posts 44 can be tilted toward each other with their bases 45 on opposite ends of the rack 18A, or one or both of the guides 120 can be of sufficient length to allow the center posts 44 to be positioned on the one end of the rack 18A. The center posts 44 can be held in their inclined or tilted positions by a lock provided for each of the pivot assemblies such as with pins 75 as described above.

Figure 29:
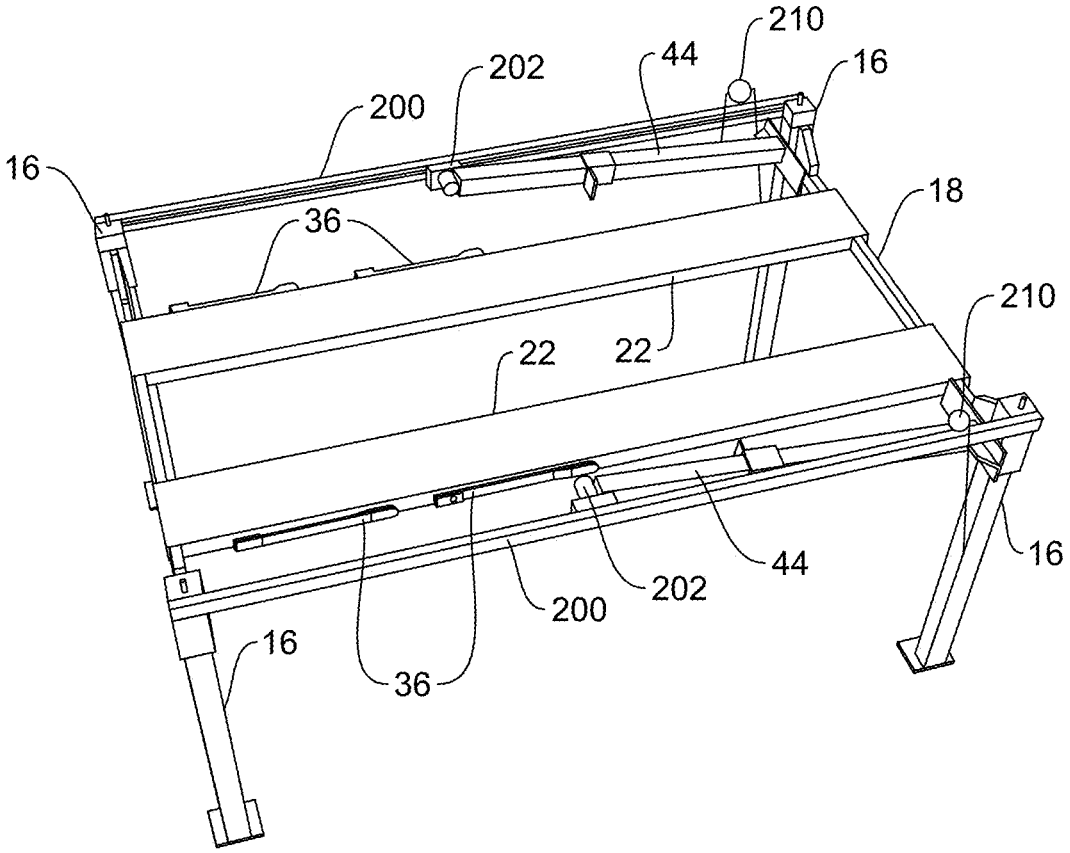
FIG. 29 is perspective view of another embodiment of a vehicle lift support assembly.
Figure 30:
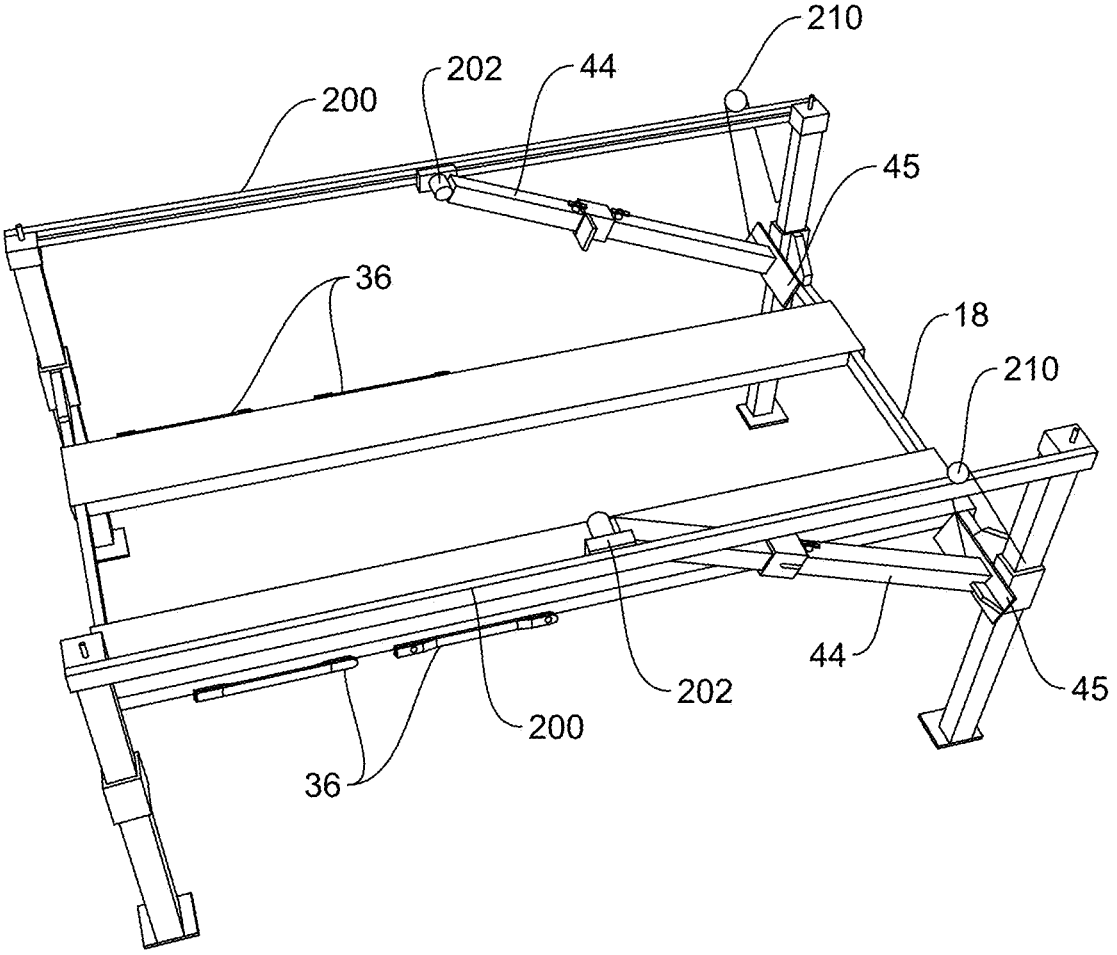
FIG. 30 is a perspective view of the vehicle support assembly of FIG. 29 in an alternative position.
Figure 31:
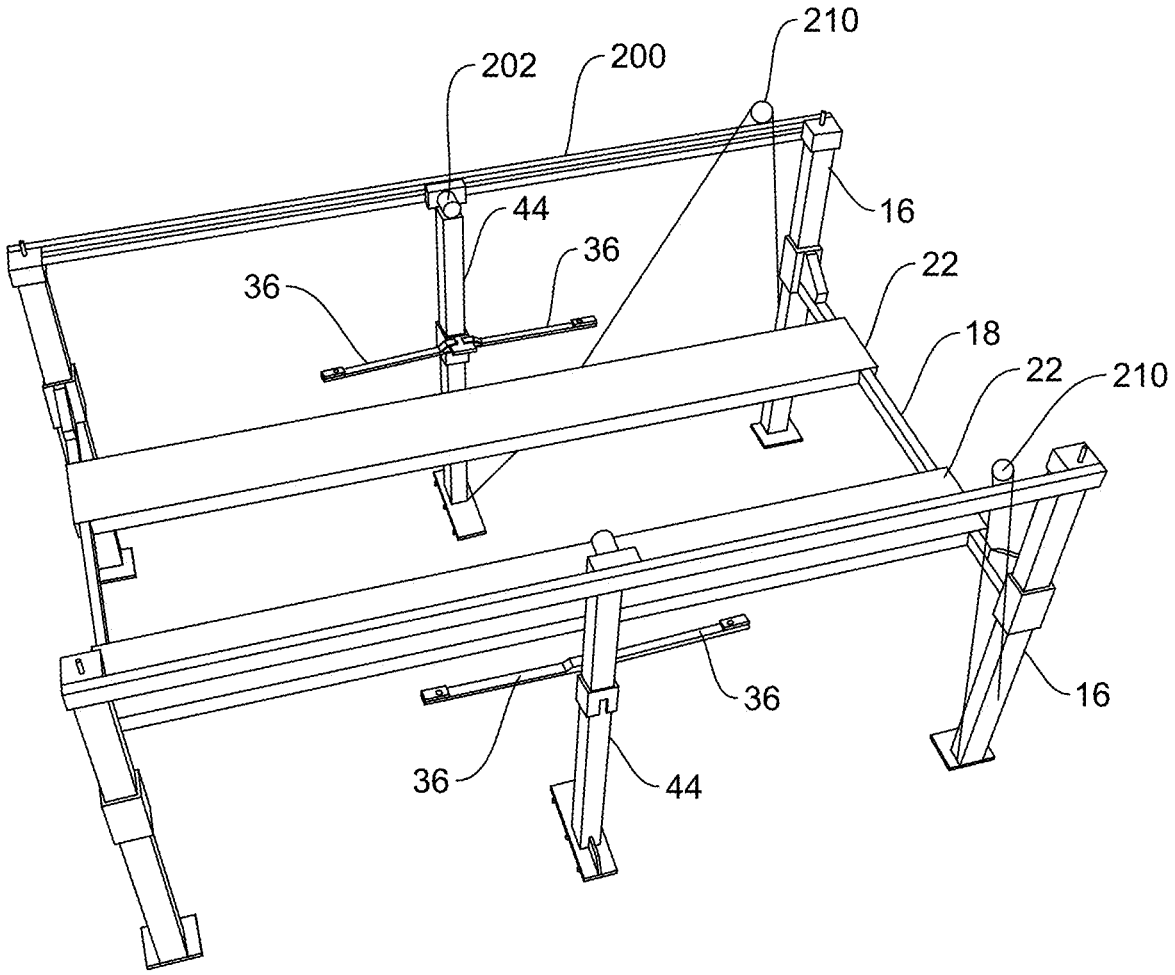
FIG. 31 is a perspective view of the vehicle support assembly of FIG. 29 in an operative position.
Figure 32:
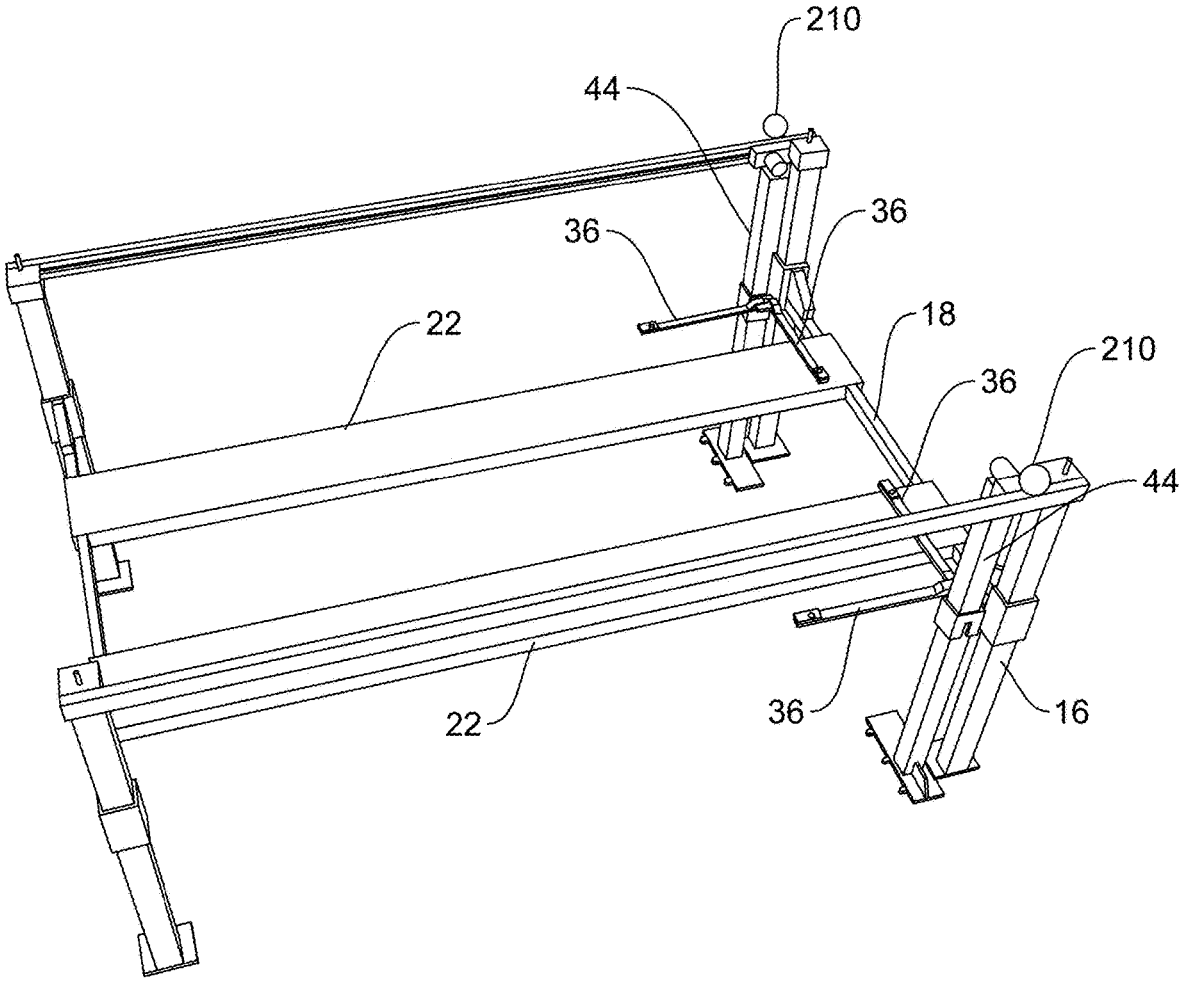
FIG. 32 is a perspective view of the vehicle support assembly of FIG. 29 in a storage position.

FIGS. 29-32 illustrate an embodiment where each post 44 is moveably coupled to a guide 200 that remains in a fixed position irrespective of the position of the rack 18 and the runways 22. In other words, the guide 200 is fixedly attached to the frame herein the vertically oriented supports 16. In the embodiment of FIGS. 29-31, the posts 44 are pivotally coupled to the guide 200 using a pivot connection tool 202. In FIG. 29, the posts 44 are in a generally horizontal/tilted storage position where a lift mechanism 210, for example, comprising rope(s) and pulley(s), has been provided for each post 44 to lift the base 45 upwardly. For example, the lift mechanism 210 can comprise ropes or cables connected to the base 45 of each post 44. FIG. 30 illustrates the lift mechanism 210 partially lowering each associated base 45. FIG. 31 illustrates each post 44 assuming a vertical position. In FIG. 31, one of the ropes of the lift mechanism 210 is still coupled to one of the bases 45, while the other illustrates that the rope can be disconnected and conveniently stored next to the support 16. The carriage assemblies are not fully illustrated, but can take the form of any of those described above. The vehicle 42 is transferred from the runways 22 to the arms 36 in a manner similar to that described above. If desired, the arms 36 can be disposed above the associated runways 22 (for example as shown in FIG. 32) such that the arms 36 raise and lower the carriage assemblies when the rack 18 and runways 22 are raised and lowered.

FIG. 32 illustrates a storage position where the posts are transverse or perpendicular to the runways 22. The lift mechanisms 210 need not be used if this storage position is desired for the posts 44.

Figure 33:
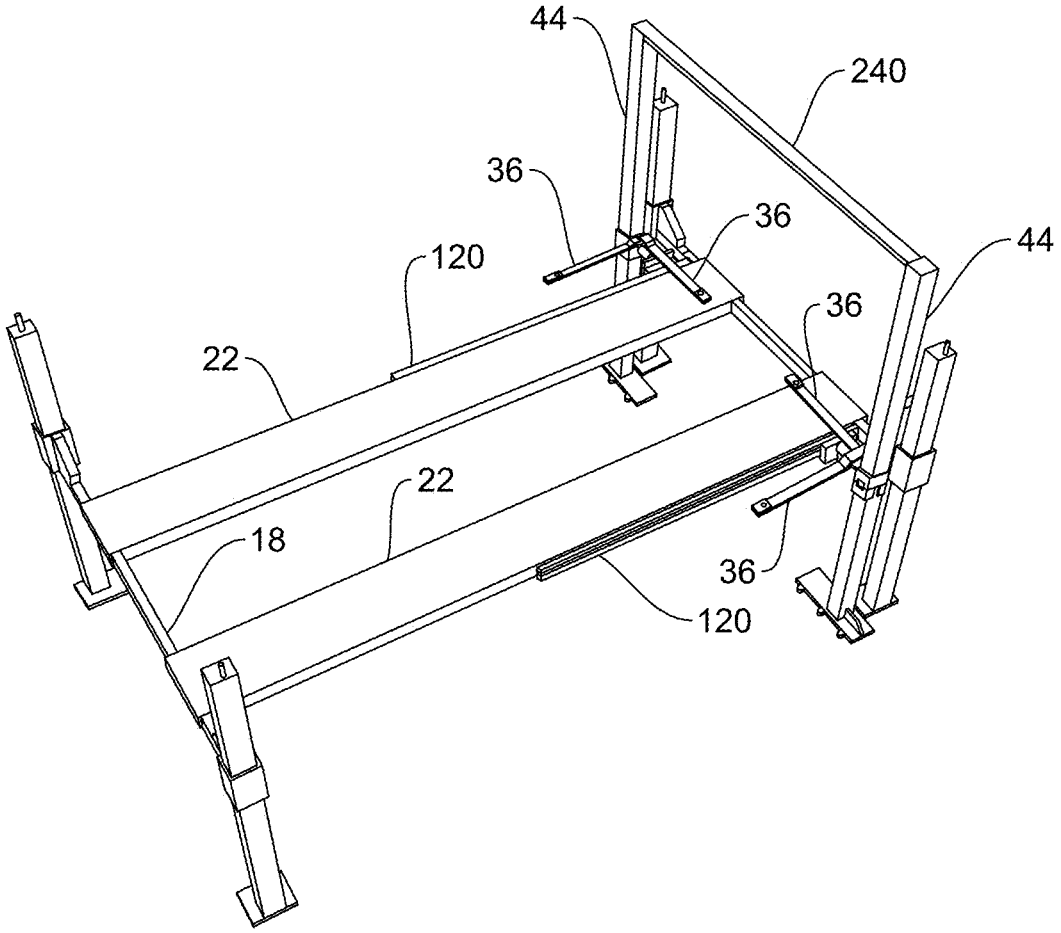
FIG. 33 is a perspective view of another embodiment of a vehicle support assembly.
Figure 34:
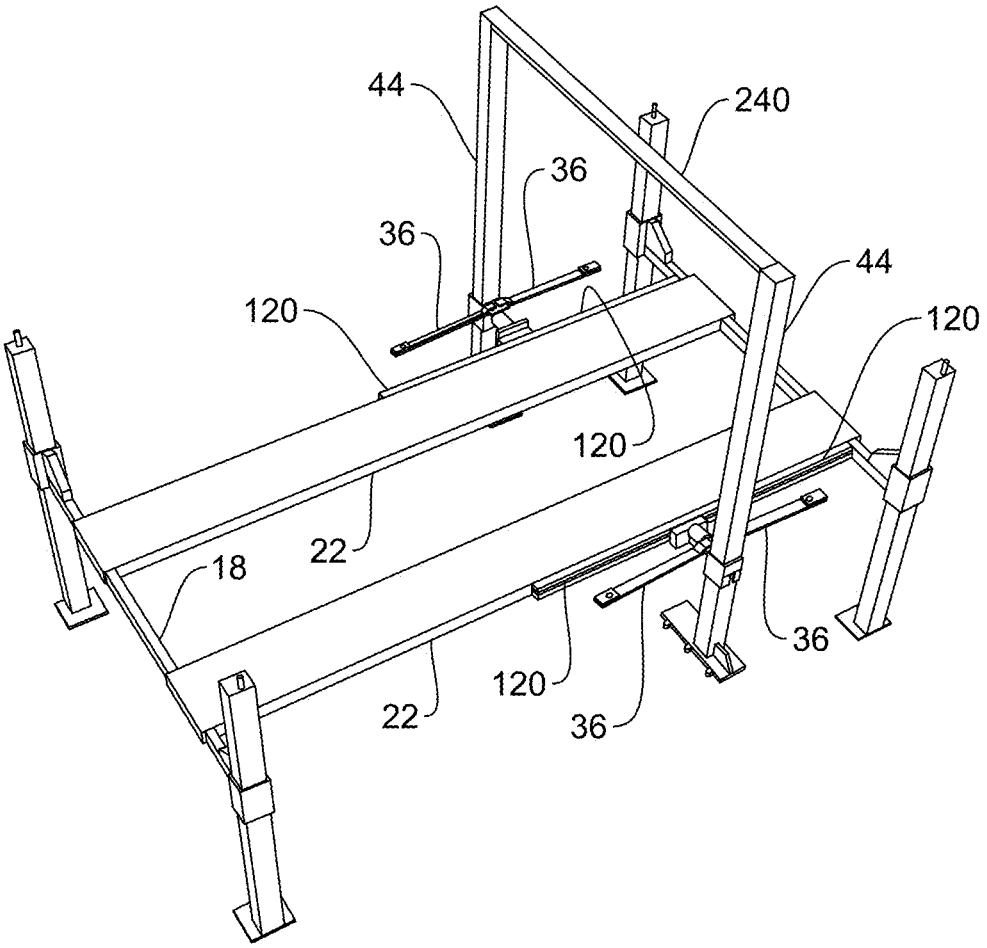
FIG. 34 is a perspective view of the vehicle support assembly of FIG. 33 in a second position.

FIG. 33 illustrates the carriage assembly of the embodiment of FIG. 23 however an upper brace 240 extends between the posts 44 so as to provide additional support. FIG. 34 illustrates how the rack 18 and runways 22 can be lifted so as to lift the carriage assemblies, posts, etc. off the ground such that the posts 44 can be displaced from their storage positions to an operative position using the guides 120. It should be noted that the carriage assemblies can be pivotable or nonpivotable if desired.

Figure 36:
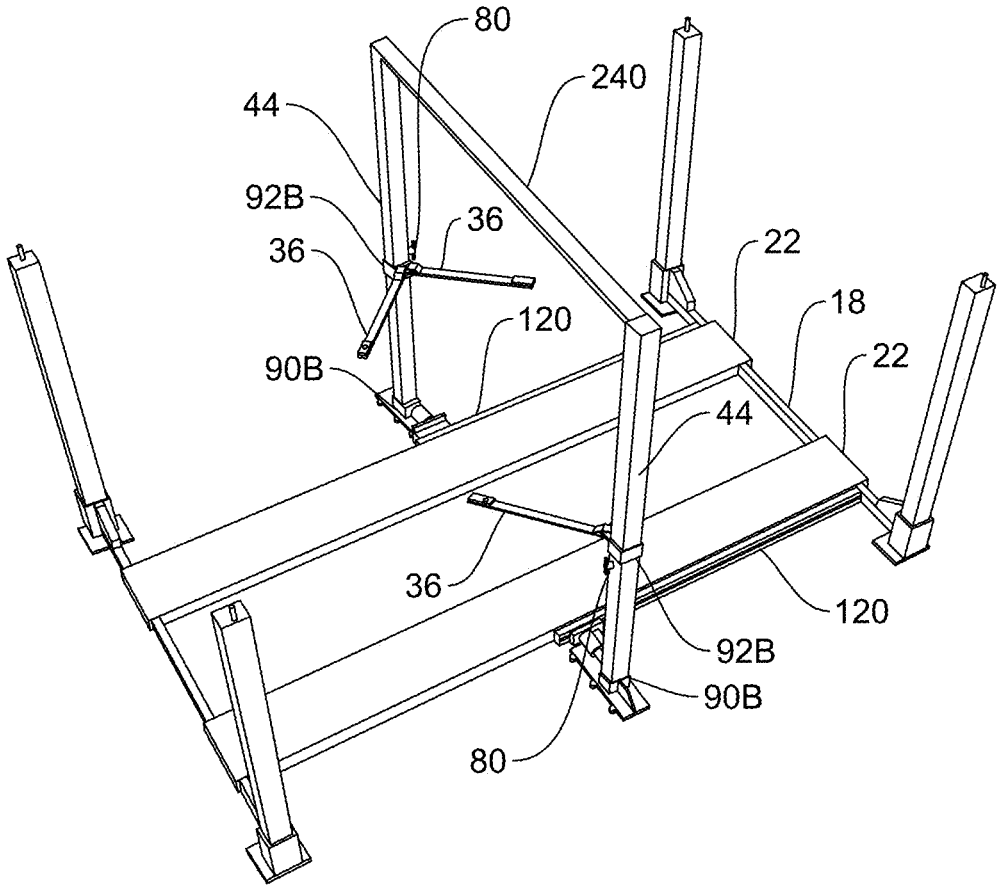
FIG. 36 is a perspective view of the vehicle support assembly of FIG. 33 in another position.

FIG. 36 illustrates the rack 18 and runways 22 being lowered while the arm carriage 92B and arms 36 have been held in a vertical position by the pins 80.

Figure 35:
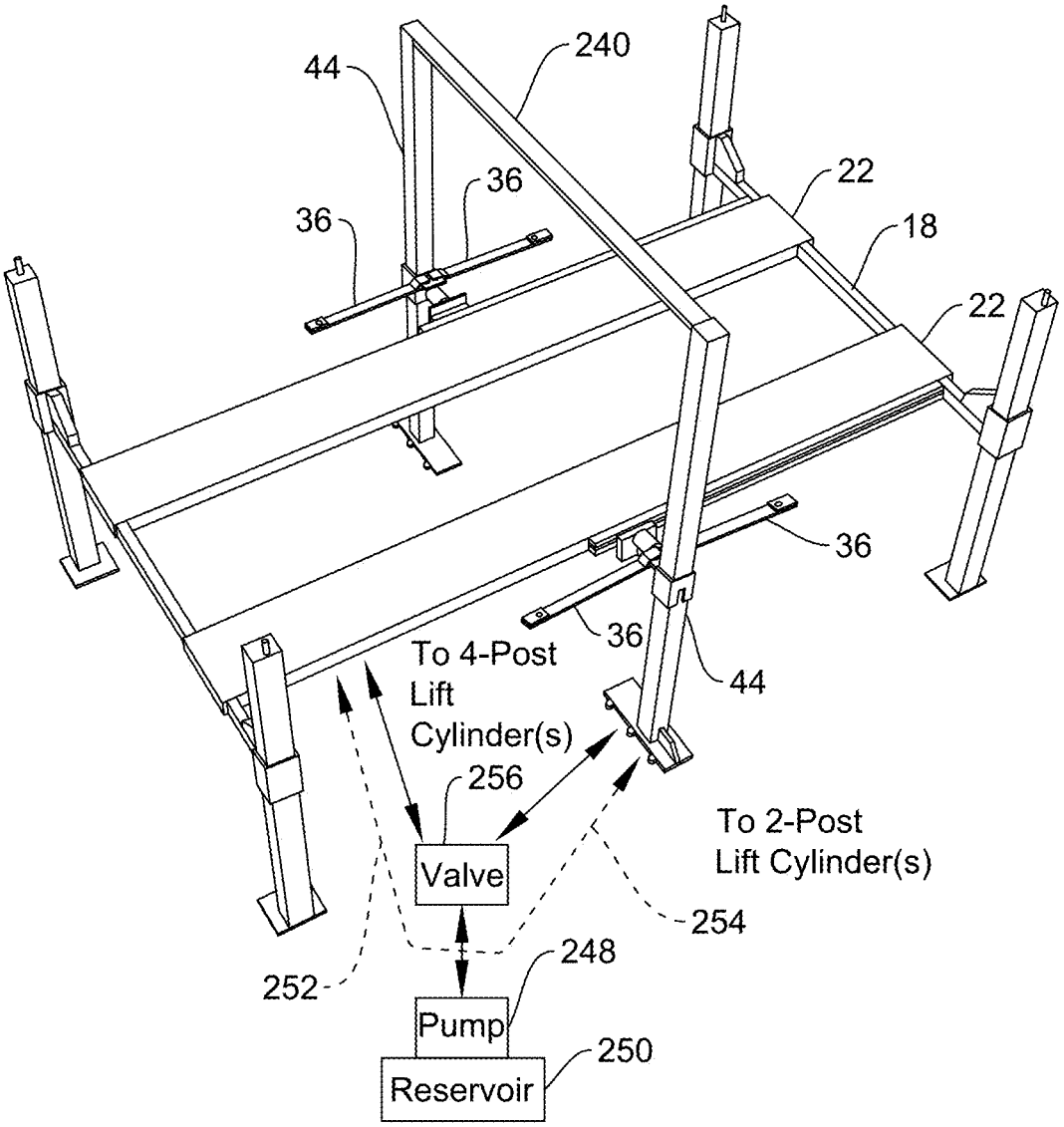
FIG. 35 is a perspective view of the vehicle support assembly of FIG. 33 in an operative position.

Although in the previous embodiments, the two-post support assembly does not include any lift mechanism, it should be noted that in an alternative embodiment lift mechanisms can be provided to control the position of the arms 36 independent of the rack 18 and runways 22, if desired. Referring to FIG. 35, typically, such a two-post lift would have at least one actuator disposed in one of the posts 44. If a single actuator is provided, cabling extends from the actuator to the other post 44 through the upper brace member 240 so as to lift and lower the other carriage assembly simultaneously with the other carriage assembly. If an actuator is provided for each post, the upper brace member 240 can be used to support the hydraulic line(s).

FIG. 35 further illustrates how a single hydraulic pump 248 and reservoir 250 can be used in conjunction with the actuator(s) of the runway vertical lift and the actuators(s) of the two-post vehicle lift. In particular, the pump 248 and reservoir 250 can be selectively fluidly connected to each of the actuator(s) of the runway lift and the two post lift when desired as illustrated by dashed lines 252 and 254, respectively. Alternatively, the pump 248 can be connected to a valve 256 which in turn controls the flow of hydraulic fluid to the actuators of each of the vehicle lifts. The reservoir 250 is sized so as to be large enough to hold all of the fluid from the runway lift and the two-post lift when needed.

Figure 37:
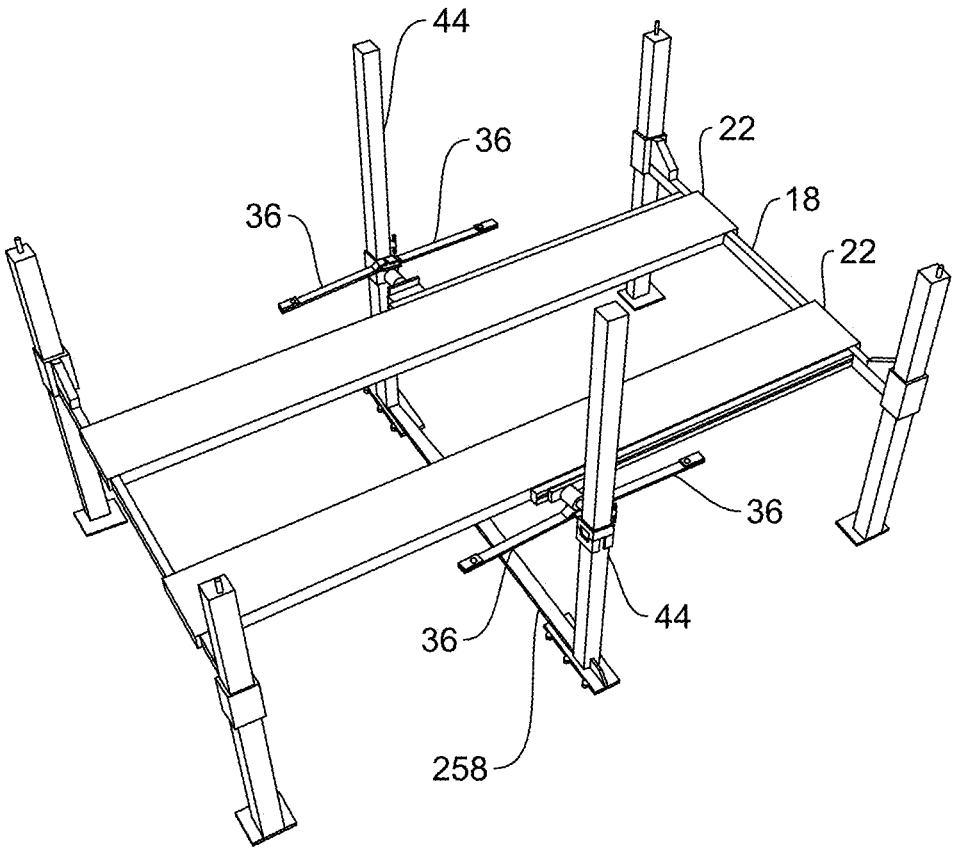
FIG. 37 is a perspective view of another embodiment of a vehicle support assembly.

FIG. 37 illustrates a lower connecting member 258 that is sometimes present in two-post vertical lifts having actuators for the cabling or hydraulic lines for each of the post lift mechanisms.

Figure 38:
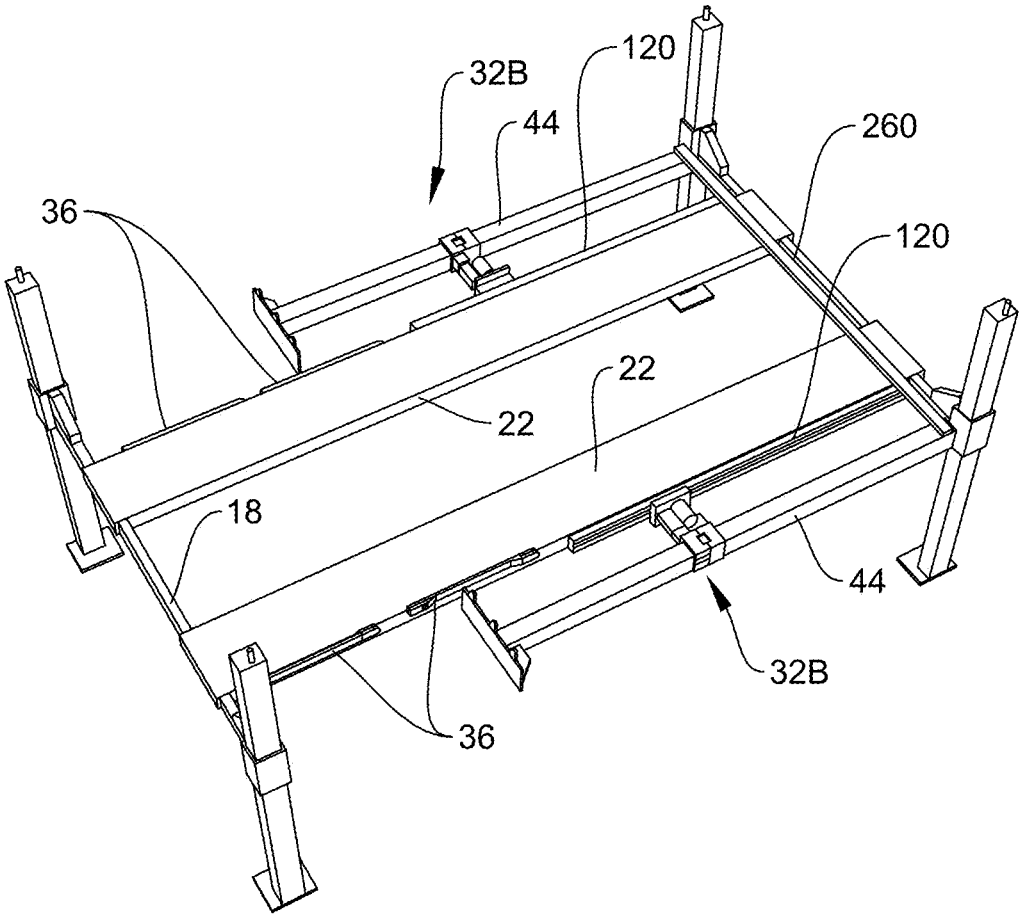
FIG. 38 is a perspective view of the vehicle support assembly of FIG. 37 in a storage position.
Figure 39:
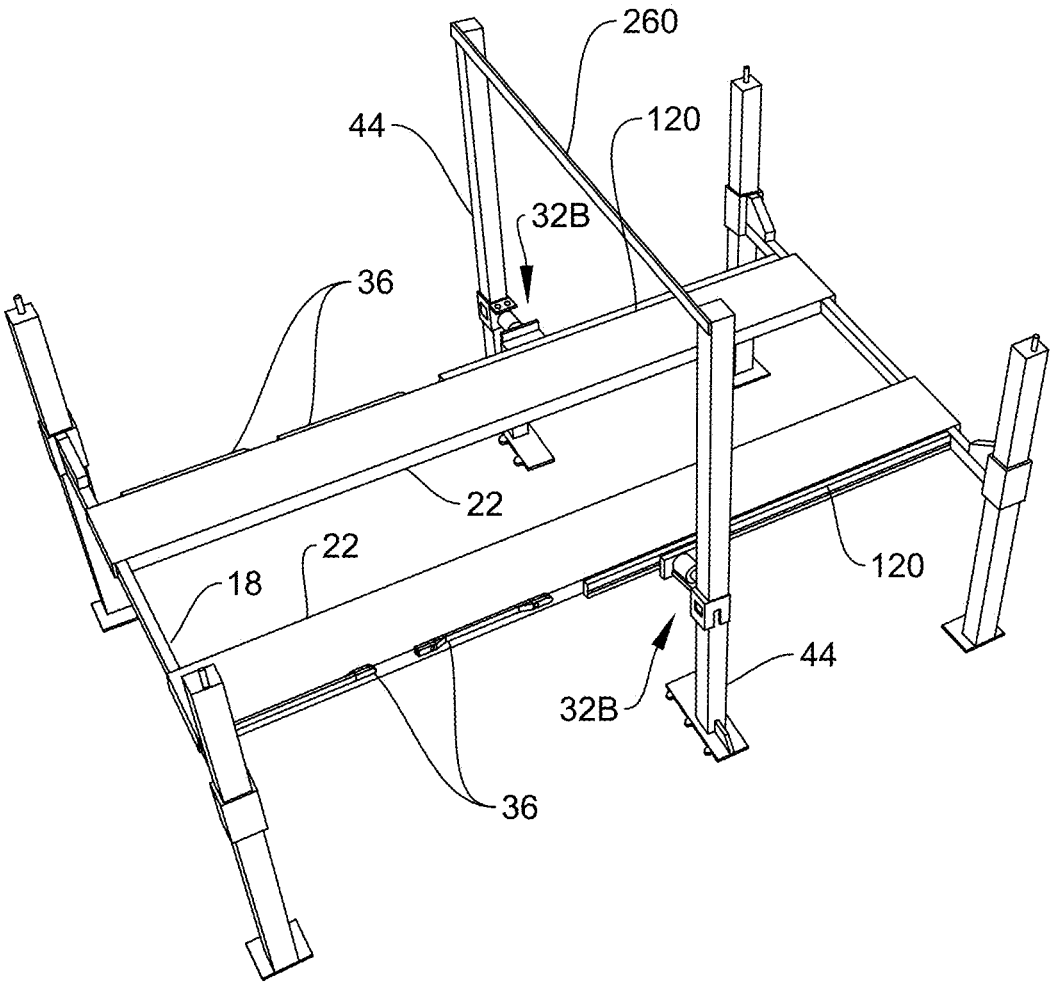
FIG. 39 is a perspective view of the vehicle support assembly of FIG. 37 in another position.
Figure 40:
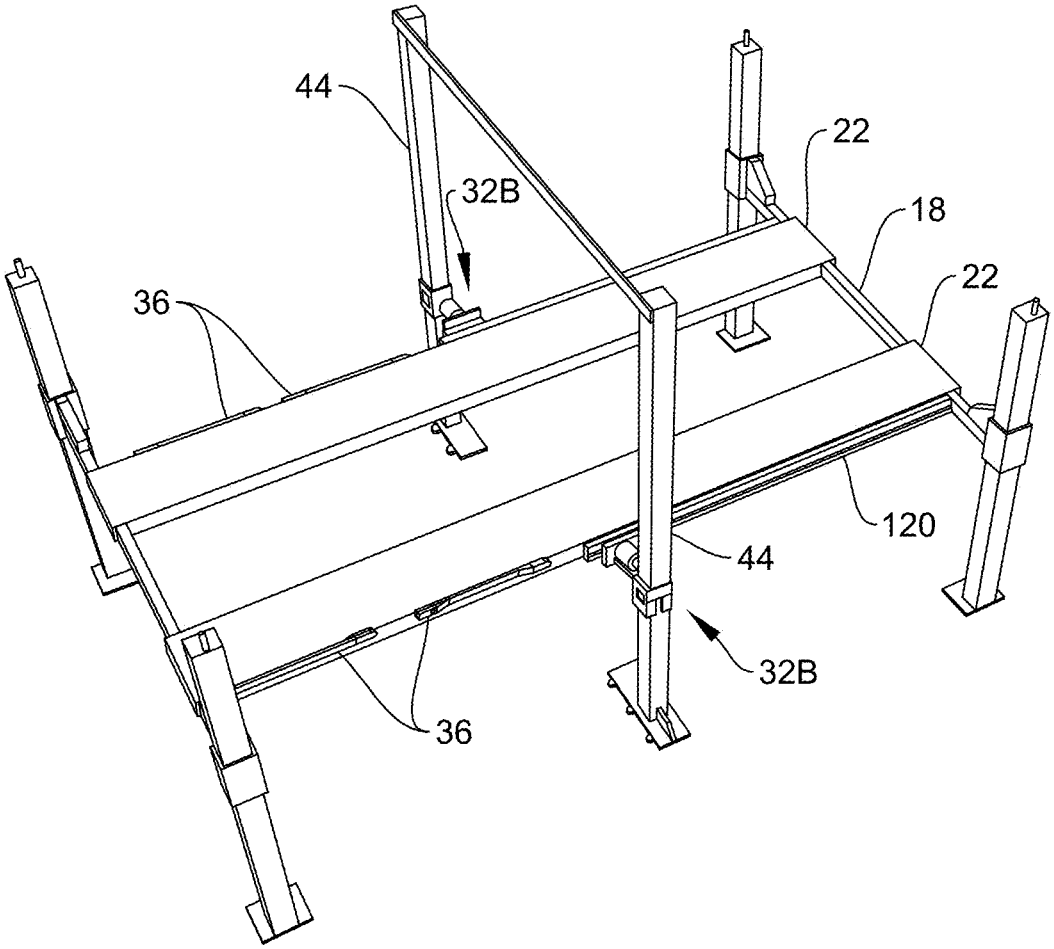
FIG. 40 is a perspective view of the vehicle support assembly of FIG. 37 in yet another position.
Figure 41:
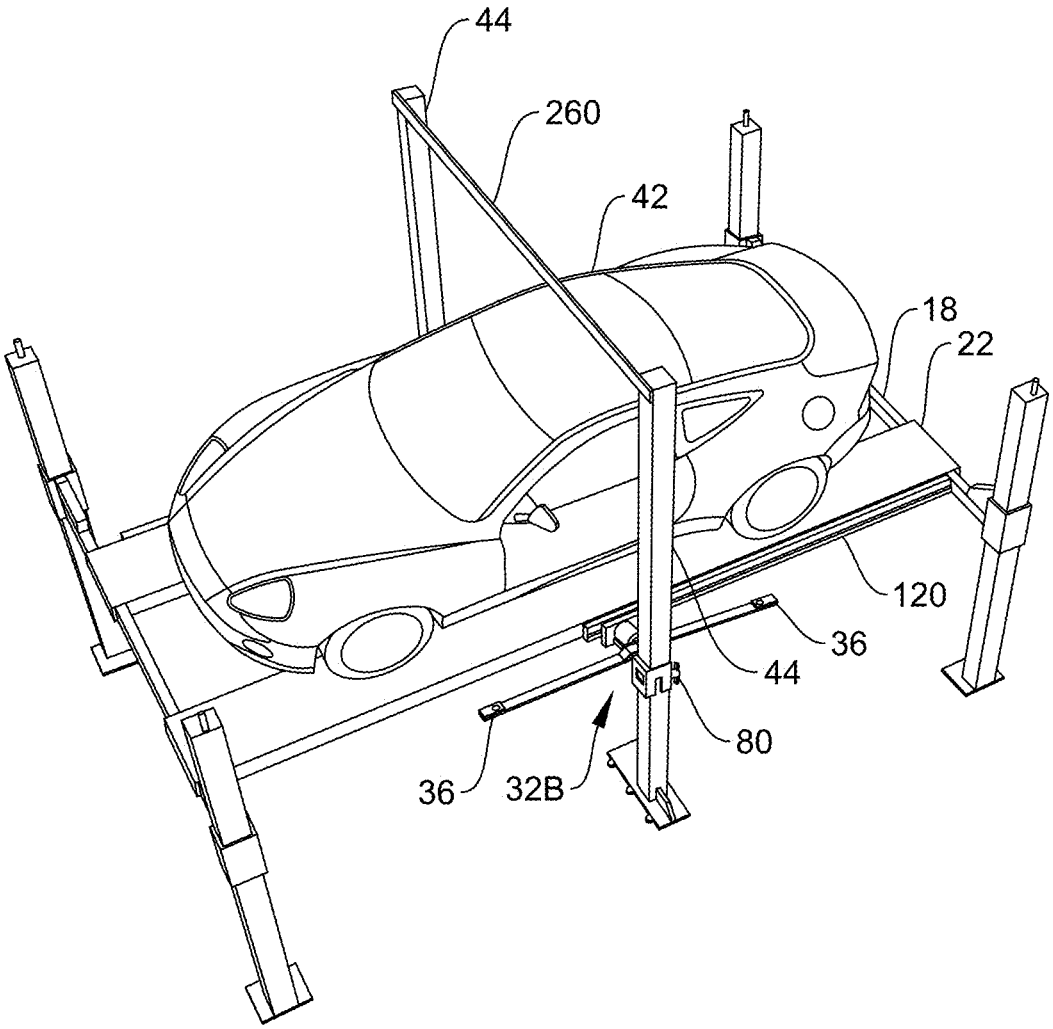
FIG. 41 is a perspective view of the vehicle support assembly of FIG. 37 in yet another position.
Figure 42:
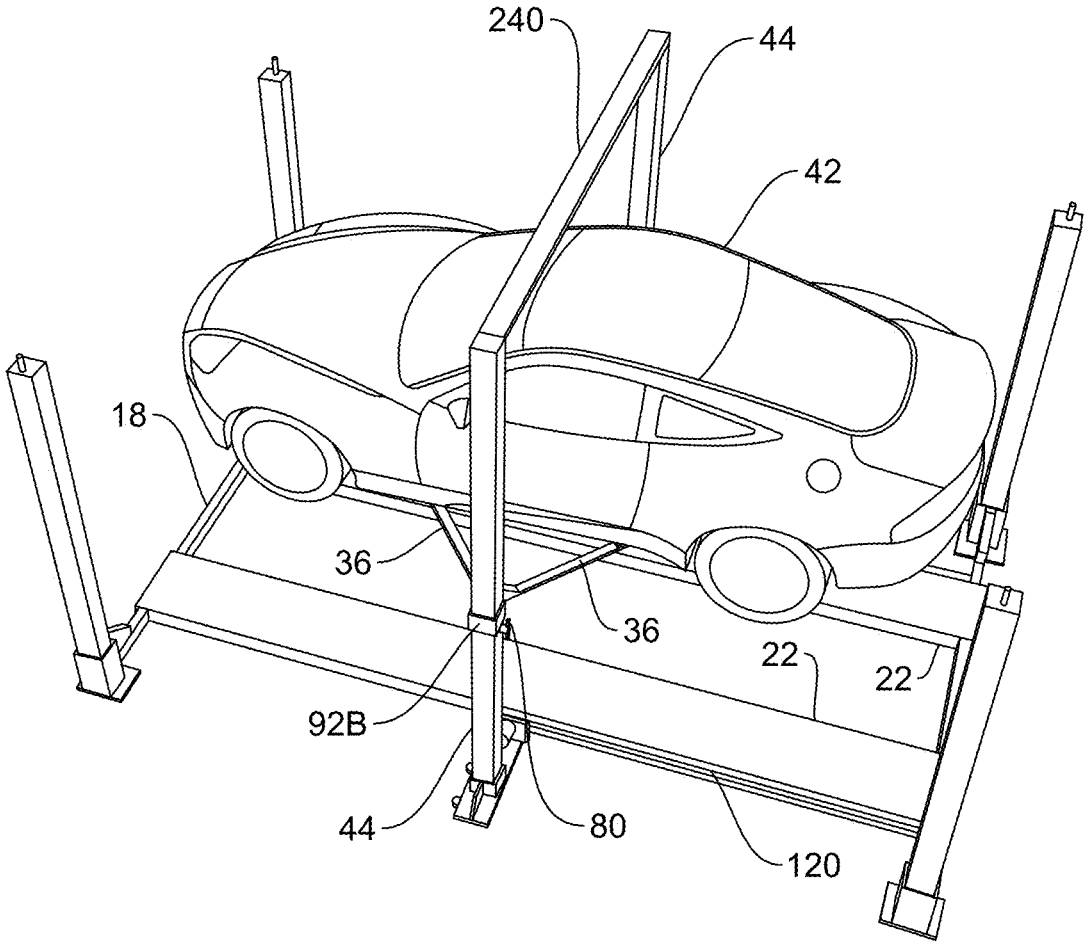
FIG. 42 is a perspective view of another embodiment of a vehicle support assembly.
Figure 43:
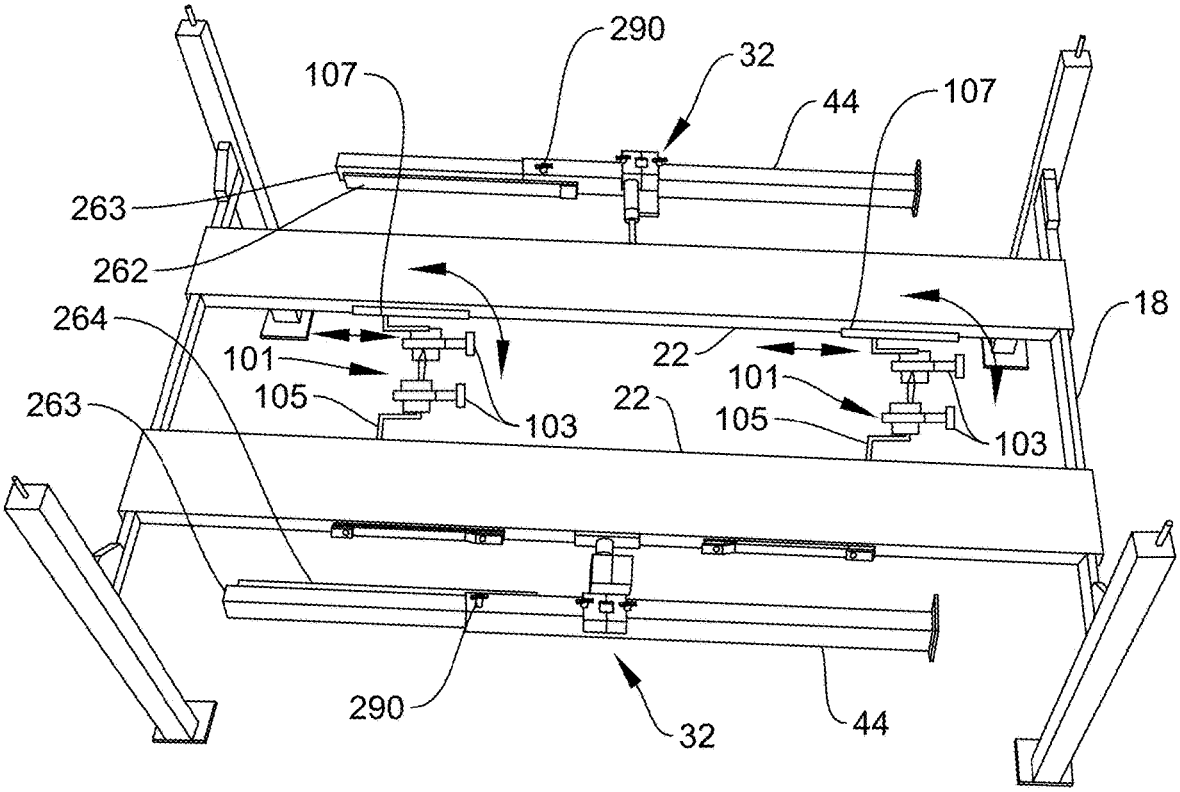
FIG. 43 is a perspective view of yet another embodiment of a vehicle support assembly.
Figure 44:
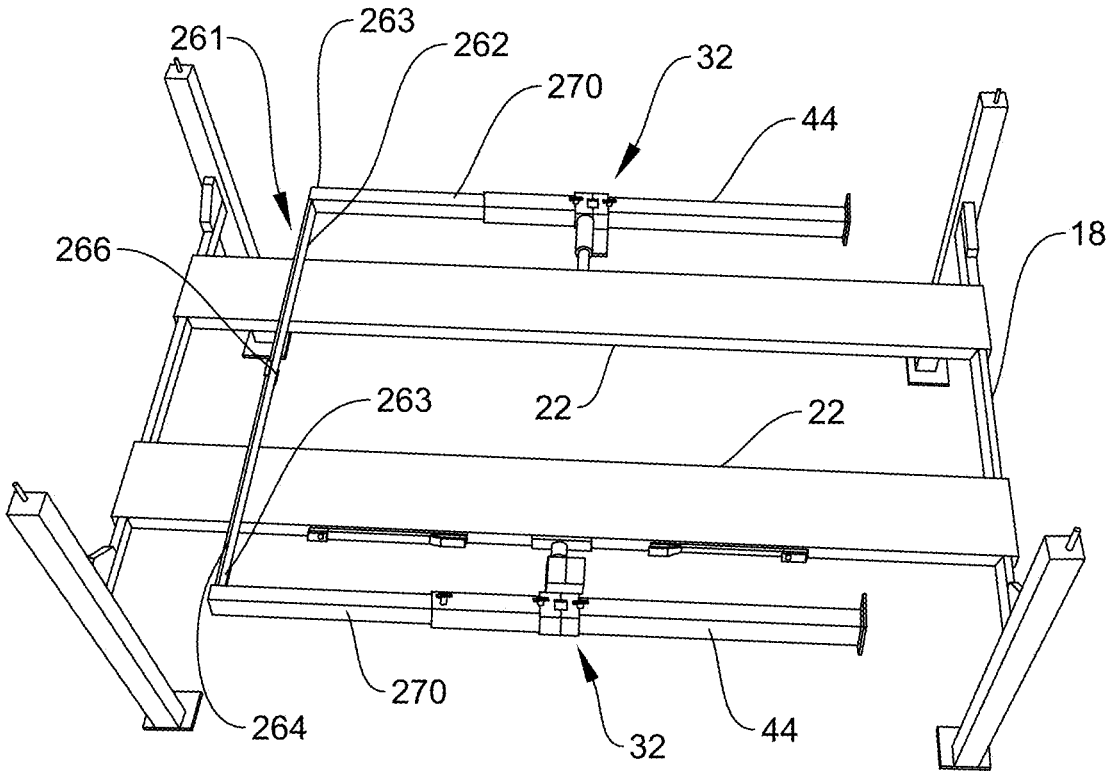
FIG. 44 is a perspective view of the vehicle support assembly of FIG. 43 in another position.
Figure 45:
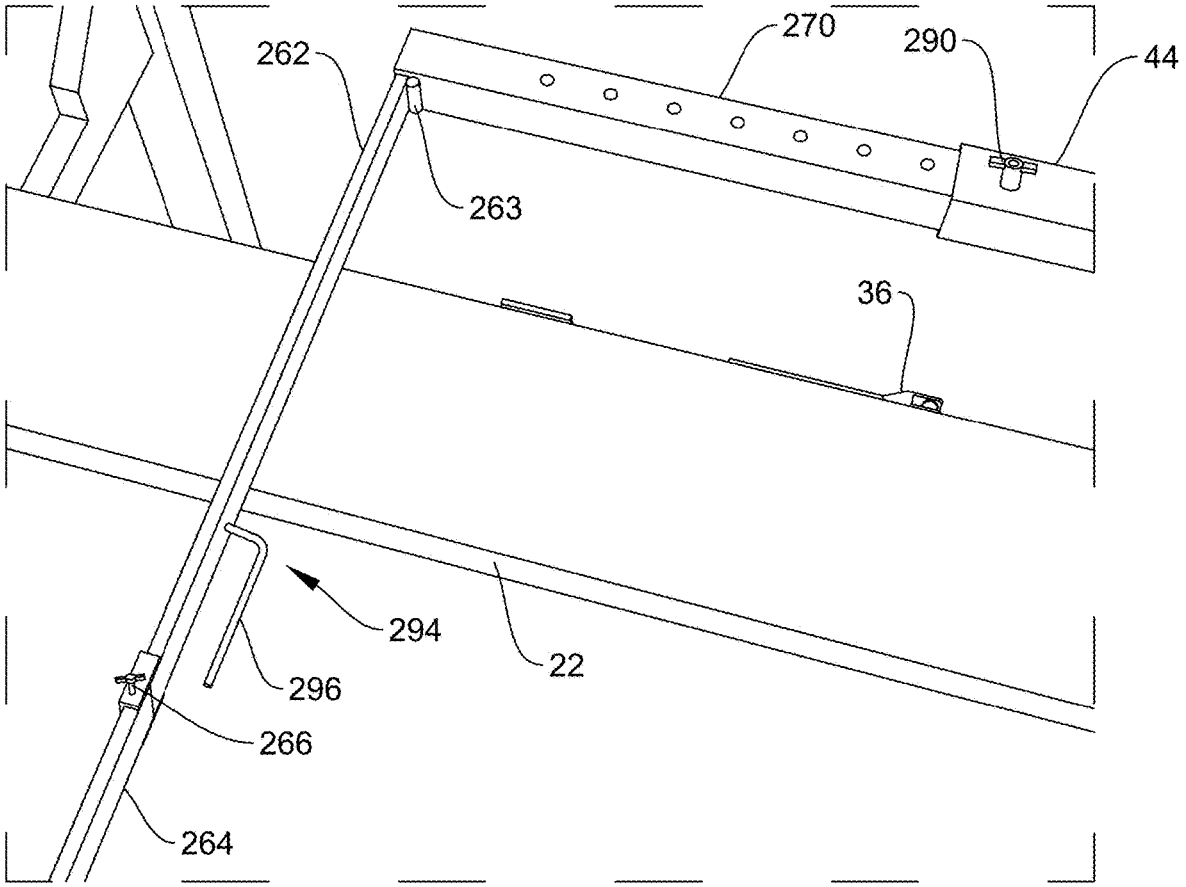
FIG. 45 is an enlarged perspective view of the vehicle support assembly of FIG. 43.
Figure 46:
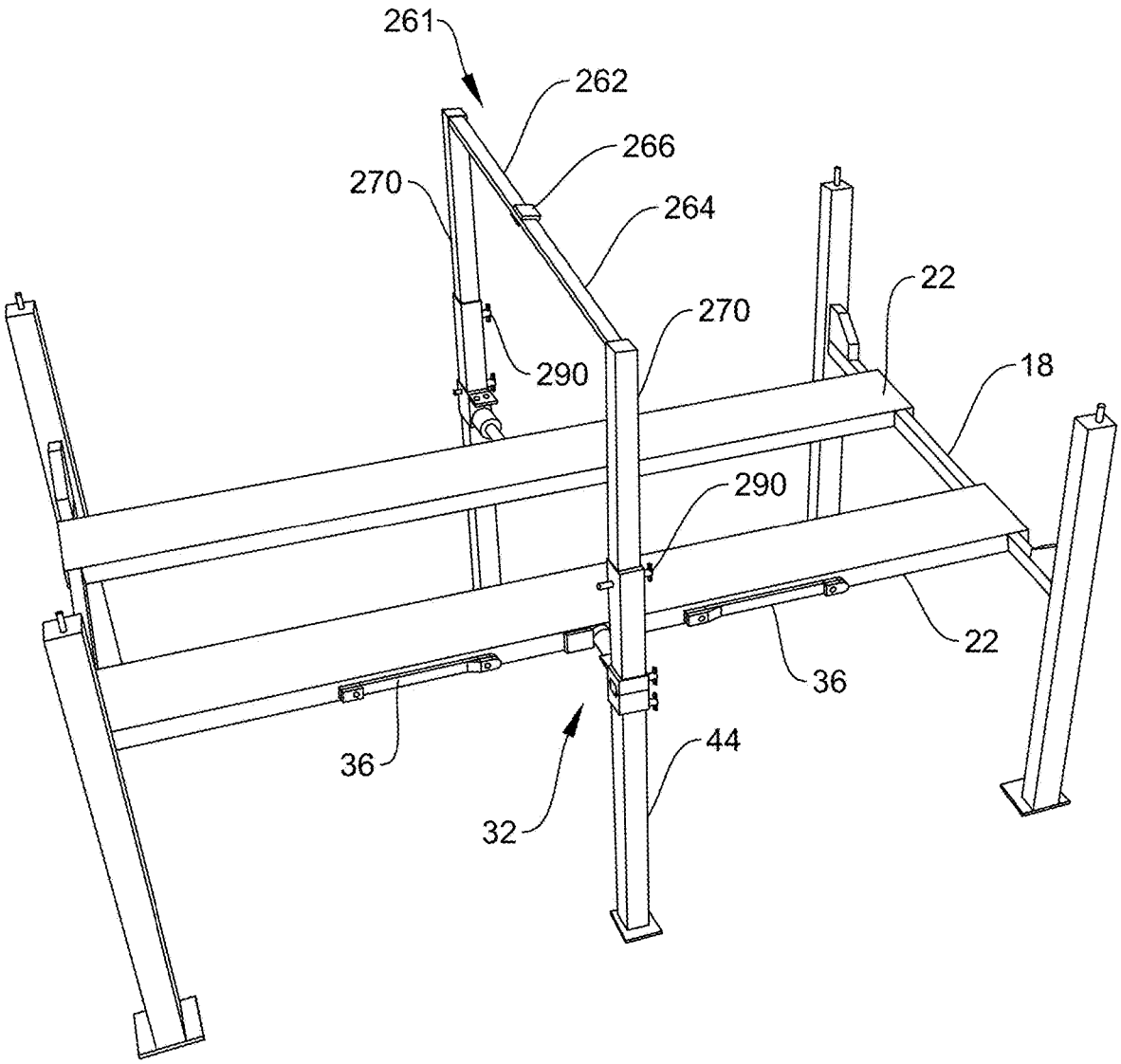
FIG. 46 is a perspective view of the vehicle support assembly of FIG. 43 in an operative position.
Figure 47:
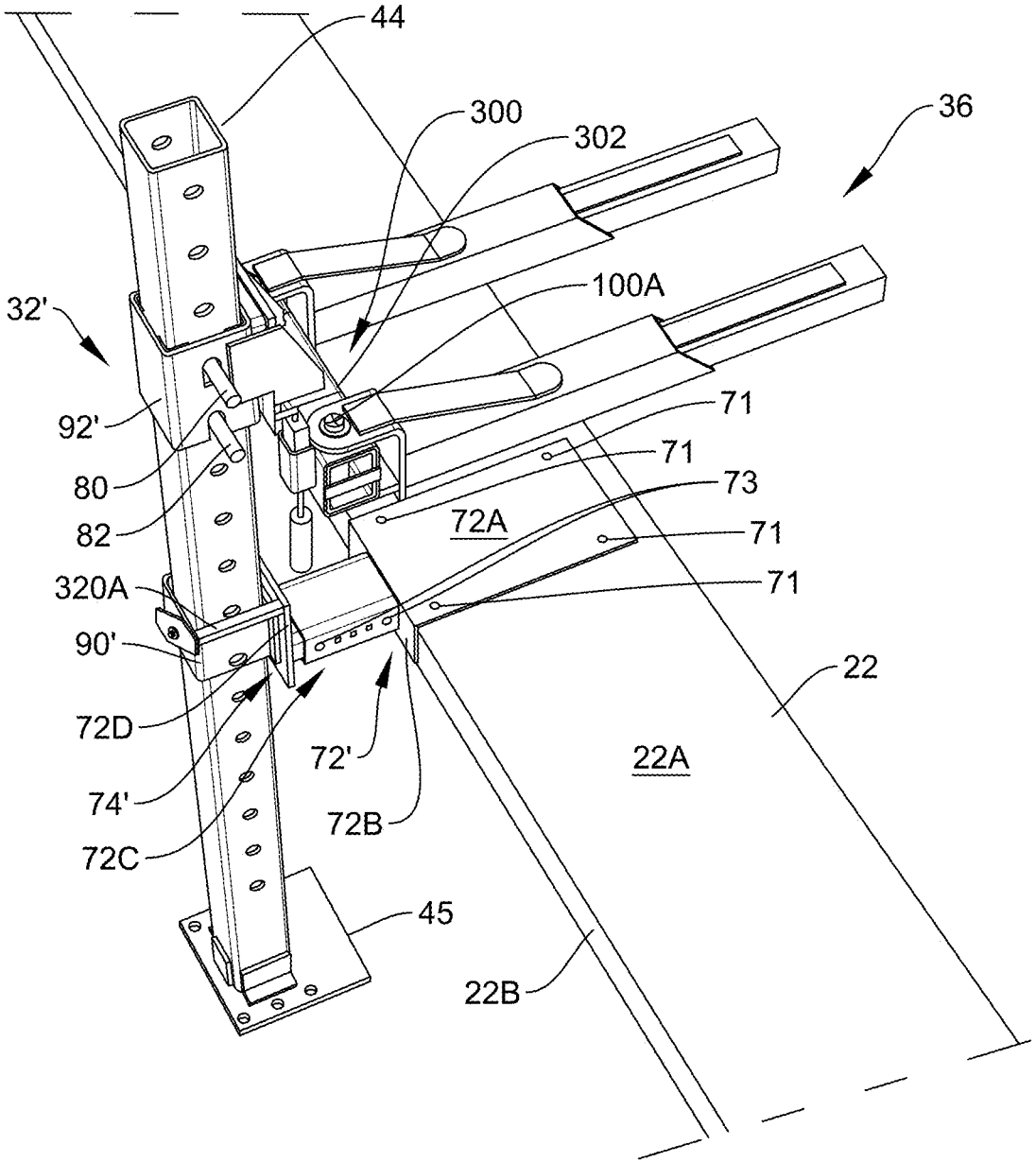
FIGS. 47 and 48 are perspective views of yet another embodiment of one column assembly of a vehicle support assembly.

FIG. 38 illustrates a lift having an upper brace 260 connected to each of the posts 44 in a manner so as to allow the posts 44 to be substantially horizontal in the storage position. FIG. 39 illustrates the upper brace 260 and posts 44 being moved along the runways 22 when the runways 22 and carriage assemblies are configured to elevate the posts 44 so as to allow movement along the guides 120. FIGS. 40 and 41 illustrate location of the posts 44 in a position to support the vehicle. FIG. 42 illustrates the vehicle 42 being supported with the upper brace member 240, but could also be upper brace 240, connecting the upper portions of each of the posts 44. FIGS. 43-46 illustrate a couplable upper brace support member 261 which allows each post 44 to be in a horizontal position. The upper brace support member 261 includes a first portion 262 connected to one of the posts 44 and a second member 264 connected to the other post 44. The connection can be with a hinge 263 as illustrated in FIG. 45. The portions 262 and 264 can be selectively coupled together as illustrated in FIGS. 44 and 45 using a locking pin 266. FIG. 46 illustrates the post 44 oriented to a vertical position wherein the upper brace support member 261 spans between the upper ends of the posts 44. It should be noted, that each posts 44 can include an extendable portion 270 so as to allow height adjustment of the upper brace support member 261 depending upon the height of the vehicle and the height of the available space in the working environment. The portions 270 would include apertures that are alignable within apertures provided in the upper ends of the posts 44. A locking pin 290 is inserted through the apertures on the upper end of the posts 44 and through selected apertures of each of the portions 270 in order to adjust the extension of the extendable portion 270 and the vertical position of the upper support brace member 261. Referring to FIG. 45 one or both of the members 262 or 264 carry a sensor 294 that senses when the roof of the vehicle come close to the upper brace 261. For instance, the sensor 294 can be a contact sensor having a portion 296 that deflects or moves with contact with the vehicle roof. The sensor 294 is configured to so as to stop operation of the pump when contact is made.

FIGS. 47-54 illustrate another embodiment where the similar reference numbers have been used to identify the same or similar components as described above. A carriage assembly 32' includes an arm carriage 92' and an arm carriage driver 90'. A pivot assembly 70' couples the carriage assembly 32' to a respective runway 22 and includes a first portion 72' mounted to the runway 22. A second portion 74' is pivotably coupled to the first portion 72'. The second portion 74' connects to the carriage assembly 32', in particular arm carriage driver 90'. The first portion 72' is an L-shaped plate assembly having an upwardly facing plate 72A secured to similar facing surfaces of the runway 22 using fasteners 71 (FIG. 48), adhesive and/or welding, herein exemplified as an upwardly facing surface 22A. A side plate 72B connected to upwardly facing plate 72A is disposed on a side surface 22B of the runway 22. In the embodiment illustrated, the first portion 72' includes an optional telescoping assembly 72C that allows a distance between the carriage assembly 32'/post 44 and the runway 22 to be selected as desired. Fasteners 73 can be used to selectively adjust the spacing of the members of the telescoping assembly 72C. A support member 72D, herein exemplified as a plate, is joined to an end of the tube assembly 72C opposite the runway 22.

Arm carriage 92' is advantageously selectively secured to post 44 using the two pins 80 and 82 extending through spaced apart apertures in arm carriage 92'. The use of two pins 80 and 82 prevents the arm carriage 92' from pivoting on post 44, which would be the case if only one pivot pin was used. The use of two pivot pins 80 and 82 helps maintain arms 36 essentially horizontal even when carrying a load from the vehicle.

Figure 48:
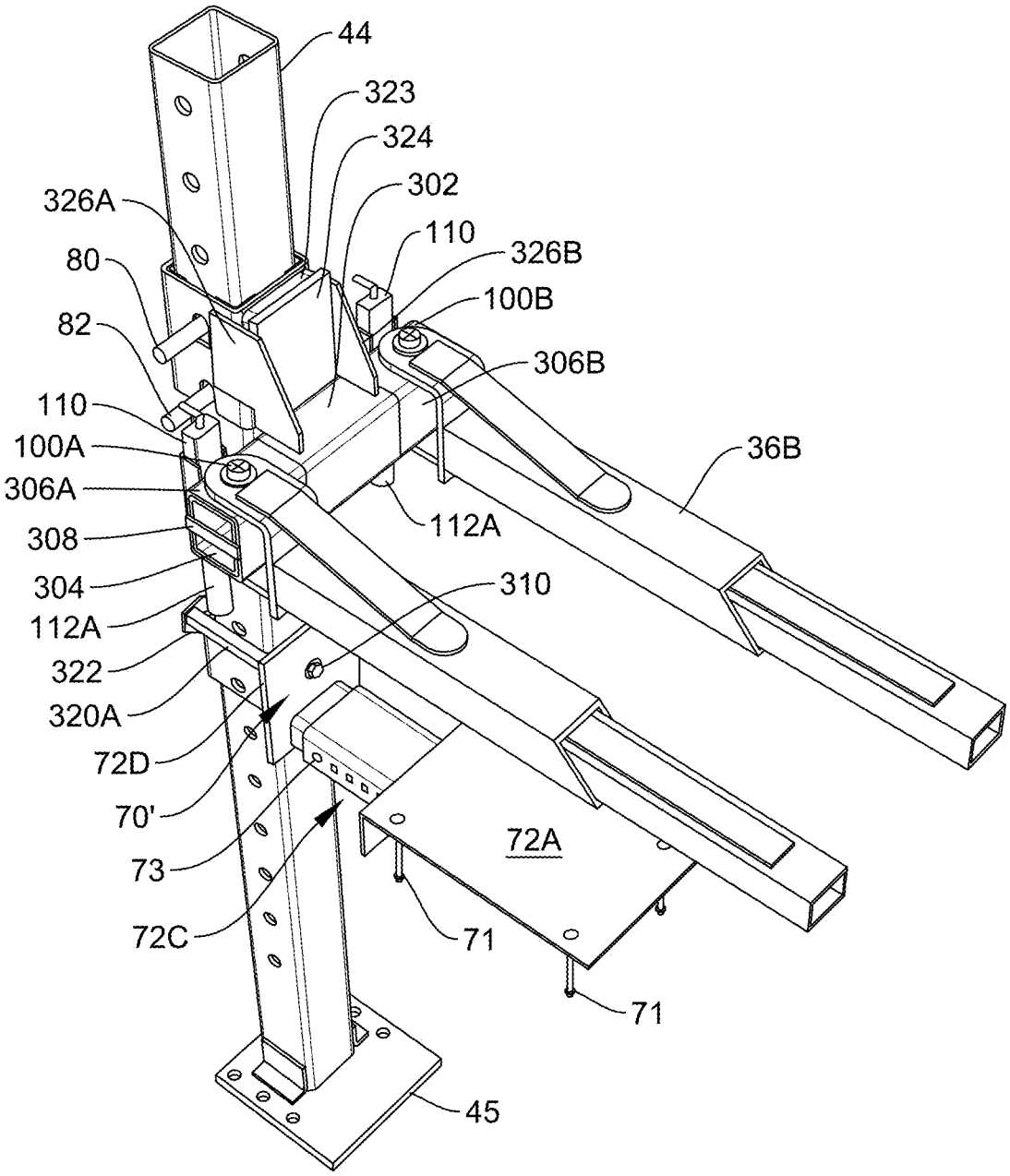

In this embodiment, arm carriage 92' includes a crossbeam assembly 300 that supports arms 36 that can be selectively removed from. Referring to FIG. 48, the crossbeam assembly 300 includes crossbeam receiver 302 that receives a crossbeam 304 that is held in the crossbeam receiver 302 through interlocking elements locked together using one or both pivot pins 100A, 100B that are used to pivotally mount the arms 36 to the crossbeam 304.

Figure 49:
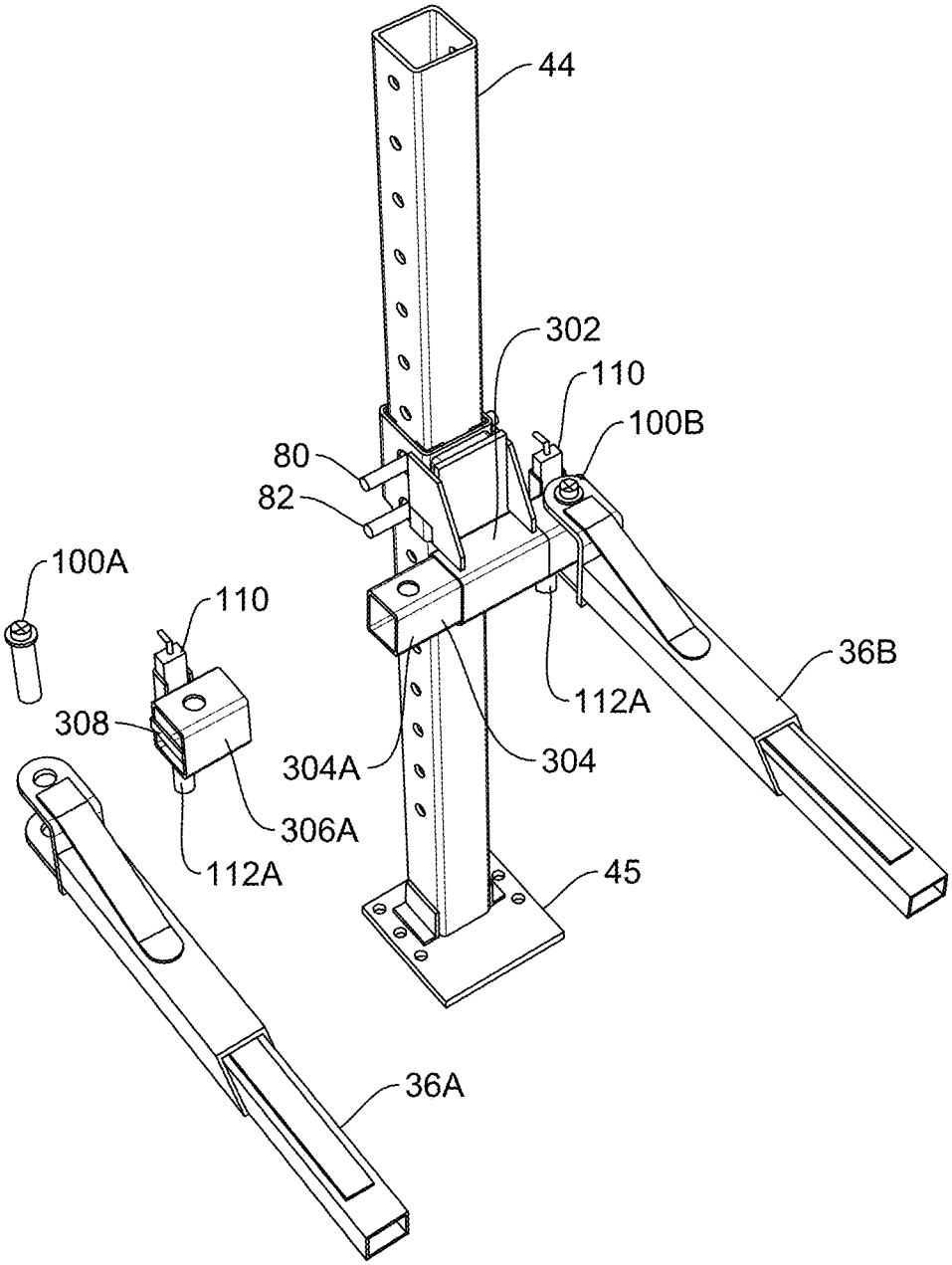
FIGS. 49 and 50 are exploded perspective views of the column assembly of FIG. 47.
Figure 50:
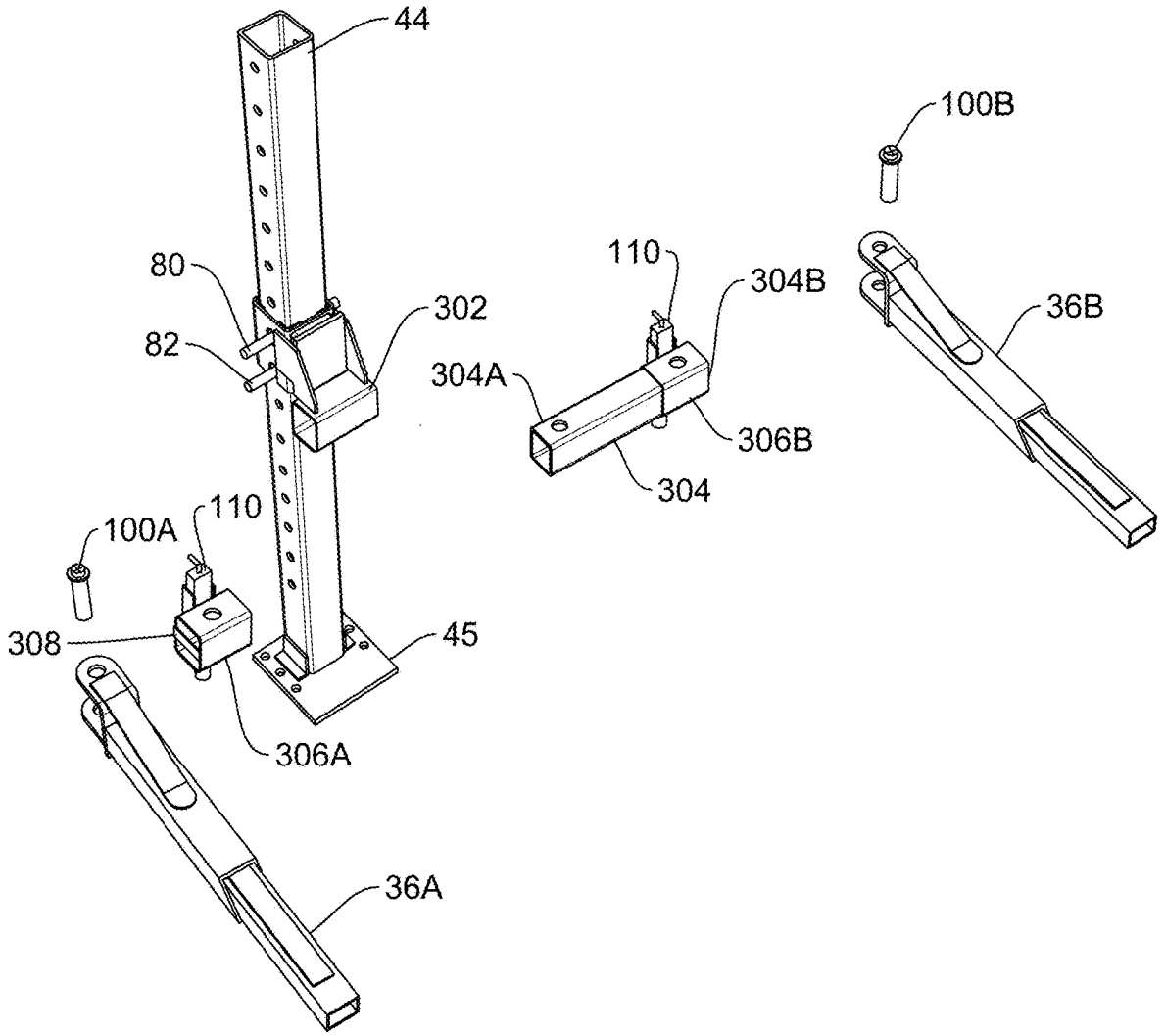

FIGS. 49 and 50 illustrate disassembly of the crossbeam assembly 300 and the arms 36, where the arm carriage driver 90', pivoting assembly 70' and first portion 72' have been removed for purposes of explanation. In FIG. 49 pivot pin 100A for the left-hand arm 36A is removed from aligned apertures in the arm 36A, an endcap 306A upon which the arm 36A is supported on, and an end 304A of the crossbeam 304. Removal of the pin 100A, allows the corresponding arm 36A to be separated from the endcap 306A, and the endcap 306A to be removed from the end 304A of the crossbeam 304. At this point, the crossbeam 304 can be removed from the crossbeam receiver 302 as illustrated in FIG. 50. If desired, pin 100B can be removed so as to allow arm 36B to be separated from end cap 306B, that in turn is mounted on end 304B of the crossbeam 304. Endcap 306B can be removable from the crossbeam 304 or can be fixedly secured to the end 304B of the crossbeam 304 such as by welding. The endcaps 306A and 306B are or size similar to the crossbeam receiver 302 such that when assembled and secured to the crossbeam 304, the endcaps 306A, 306B contact the crossbeam receiver 304 so as to allow only limited sliding movement of the crossbeam 304 in a direction of its longitudinal axis in the crossbeam receiver 302, if any. A stop plate 308 can be secured to an end surface of the endcaps 306A and/or 306B, which will contact the end of the crossbeam 304 at which point the apertures of the endcaps 306A, 306B are aligned with the respective apertures in the crossbeam 304

Figure 51:
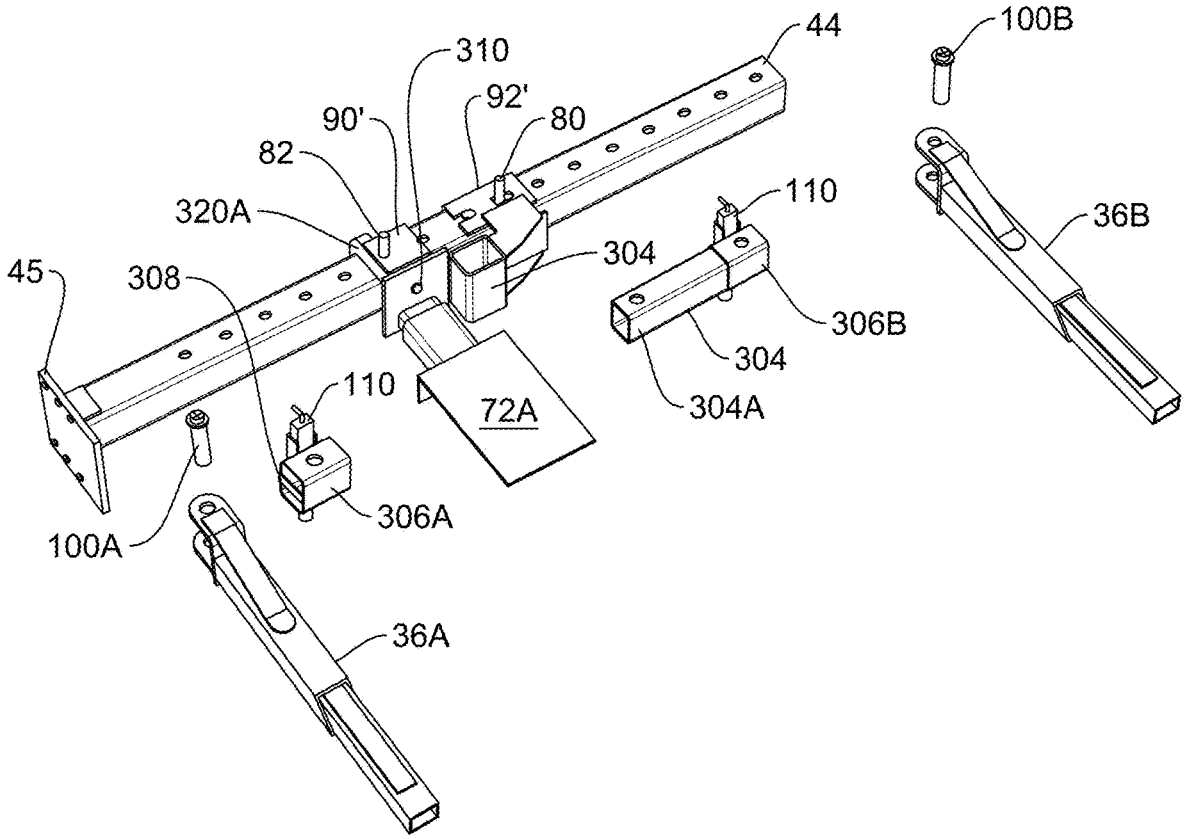
FIG. 51 is a perspective view of the column assembly of FIG. 47 in a storage position.

Removal of the crossbeam 304 reduces the width of the carriage assembly 32', which allows a pivot axis of the pivoting assembly 70' to be lower, i.e. closer the to the upper or lower surface of the runway 22. This reduces the overall height of the post 44 and carriage assembly 32' in the storage position making it less apt to be struck for example from a door of the vehicle when the vehicle door is opened with the vehicle on the runways 22. It also is desirable that the pivot axis of the pivot assembly 32' be at a sufficient height above the lower surface of the runway 22 so that in a horizontal position of the post 44 as illustrated in FIG. 51 the post 44 including its base 45 is higher than the lower surface of the runway 22 such that the runway 22 can be lowered to or at least proximate the ground surface without the post 44 or base 45 from contacting the ground surface in a manner that inhibits lowering of the runway 22.

Figure 52:
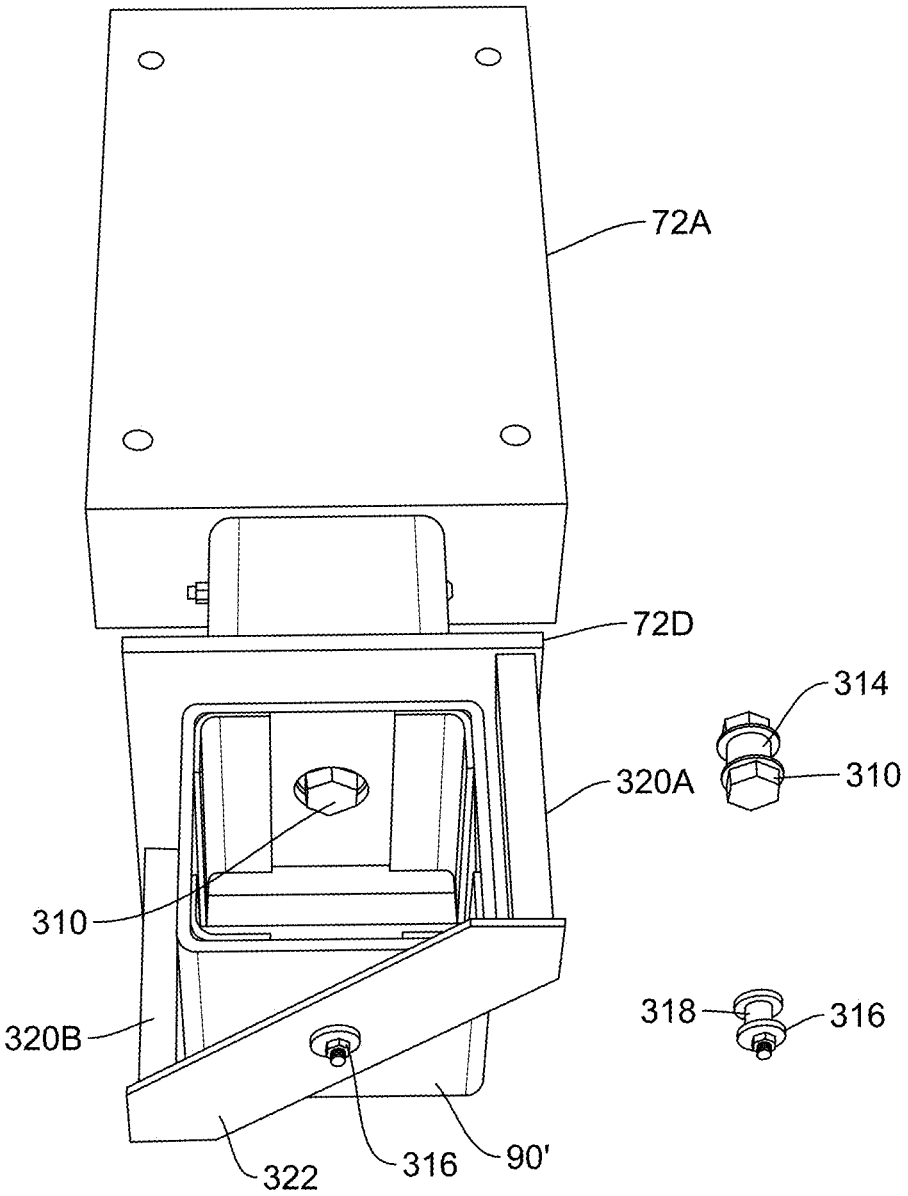
FIG. 52 is a perspective view of an arm carriage driver of the column assembly of FIG. 47.
Figure 53:
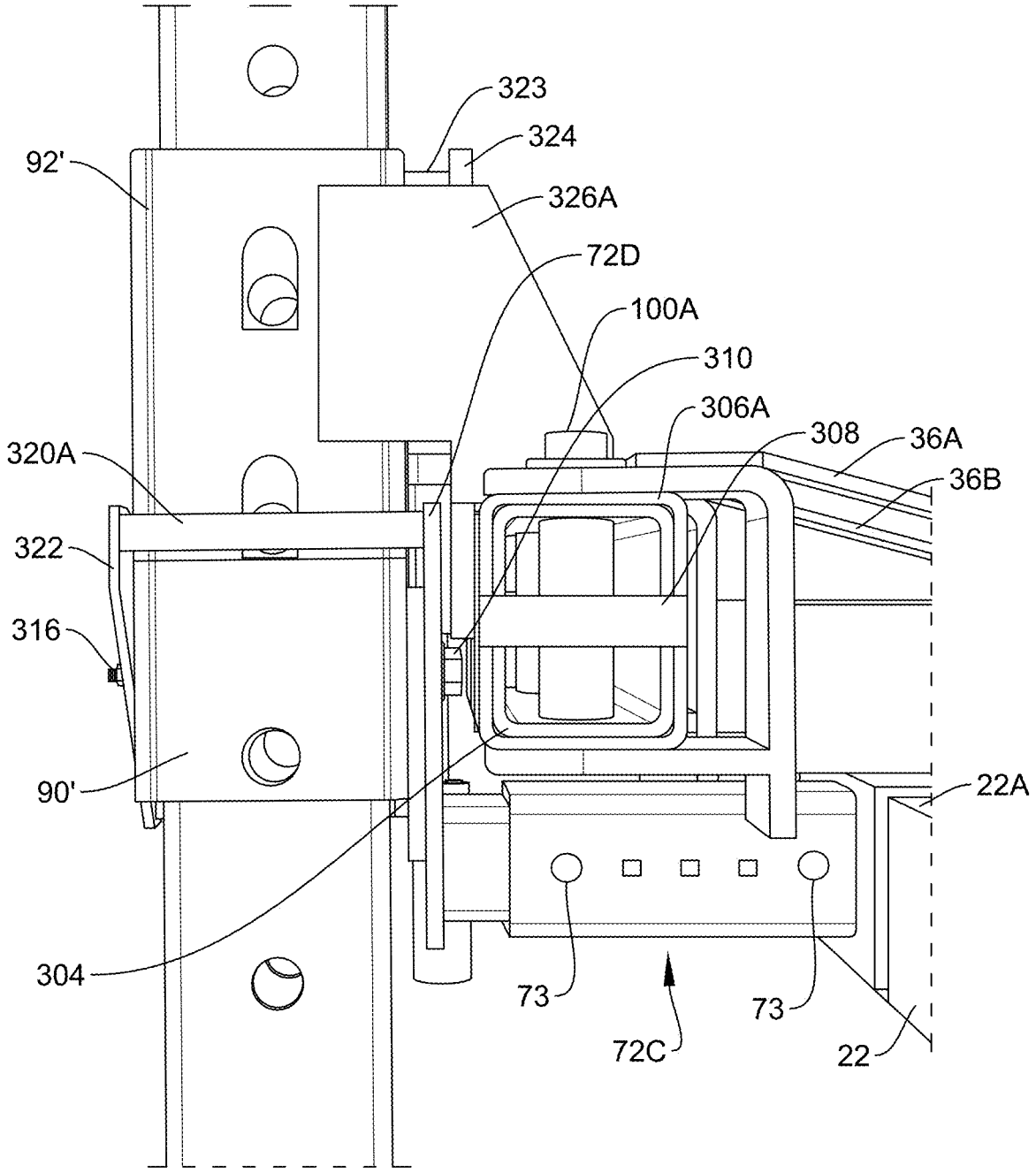
FIG. 53 is an enlarged perspective views of the column assembly of FIG. 47.

FIGS. 52 and 53 illustrate further advantageous, optional, aspects of the pivot assembly 70'. Like the pivot assembly 70 described above, a pivot pin 310 of pivoting assembly 70' is disposed between post 44 and runway 22. In this embodiment, the pivot pin 310 is formed of a fastener such as a fastening bolt and nut assembly, that secures the second portion 74' or arm carriage driver 90' to the support member 72D. The pivot pin 310 can include a bushing 314. Optionally, a second pivot pin 316 can be provided on an opposite side of the post 44/arm carriage driver 90' as the pivot pin 310 so as to provide support on the back side of the post 44/arm carriage driver 90', where the pivot axes of pivot pins 310 and 316 are substantially aligned with each other. The second pivot pin 316 can also take the form of a fastener such as a fastening bolt and nut assembly having a bushing 318. Support arms 320A and 320B are secured to support member 72D and extend along sides of the post 44/arm carriage driver 90' and are joined to a support plate 322. The support plate 322 supports the second pivot pin 316. It should also be noted that the support arms 320A, 320B also advantageously provide stops that limit rotation of the post 44/arm carriage driver 90' to substantially 90 degrees, thus helping holding the post 44 in a substantially horizontal, storage position (FIG. 51) and stopping rotation at a vertical orientation of the post 44 (e.g. FIG. 47) when rotated from the storage position. Pins 80 and 82 can be inserted through apertures in the arm carriage 92' and the arm carriage driver, respectively, to retain their positions on the post 44 in the storage position.

Referring to FIG. 53. it is desirable to position the crossbeam 304 of the arm carriage 92' in an overlapping arrangement with respect to the arm carriage driver 90' so that the arms 36A and 36B are disposed proximate the upper surface 22A of the runway 22 to allow ends of the arms 36A, 36B to be placed beneath the frame of the vehicle. In thus embodiment, a spacer 323, a support plate 324 and end plates 326A, 326B support the crossbeam receiver 302 adjacent but spaced apart from the support plate 72D, where the compact nature of the pivot pin 310 allows such an arrangement to occur.

Figure 54:
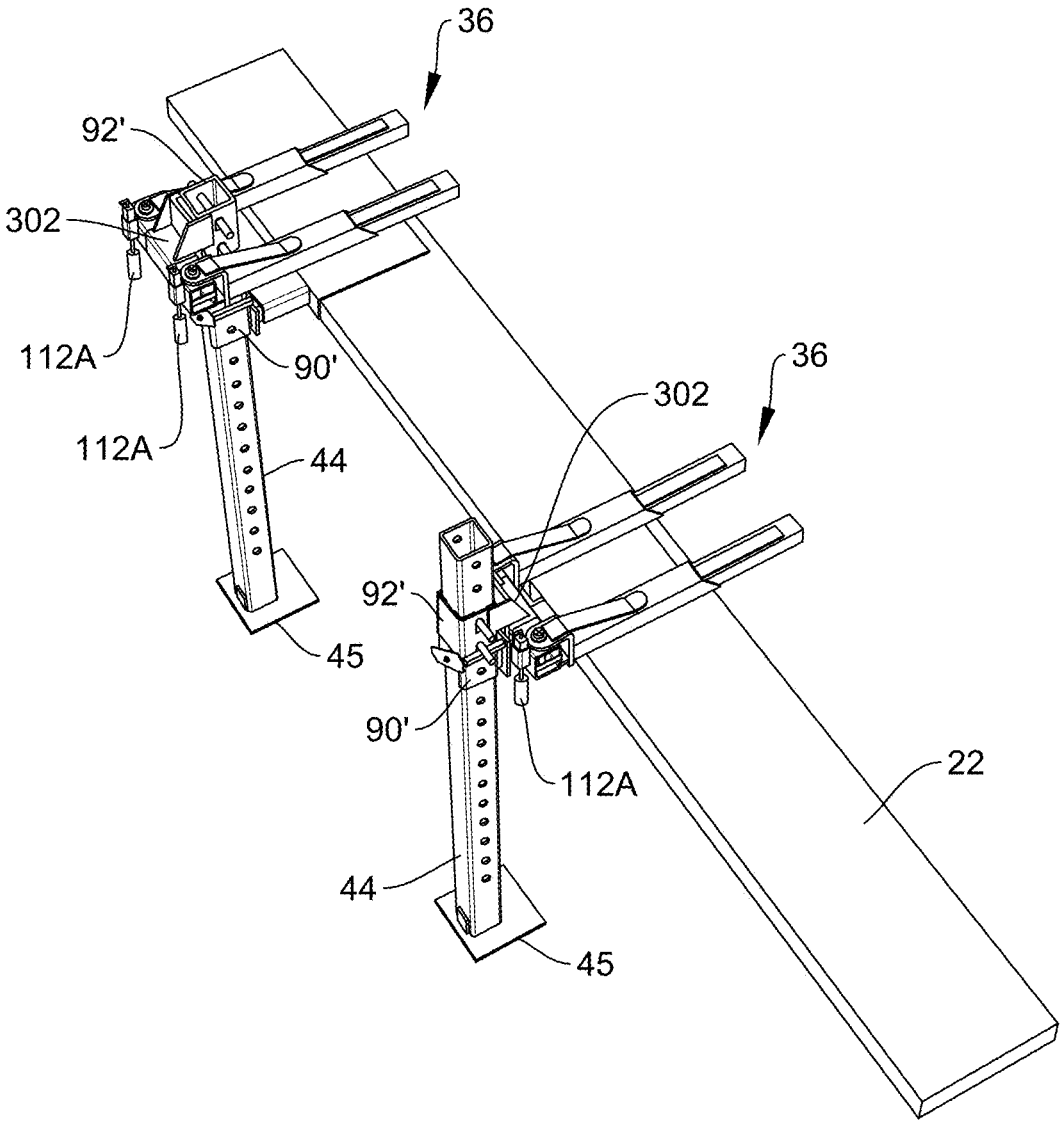
FIG. 54 is perspective views of the column assembly of FIG. 47 in two different positions.

FIG. 54 illustrates how the arm carriage 92' can be rotated 180 degrees so as to selectively position the crossbeam 304 between the post 44 and the runway 22, or on a side of the post 44 opposite the runway 22. This is advantageous because it thereby allows the overall reach of the arms 36A, 36B relative to the runway 22 to be adjustable without moving the base 45 on the floor. For instance, for smaller vehicles of less width it may be helpful to locate the crossbeam 304 between the post 44 and the runway 22, whereas this position may not work for larger, wider vehicles, where it is more useful to locate the crossbeam 304 on the side of the post 44 facing away from the runway 22. It should be noted that this is not limited to a post 44 and an arm carriage 92' having square cross-sections, but can be done with any post and arm carriage combination where symmetry exists relative to a plane parallel to a side surface of the runway 22.

Arm locks 110 are advantageously mounted to the end-caps 306A, 306B so that the locks 110 are in the proper position to selectively lock the arms in either of positions shown in FIG. 54. Lower ends of shafts 112, which operate the arm locks 110 in the manner described above, but in this embodiment where the shafts 112 make contact with the ground surface, and hence lock the arms in their angular positions when the carriage 92' is lifted by the associated runway 22. The shafts 112 can include cushions 112A.

Figure 55:
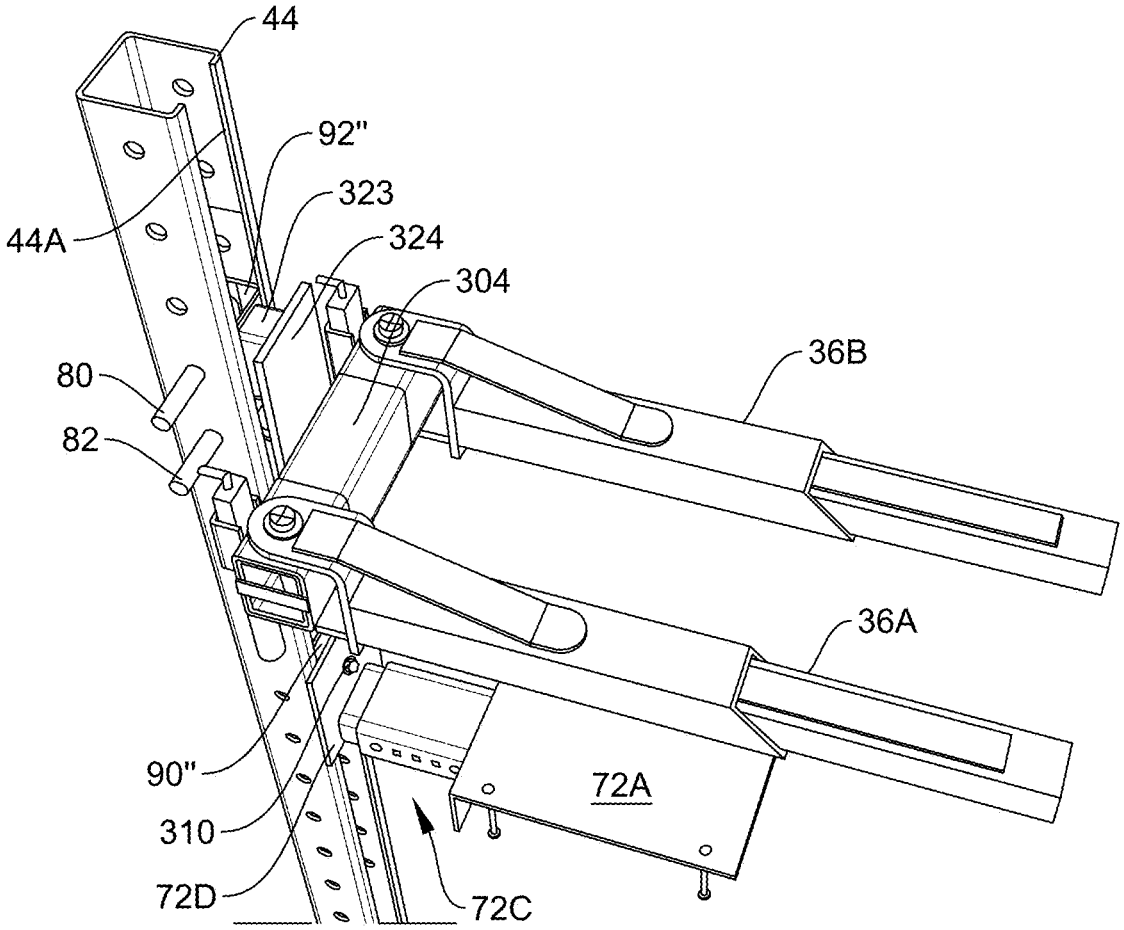
FIG. 55 is a partial perspective view of the another embodiment of a vehicle support assembly.

It should be noted that any of the foregoing arm carriages and/or arm carriage drivers need not be limited to structures that are disposed to the outside of the posts 44, but rather the arm carriages and/or arm carriage drivers can be disposed inside the posts 44 if desired. By way of example, FIG. 55 illustrates the post 44 can include a longitudinal slot 44A. An arm carriage 92" and an arm carriage driver 90" are disposed inside the post 44, the other components for example being the same as the previous embodiment. Various forms of slide plates, blocks, wheels or the like can be used to guide the arm carriage 92" and/or an arm carriage driver 90" in the post 44.

Figure 56:
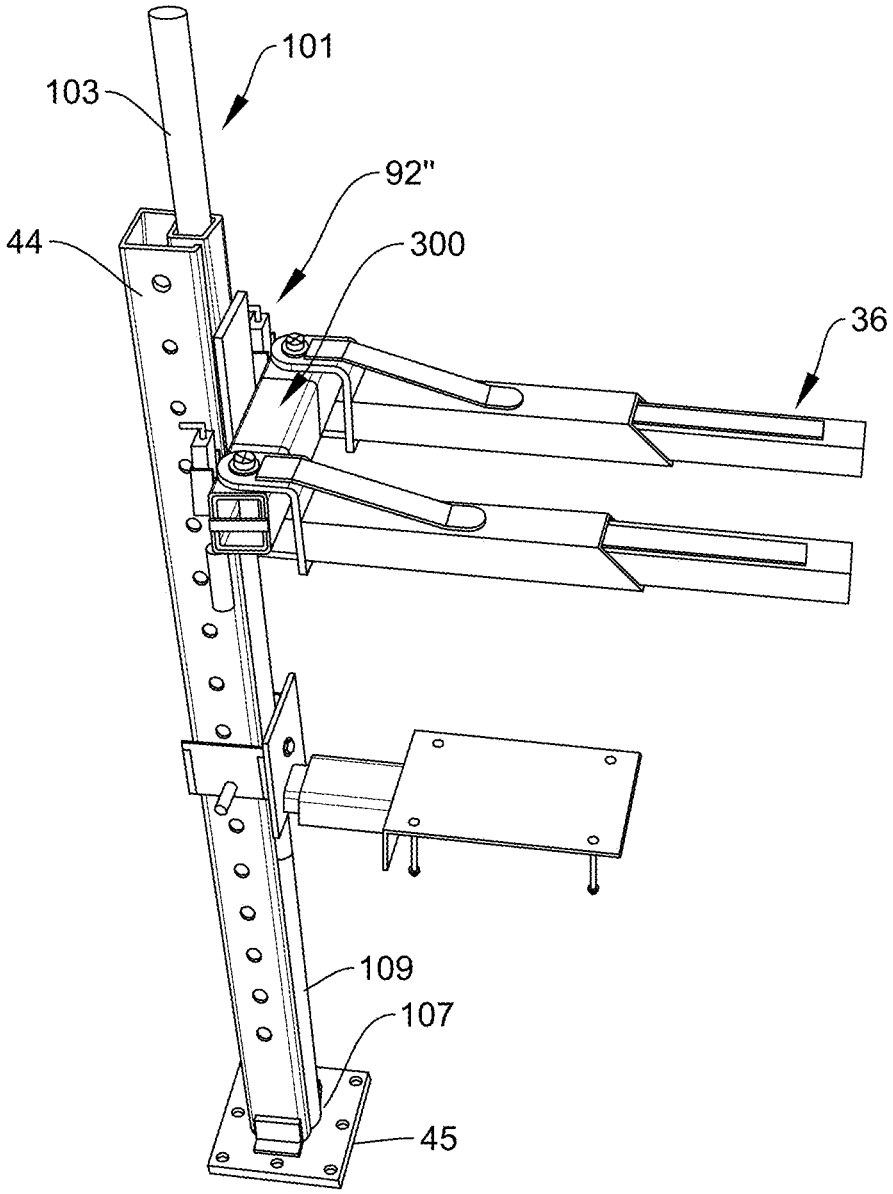
FIG. 56 is a perspective view of yet another embodiment of a vehicle support assembly.

FIG. 56 illustrates the arm carriage 92" of FIG. 55; however, an actuator 101 is also disposed in the post 44. A first portion such as a cylinder 103 of the actuator 101 is fixed attached to the arm carriage 92" while an end 107 of an actuator rod 109 abuts the base plate 45. The actuator 101 can comprise a single rod 109 and cylinder 103, or be of the form of a telescopic actuator having multi-stage telescopic cylinders.

Figure 57:
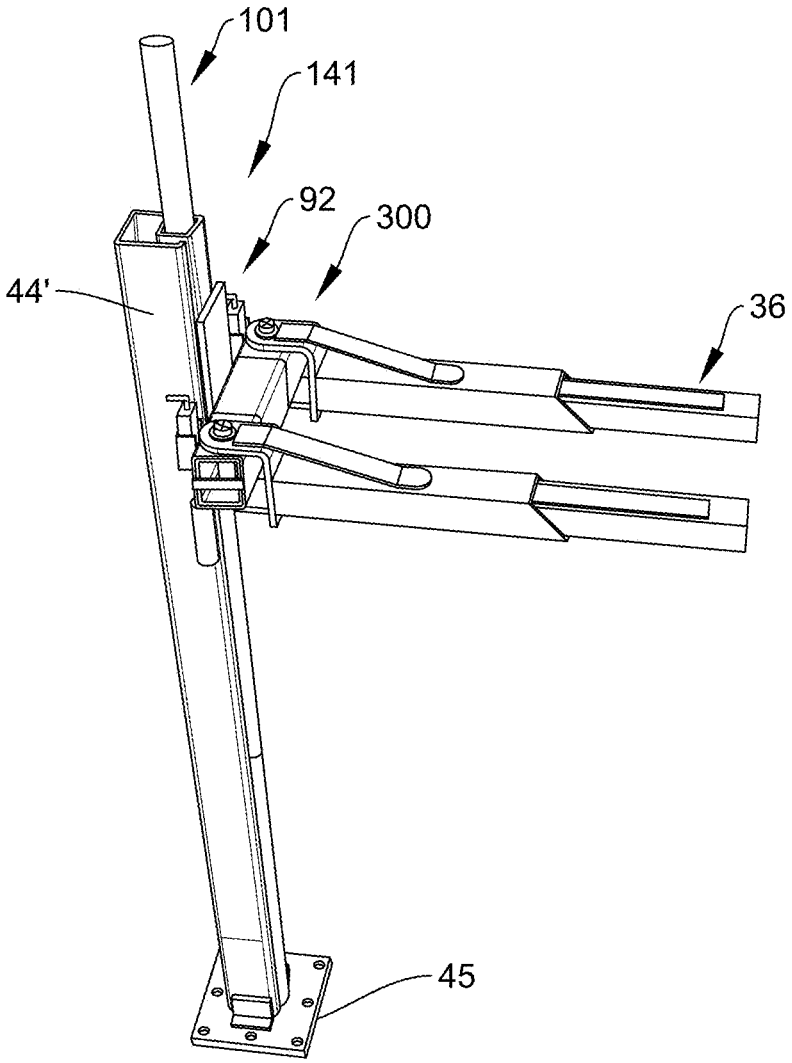
FIG. 57 is a perspective view of a further embodiment of a vehicle support assembly.

FIG. 57 illustrates a single column assembly 141 of a two-column lift. The column assembly 141 includes a post 44' having the arm carriage 92" and the actuator 101. The post 44' is not configured to be supported by a runway or rack of a lift but rather supported in an upright position by fasteners securing the base plate 45 to the ground. The arm carriage 92" includes the crossbeam assembly 300 as described above. Hence, the arms 36 can be arranged to extend in opposite directions as described above and illustrated in FIG. 54 so as to selectively vary the width between the crossbeam assemblies 300 of two columns assemblies arranged to lift vehicles as described below.

Figure 58:
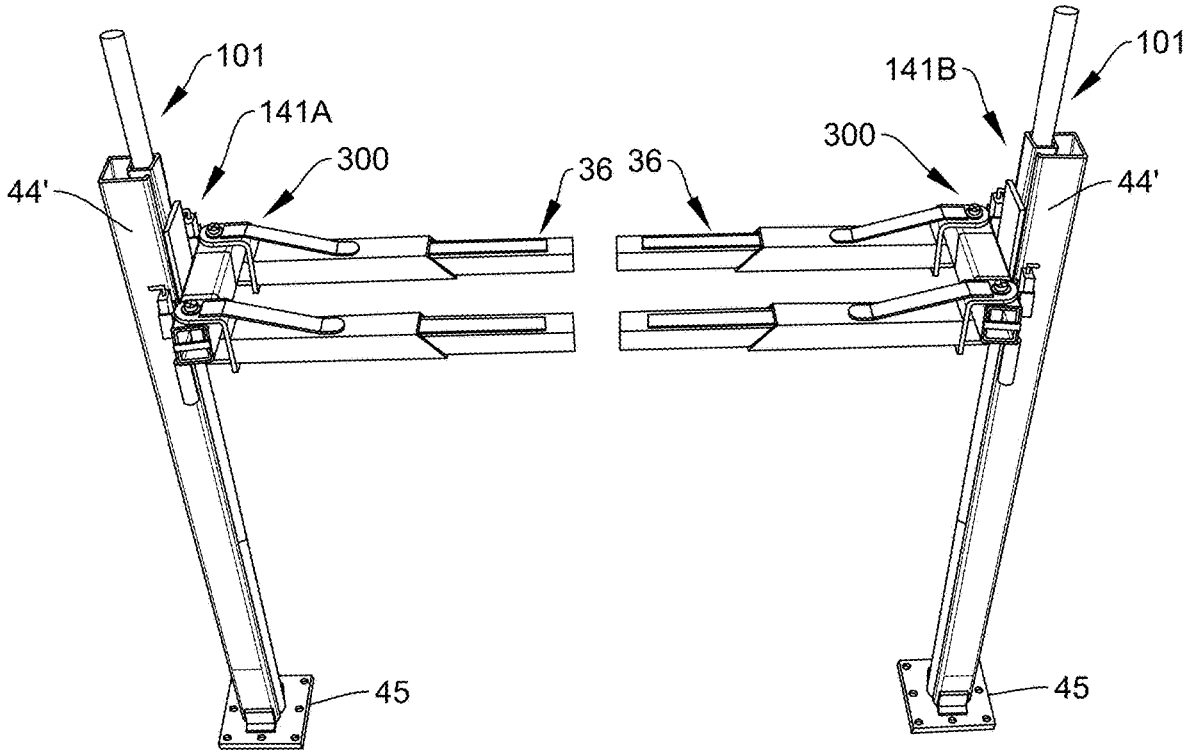
FIGS. 58-60 are perspective views of column assemblies of a vehicle support assembly in different positions.

FIG. 58 illustrates two-column lift where the column assemblies 141A, 141B are arranged to accommodate a vehicle of smaller width. It should be noted that the posts 44' of each column assembly are not centered on each corresponding base plate 45 but rather offset and not centered. In FIG. 58 the column assemblies 141A, 141B are secured such that a distance between the posts 44' is the narrowest. In addition, the column assemblies 141A, 141B are arranged such that the crossbeam assemblies 300 are closest to each other. This arrangement brings the opposed ends of arms 36 to be closest to each other.

Figure 59:
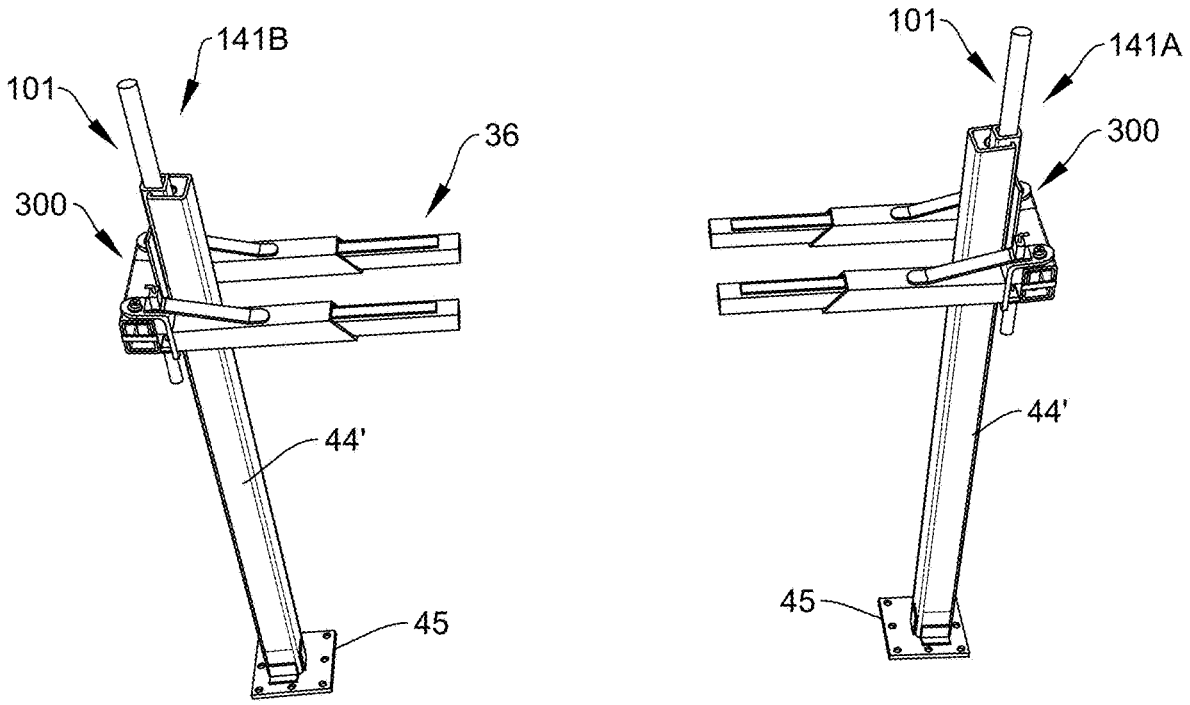

In contrast, in FIG. 59, the column assemblies 141A, 141B are now on opposite sides compared to FIG. 58, but are otherwise using the same mounting holes in the ground as used in FIG. 58. In other words, the distance between the base plates 45 in FIGS. 58 and 59 is the same. However, due to the offset mounting of the posts 44' on the base plates 45 and switching the column assemblies 141A, 141B to be on opposite sides from that of FIG. 58, the distance between the posts 44' in FIG. 59 is greater than that of FIG. 58. In addition, since the crossbeam assemblies 300 are also on the opposite sides of the posts 44' compared to FIG. 58, the distance between ends of the arms 36 is farther apart than that of FIG. 58. Hence, using the same mounting holes in the ground, the column assemblies 141A, 141B can be arranged to accommodate a vehicle of larger width.

Figure 60:
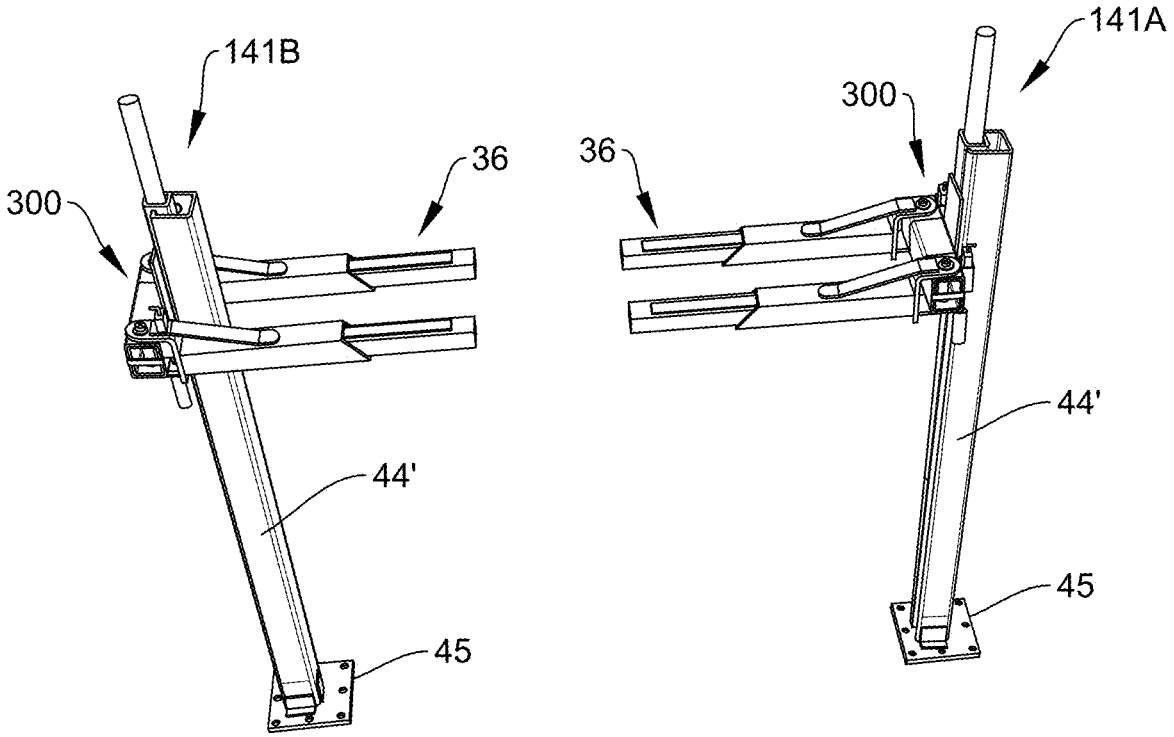

In FIG. 60, the base plates 45 are again at the same distance from each other as in FIGS. 58 and 49, but in FIG. 60, the column assemblies 141A, 141B are oriented in the same direction as opposed to opposite directions as in FIGS. 58 and 59. In this configuration, only one crossbeam assembly is located between the posts 44' whereas in FIG. 58 both the crossbeam assemblies 300 are located between the posts 44', while in FIG. 59 neither of the crossbeam assemblies 300 are located between the posts 44'. The distance between the posts 44' in FIG. 60 is greater than the spacing of FIG. 58, but less than the spacing of FIG. 59. Configuring the column assemblies 141A, 141B as illustrated in FIG. 58-60 allows the spacing between the posts 44' and arms 36 to adjusted as necessary to accommodate vehicles of different widths.

Figure 61:
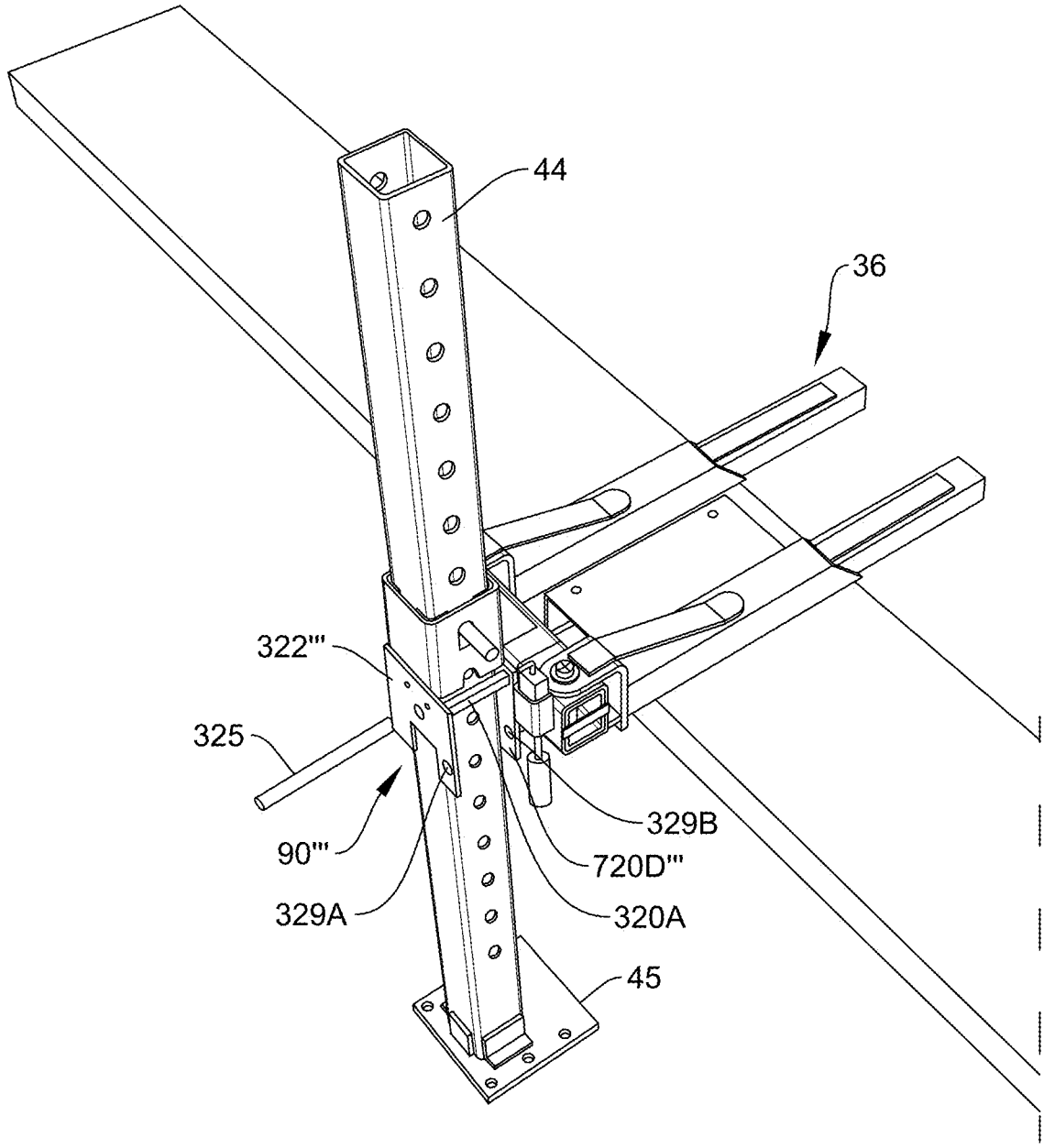
FIG. 61 is a perspective view of yet another embodiment of a vehicle support assembly.
Figure 62:
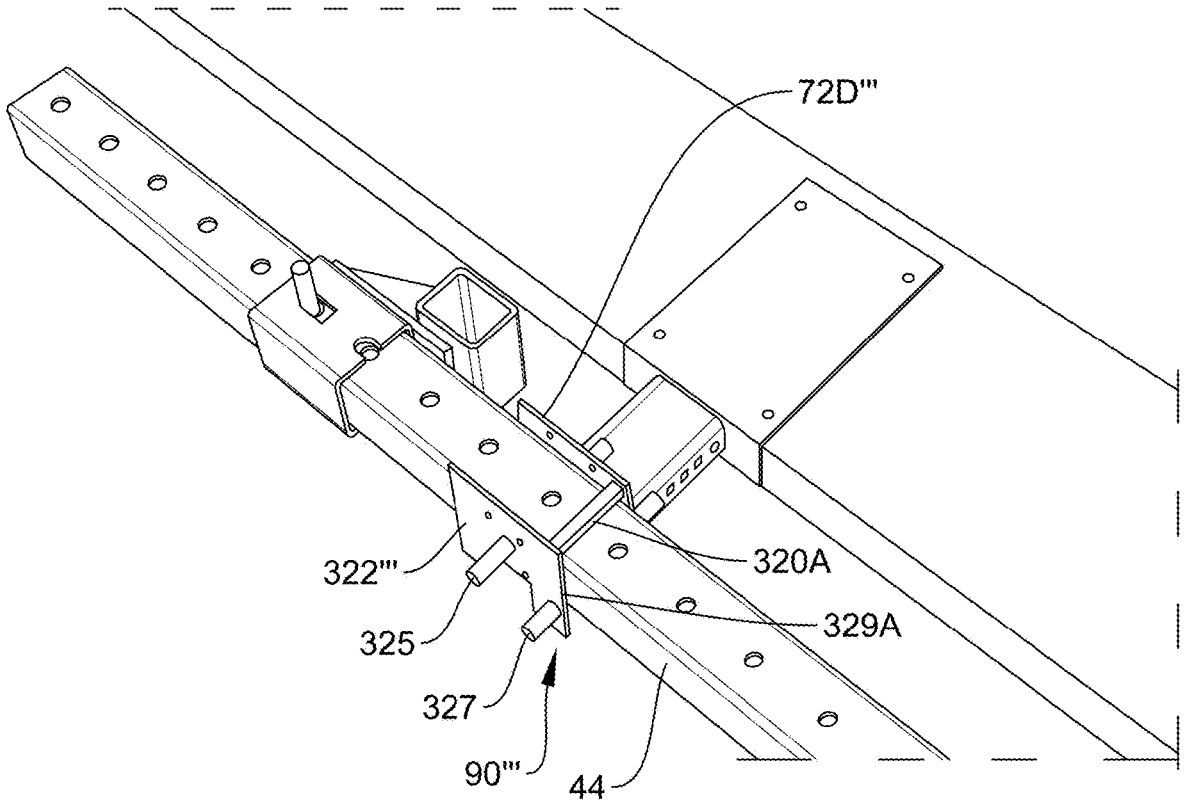
FIG. 62 is a partial perspective view of the vehicle support assembly of FIG. 61 in a storage position.

FIG. 61 illustrates another embodiment of an arm carriage driver 90'''. The arm carriage driver 90' includes spaced apart support plates 72D''' and 322'''. Support plate 72D''' is mounted to the runway herein using telescoping assembly 72C. Support arms 320A and 320B join the support plate 322''' to support plate 72D''' in a manner similar to the embodiment of FIG. 52. However, in this embodiment, the post 44 can pivot relative to the arm carriage driver 90''' when a pivot pin 325 is inserted in aligned apertures of support plates 72D''' and 322''' and also through aligned apertures in post 44. When the pivot pin 325 is inserted through the support plates 72D''' and 322' and the post 44 (FIG. 62), the post 44 can be rotated as desired between an operative (vertical) position illustrated in FIG. 61 and a storage (horizontal) position illustrated in FIG. 62. The support arms 320A, 320B limit pivotal movement. A second pin 327 can be inserted in apertures 329A and 329B in support plates 322' and 72D' when the post 44 is in the storage position and thereby preventing the post 44 from pivoting away from the storage position.

Figure 63:
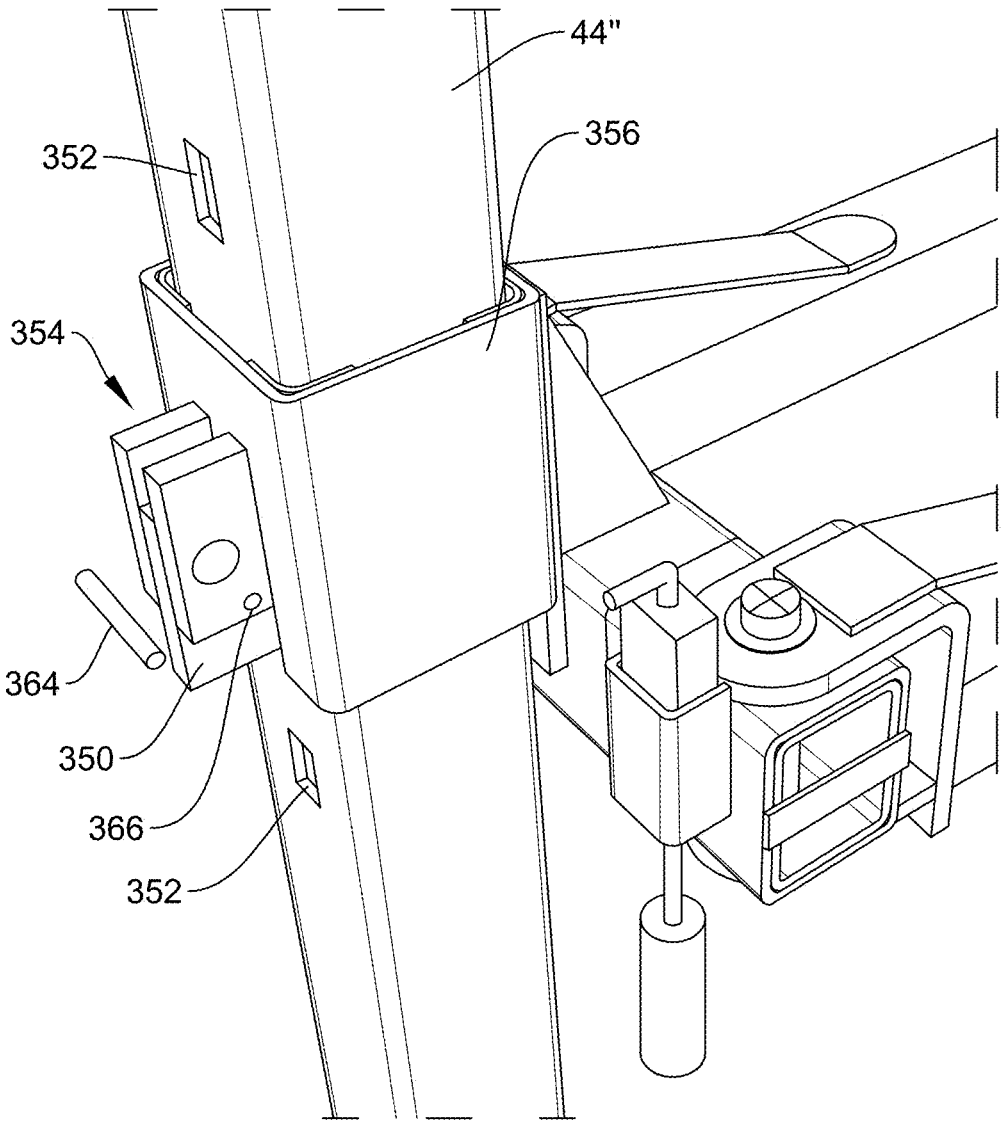
FIG. 63 is a perspective view of an arm carriage with a locking pawl.
Figure 64:
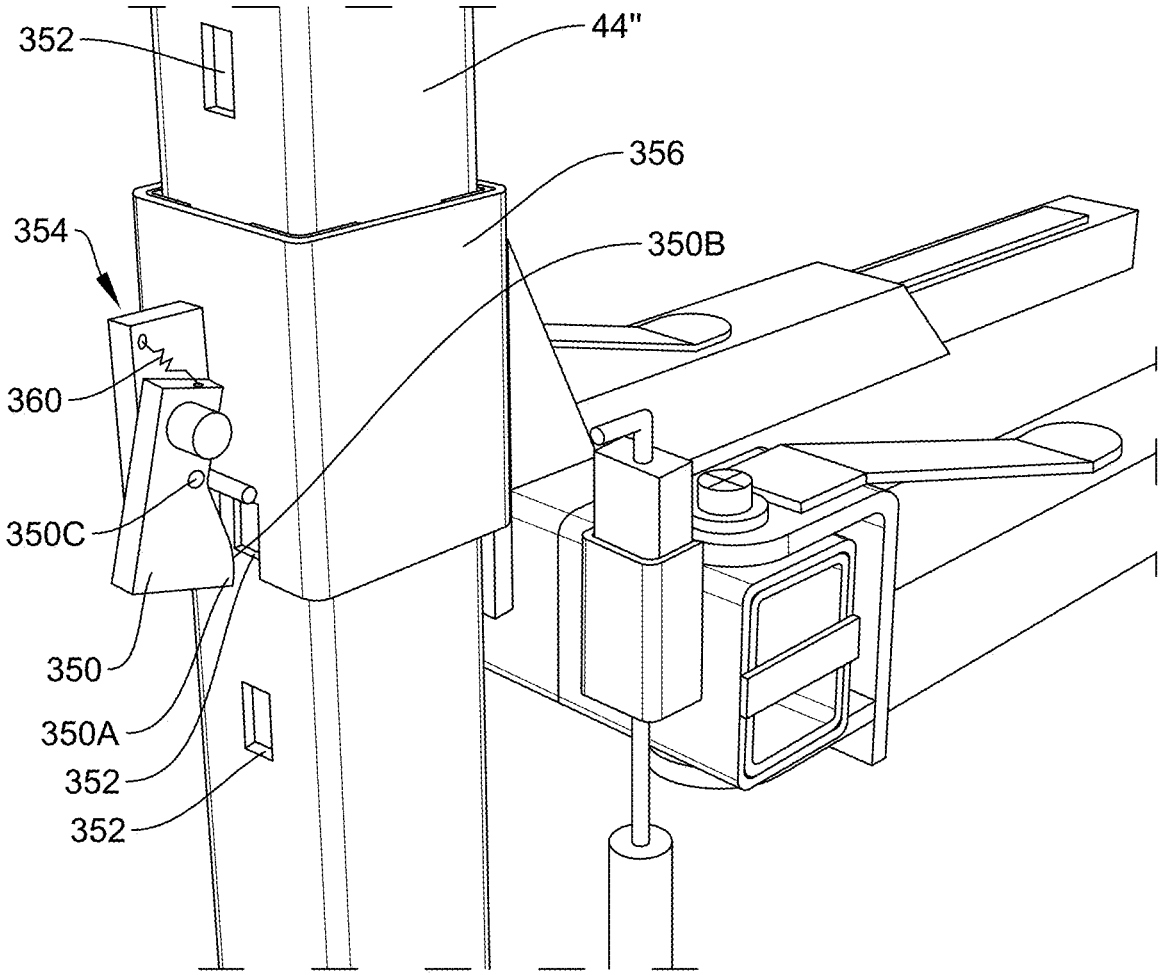
FIG. 64 is a partial perspective view of the embodiment of FIG. 63.

FIGS. 63 and 64 illustrate an exemplary carriage lock comprising a movable pawl 350 that selectively engages apertures 352 provided in post 44". In the embodiment illustrated, the pawl 350 is pivotally mounted to a standoff 354 secured to any of the arm carriages herein represented as 356. The pawl 350 includes an end 350A that can be inserted partially in one of the apertures 352 to obtain a desired height of the arm carriage 356 on the post 44". In a preferred embodiment, a bias spring 360 is arranged to urge the end 350A into the apertures 352. The end 350A can have an inclined surface 350B that urges the end 350A out of the apertures 352 successively as the arm carriage 356 is moved upwardly on the post 44", while the spring 360 urges the end 350A back into an aperture 352 when the end 350A is aligned with the aperture 352. The pawl 350 transfers the load from the arm carriage 356 to the post 44". If desired, a pin 364 can be inserted in aligned apertures 366 in the standoff 354 (one of which is illustrated at 366) and aperture 350C of the pawl 350 to ensure the end 350A projects into and stays in the aperture 352. When it is desired to lower the arm carriage 356, the arm carriage 356 can be lifted upwardly slightly by the arm driver such that the pawl 350 can be rotated to remove the end 350A from the aperture 352. The pin 364 can then be inserted in the aligned apertures 366 of the standoff 354, which then blocks the pawl 350 from rotating back, thus keeping the end 350A from entering an aperture 352 (FIG. 64) as the arm carriage 356 is lowered.

FIGS. 65-68 illustrate yet further embodiments of support assemblies usable with the vehicle lift assembly 10 described above. The support assemblies illustrated in these figures all include support arms that are not cantilevered, or only coupled to a support column assembly at one end where the other free end supports the vehicle, but rather support arms that extend between support column assemblies, where the support arm span across at least one and in some instances both of the runways 22 of the vehicle lift assembly 10. Since the arms are supported at each end the support column assemblies do not experience any substantial torque that would cause the support columns to rotate but rather the force on each support column assembly is substantially vertical.

Figure 65:
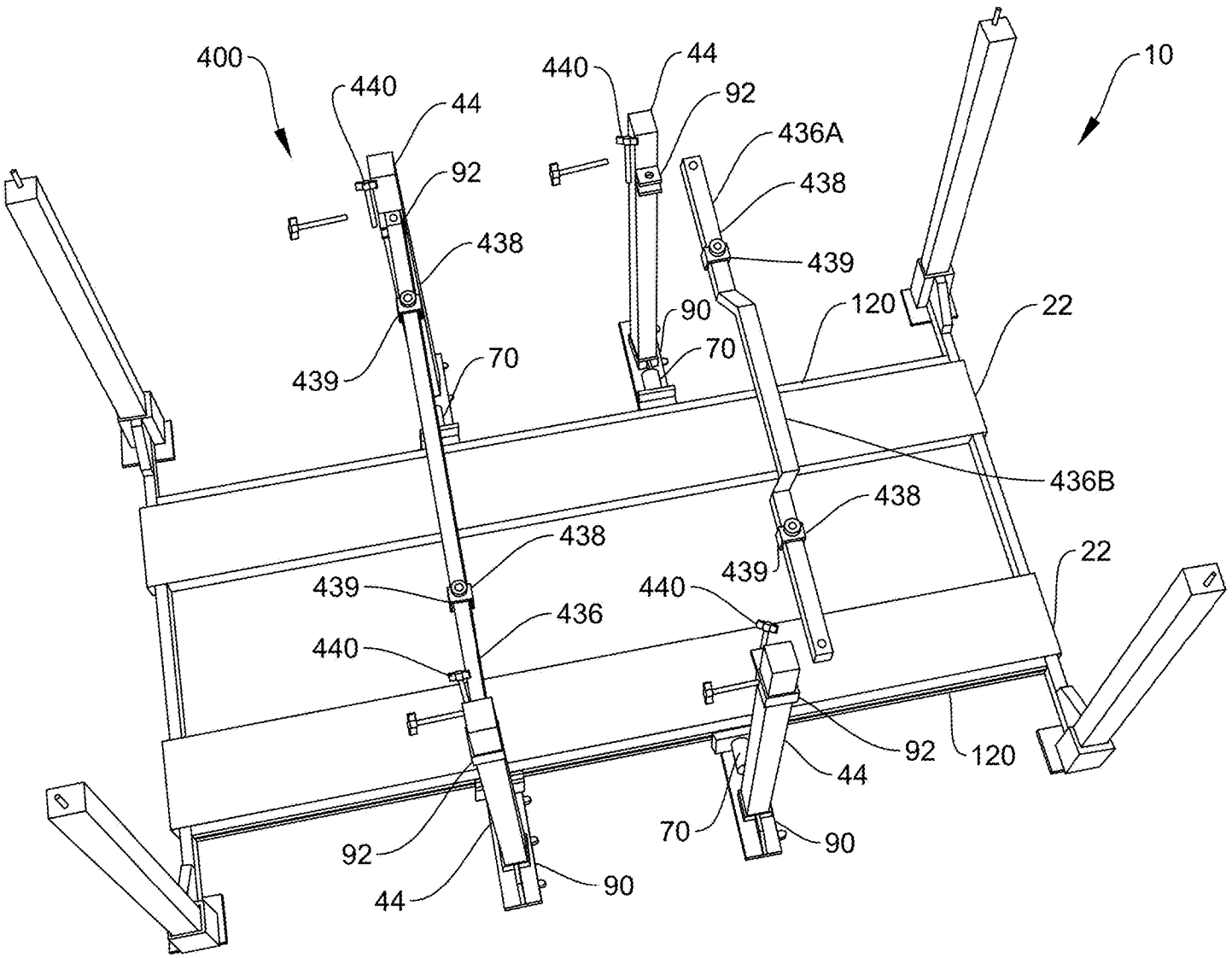
FIG. 65 is a perspective view of another vehicle support assembly.

Referring to FIG. 65 where reference numbers for components described above are identified and perform substantially if not the same function. A support assembly 400 comprises a four support posts 44 arranged in pairs such that a single support arm 436 extends between each pair of support posts 44, each end of the arm 436 being removably coupled to an arm carriage 92. An arm carriage driver 90 is disposed below each associated arm carriage 92 and lifts the arm carriage 92 because the arm carriage drive is coupled to the runway 22. In this embodiment, an optional pivot assembly 70 allows the post to be pivoted between horizontal and vertical positions as described above. Optionally, the arm carriage driver 90 can be slidably coupled to guide 120. In this manner, each of the posts can be moved to any of the storage positions described above. Generally in this embodiment, each arm carriage driver 90 as well as the post 44 coupled thereto is movable linearly along the runway so as to allow the support arm 436 to be positioned where desired under the vehicle. Preferably, each arm 436 includes a pair of movable support elements 438 that are movable along each arm 436 such that the support element 438 can be located so as to properly engage the lift point on the vehicle. The support element can include a U-shaped collar 439 so as to restrain movement only linearly along the support arm 436.

In one embodiment, the support arm 436 can be straight with being coupled to each arm carriage 92 with pins 440. Typically, the support elements 438 are of sufficient height such that the center sections of the arms 436 do not contact lower elements of the vehicle. However, if desired a support arm 436A that has an offset center section 436B, i.e. not being in line with the ends of the support arm 436 coupled to the arm carriages 92. The offset center section 436B maintains the necessary rigidity of the arm but with selective rotation of the arm 436A prior to coupling of the arm 436A to the arm carriages 92, the offset section 436B can be positioned so as to extend further downwardly than the portions of the arm coupled to the arm carriage 92, or to one end of the other of the lift assembly 10. In the embodiment illustrated, the support arm 436A is of a square shape with apertures on opposite side that are aligned with each other, allowing the arm 436 to be coupled to the arm carriages in four different orientations. It should be noted a cylindrical ends could be provided on the arm 436A that fits in a suitable cylindrical receiver, allowing the arm 436A to be rotated to any desired position.

Figure 66:
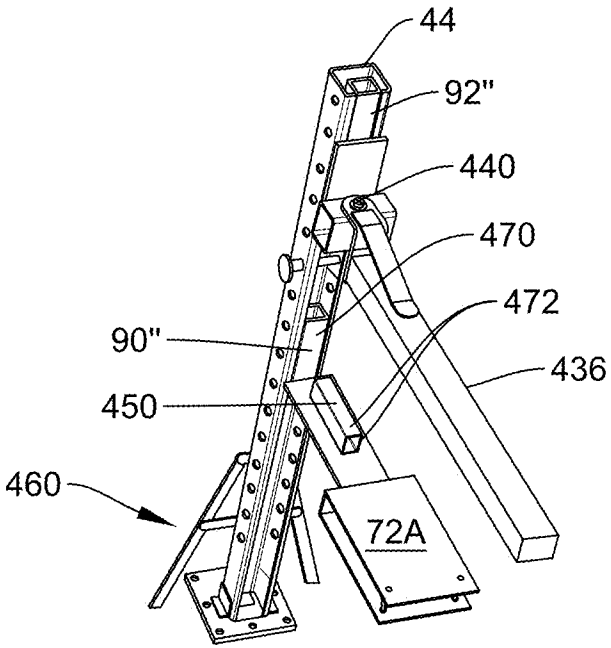
FIG. 66 is a perspective view of a support column assemblies in two different positons.
Figure 66:
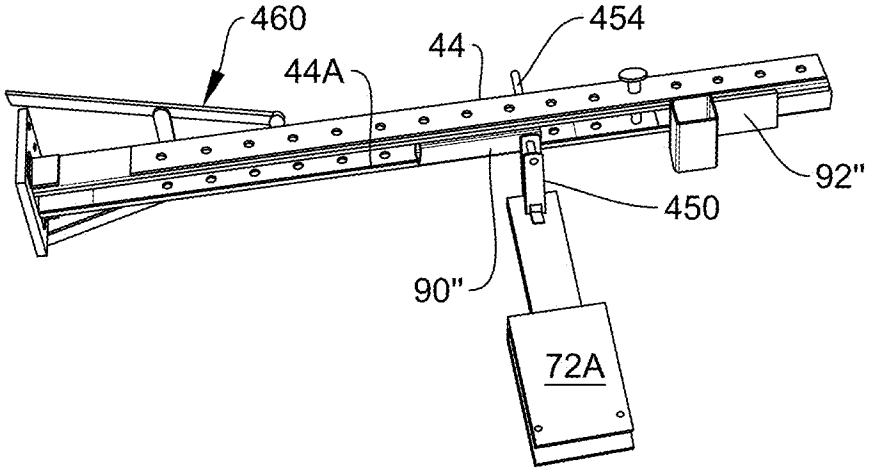

As in the embodiments described above, the arm carriages and/or arm carriage drivers need not be limited to structures that are disposed to the outside of the posts 44, but rather the arm carriages and/or arm carriage drivers can be disposed inside the posts 44 if desired. By way of example, FIG. 66 illustrates the post 44 can include a longitudinal slot 44A. An arm carriage 92" and an arm carriage driver 90" are disposed inside the post 44, the other components for example being the same as the previous embodiment. Various forms of slide plates, blocks, wheels or the like can be used to guide the arm carriage 92" and/or an arm carriage driver 90" in the post 44. The support arm 436 is again coupled to arm carriage 92" with a pin 440.

In this embodiment, the arm carriage driver 90" is detachably coupled to support post 450 that is pivotally coupled to a mounting portion 72A that preferably is slidable on the runway 22 so as to again allow the post 44 and arm 436 thereattached to be located where needed such that support elements 438 engage the lift points of the vehicle. An advantage of an arm carriage 92" and arm carriage driver 90" that slides inside the post 44 is that additional lateral support indicated at 460 can be attached to the post 44 so as to provide additional stability. A pin 454 through an aperture provided in the back side of the post 44 and through apertures 470 in the carriage driver 90" and apertures 472 in post 450 allows the post 44 to pivot.

Figure 67:
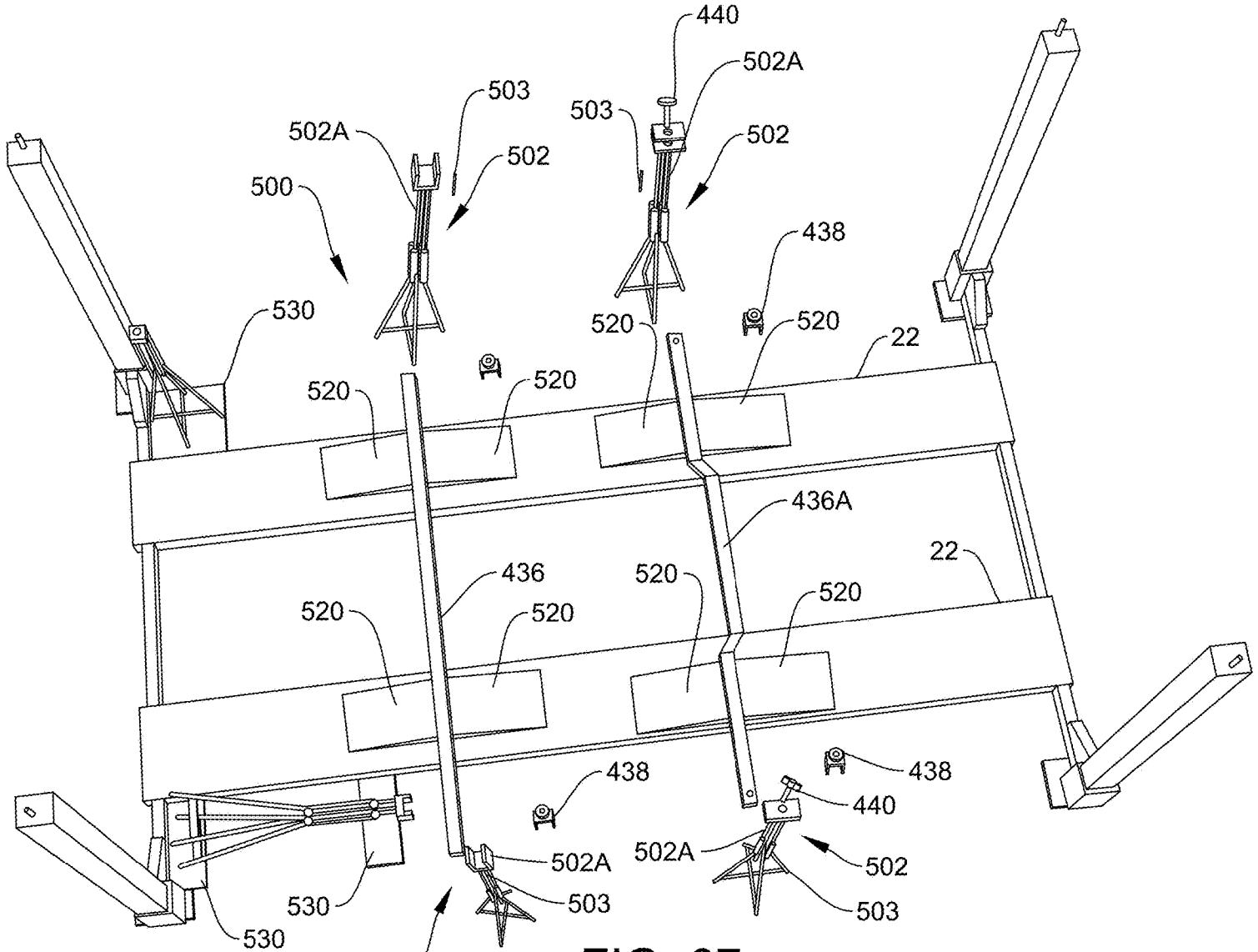
FIG. 67 is a perspective view of yet another vehicle support assembly.

FIG. 67 illustrates a support assembly 500 that has posts 502 that are adjustable in height such as in a telescoping manner with cross pins 503 extending through aligned apertures provided in the posts 502 to maintain upper portions 502A of posts 502 at the desired height. In this embodiment the posts are not in any manner coupled to the runways but rather are free from the runways 22 allowing each to placed along side the runway 22 where needed to properly position the support arms 436 or 436A and support elements 438 where needed under the vehicle. The support posts 44 for support arm 436 do not have an overt coupling with the ends of the arm 436, but rather the arms 436 are retained in a U-Shaped end at the top of each post. However, the posts 44 for arm 436A include a receiver 506, which allows the arm 436A to be oriented as desired and then held in the selected position with pins 440.

One method for supporting a vehicle in an elevated position on support assemblies 400 or 500 is as follows. The arms 436, 436A are placed upon the runways 22 transversely. Ramps 520 can be provided on the runways 22 on each side of the arms 436, 436A. The ramps 520 allows the vehicle to be driven onto the runways such that the support arms 436, 436 are properly positioned below the vehicle, typically between the front and rear wheels. It should be noted that the posts 44 in can be in one of the storage positions as described above depending on whether the posts are coupled to the runways with arm carriage drivers. For support assembly 500, the posts 502 can be removed from their storage positions on optional mounts 530 that allow the posts 502 to move up and down with the runways 22 and placed adjacent to the runways 22 as illustrated.

The vehicle lift 10 is then operated to lift the vehicle and the arms 436, 436A to a desired height. (The ramps 520 can be removed if desired.) If the posts 44 are in the horizontal position, the posts 44 will move up with the runways 22. If the posts 44 are horizontal, they are manipulated as described above to a vertical position and lowered back to the ground. At some point, the posts 44 are adjusted so as to be in a proper position along the length of the runway 22. For the posts 44 of FIGS. 65 and 66, once the desired height of the vehicle has been obtained, pins are used to hold the arm carriages 30 and 90" in the selected vertical position on the posts. For posts 502, the telescoping portions of the posts are raised and then held in position by cross pins. The arms 436, 436A can be coupled to the posts 44 or 502 and the support elements 438 can be positioned on the arms 436, 436 so as to properly engage the lift point of the vehicle. The runways 22 can then be lowered thereby transferring the vehicle from the lift assembly to the support assembly 400 or 500. The reverse procedure is used to return the vehicle to the lift assembly and remove the vehicle from the lift assembly.

Figure 68:
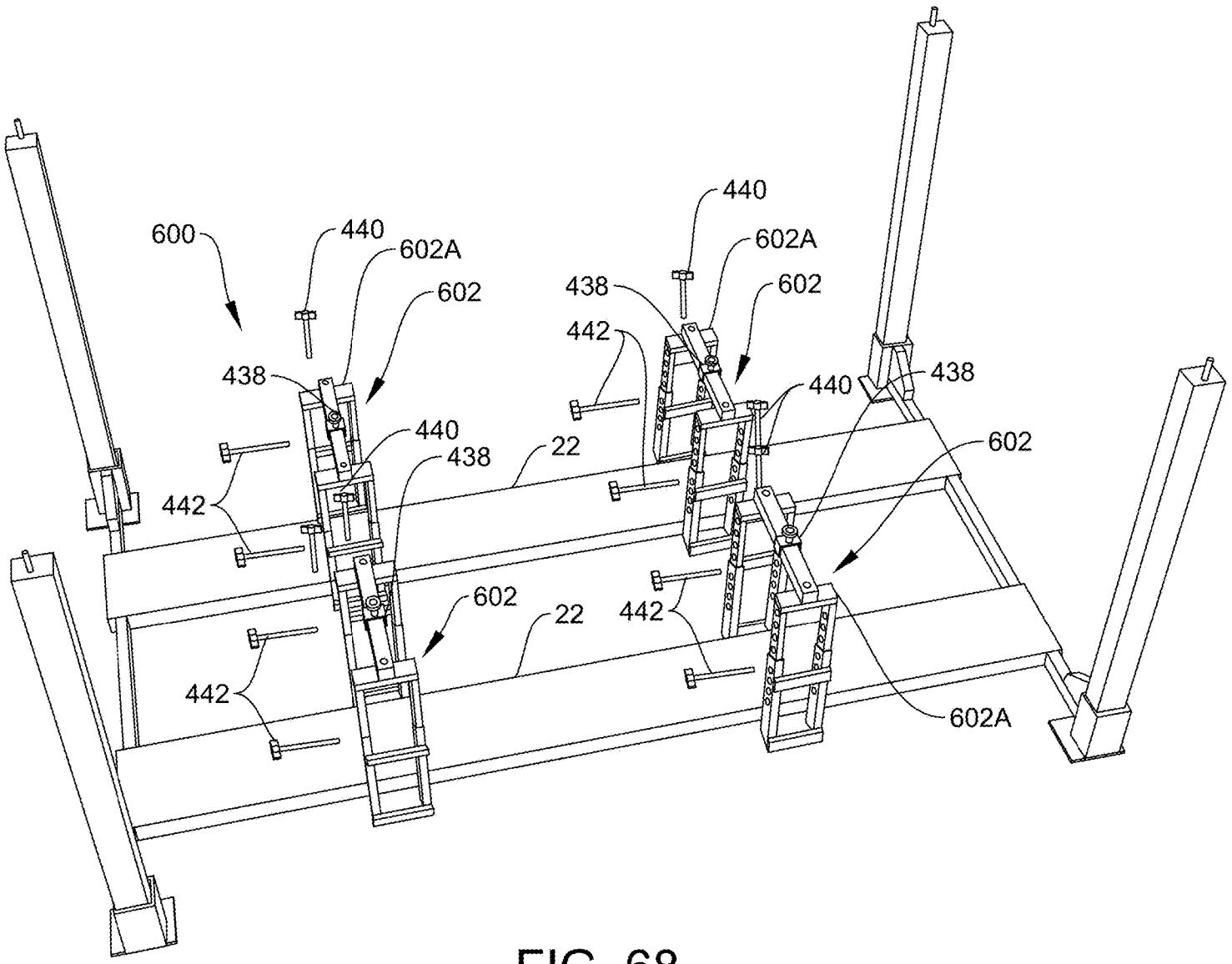
FIG. 68 is a perspective view of yet another vehicle support assembly.

FIG. 68 illustrates a support assembly 600 having telescoping post assemblies 602, where each post assembly straddles one runway 22. The support arms 636 thus extend over only one runway rather than across both runways. Pins 442 are used to adjust the height of the post assemblies 602 and can be used to couple the arms 636 to upper portions 602A of the post assemblies 602.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims.

What is claimed is:

1. A vehicle support assembly mountable to a runway vehicle lift having a frame with a plurality of vertically oriented spaced apart supports, a rack having a plurality of portions, wherein each portion is movably coupled to a different vertically oriented support, a runway vehicle support supported on the rack, a lift actuator coupled to the rack to move the rack and the runway vehicle support up and down, the vehicle support assembly comprising:

a pair of carriage assemblies, each carriage assembly having an arm carriage and a two movable arms, each arm having a first end coupled to the arm carriage and a second end configured to engage an undercarriage of a vehicle; and a pair of posts wherein each post supports a carriage assembly, each post being movably coupled to the runway vehicle lift with a mount to move the post to and from a first position wherein the post is arranged vertically with the arms extended to support a vehicle above the runway vehicle support and a second storage position wherein the post is displaced from the first position.

2. The vehicle support assembly of claim 1 wherein each carriage assembly is movable on each respective post.

3. The vehicle support assembly of claim 2 wherein each carriage assembly is coupled to each associated mount that is securable to the runway vehicle support.

4. The vehicle support assembly of claim 3 wherein each carriage assembly includes an arm carriage driver movable on the associated post, the arm carriage driver coupled to the associated mount and disposed on the associated post below the associated arm carriage, the arm carriage driver being separable from the associated arm carriage and movable on the associated post when the runway vehicle support is lowered.

5. The vehicle support assembly of claim 3 wherein each carriage assembly is pivotally coupled to the associated mount allowing each associated post to be inclined with respect to the runway vehicle support.

6. The vehicle support assembly of claim 5 wherein the second storage position comprises each post being oriented parallel to the runway vehicle support, and wherein the posts move up and down with the rack and runway vehicle support.

7. The vehicle support assembly of claim 3 wherein each mount comprises a pair of horizontal guides securable to the runway vehicle lift, wherein each carriage assembly is slidably coupled to a horizontal guide allowing each associated carriage assembly and post to move alongside the runway vehicle support.

8. The vehicle support assembly of claim 7 wherein the horizontal guides are stationary relative to movement of the runway vehicle support.

9. The vehicle support assembly of claim 3 wherein each carriage assembly is slidably coupled to the runway vehicle support allowing each associated carriage assembly and post to move alongside the runway vehicle support.

10. The vehicle support assembly of claim 9 wherein the second storage position comprise each post and carriage assembly disposed proximate an end of the runway vehicle support.

11. The vehicle support assembly of claim 9 wherein each carriage assembly is pivotally coupled to the associated mount allowing each associated post to be inclined with respect to the runway vehicle support.

12. The vehicle support assembly of claim 11 wherein the second storage position comprises either the post being oriented parallel to the runway vehicle support, and wherein the pair of posts move up and down with the rack and runway vehicle support, or each post and carriage assembly is disposed proximate an end of the runway vehicle support.

13. The vehicle support assembly of claim 1 and further comprising a pair of carriage locks, each carriage lock configured to hold one of the arm carriages at a selected elevated position on each associated post.

14. The vehicle support assembly of claim 13 wherein the carriage assemblies are coupled to the runway vehicle support wherein the selected elevated position of each arm carriage is obtained by moving the runway vehicle support vertically to move the arm carriage on each respective post.

15. The vehicle support assembly of claim 14 wherein the arms are configured to be placed under the undercarriage of a vehicle with the vehicle supported by the runway vehicle support in the selected elevated position, and wherein the arms support the vehicle in the selected elevated position when the runway vehicle support is lowered and separated from the vehicle.

16. The vehicle support assembly of claim 1 wherein each post includes a second lift actuator coupled to and configured to move each associated arm carriage with respect to each associated post.

17. The vehicle support assembly of claim 1 wherein each post does not include any lift actuator to directly move either one or both of the arm carriages.

18. The vehicle support assembly of claim 1 wherein the runway vehicle support comprises spaced apart runways.

19. The vehicle support assembly of claim 1 and at least one pivotable, telescoping jack stand coupled to the runway vehicle support and having an end engageable with the vehicle.

20. The vehicle support assembly of claim 1 and at least one flexible member having a first end coupled to the frame, rack or runway vehicle support and connectable to the vehicle at a second end.

21. A vehicle support assembly mountable to a runway vehicle lift having a frame with a plurality of vertically oriented spaced apart supports, a rack having a plurality of portions, wherein each portion is movably coupled to a different vertically oriented support, a runway vehicle support supported on the rack, a lift actuator coupled to the rack to move the rack and the runway vehicle support up and down, the vehicle support assembly comprising:

a plurality of carriage assemblies, each carriage assembly having an arm carriage;

a plurality of arms, wherein an arm is supported at each end by one of the arm carriages; and a plurality of posts wherein each post supports one of the carriage assemblies, each post being movably coupled to the runway vehicle lift with a mount to move the post to and from a first position wherein the post is arranged vertically with the arms extended to support a vehicle above the runway vehicle support and a second storage position wherein the post is displaced from the first position, and wherein each arm is of length to extend from the associated post and extend over at least a portion of the runway vehicle support.

* * * * *